United States Patent [19]

Schirmer et al.

[11] Patent Number: 4,927,349

[45] Date of Patent: May 22, 1990

[54] METHOD FOR BURNING NITROGEN-CONTAINING FUELS

[75] Inventors: Robert M. Schirmer; Ellsworth H. Fromm; Henry E. Alquist, all of Bartlesville, Okla.

[73] Assignee: Phillips Petroleum Company, Bartlesville, Okla.

[21] Appl. No.: 118,827

[22] Filed: Nov. 9, 1987

Related U.S. Application Data

[60] Division of Ser. No. 272,442, Jun. 10, 1981, Pat. No. 4,721,454, which is a continuation-in-part of Ser. No. 932,820, Aug. 10, 1978, abandoned, which is a continuation-in-part of Ser. No. 800,361, May 25, 1977, abandoned.

[51] Int. Cl.[5] ..... F23M 3/04

[52] U.S. Cl. ..... 431/10; 431/352; 60/732

[58] Field of Search ..... 431/10, 351, 352; 60/39.02, 732, 733, 752–760

[56] References Cited

U.S. PATENT DOCUMENTS

| | | | |
|---|---|---|---|
| 2,206,553 | 7/1940 | Nagel | 431/10 |
| 2,577,918 | 12/1951 | Rowe | 60/732 |
| 3,052,287 | 9/1962 | Shirley | 431/10 |
| 3,174,530 | 3/1965 | Meenan | 158/1 |
| 3,376,098 | 4/1968 | Pryor | 431/10 |
| 3,850,569 | 11/1974 | Alquist | 60/39.05 |
| 3,856,455 | 12/1974 | Otway et al. | 431/10 |
| 3,915,619 | 10/1975 | Quigg et al. | 60/732 |
| 3,927,520 | 12/1975 | Arvin et al. | 60/39.23 |
| 3,958,416 | 5/1976 | Hammond et al. | 60/39.65 |
| 4,006,589 | 2/1977 | Schirmer | 60/39.02 |
| 4,007,002 | 2/1977 | Schirmer | 431/10 |
| 4,021,186 | 5/1977 | Tenner | 431/10 |
| 4,041,699 | 8/1977 | Schelp | 60/732 |
| 4,049,021 | 9/1977 | Fromm et al. | 137/626.31 |
| 4,054,028 | 10/1977 | Kawaguchi | 60/39.23 |
| 4,054,407 | 10/1977 | Carrubba et al. | 431/10 |
| 4,060,376 | 11/1977 | Perédi | 432/24 |
| 4,060,378 | 11/1977 | Perédi | 432/96 |
| 4,205,524 | 6/1980 | Schirmer | 60/39.06 |
| 4,255,115 | 3/1981 | Graat et al. | 431/10 |

FOREIGN PATENT DOCUMENTS

| | | |
|---|---|---|
| 0009523 | 4/1980 | European Pat. Off. . |
| 1107877 | 5/1961 | Fed. Rep. of Germany . |
| 2243813 | 3/1974 | Fed. Rep. of Germany . |

*Primary Examiner*—Margaret A. Focarino
*Attorney, Agent, or Firm*—A. L. Robbins

[57] ABSTRACT

A method for burning a fuel, containing chemically bound nitrogen, in a two-stage, rich-lean combustion process, including; introducing the fuel and at least one stream of primary air into a primary combustion region at a fuel-air ratio above the stoichiometric ratio and in a manner to intimately mix the fuel and air and establish a stabilized flame adjacent the upstream end of the primary combustion region, maintaining the flame in the primary combustion region for a period of time sufficient to produce a combustion product mixture containing less than a predetermined amount of $NO_x$ pollutants and abruptly terminating the primary combustion region while introducing at least one stream of secondary air into the secondary region in an amount sufficient to reduce the overall fuel-air ratio below the stoichiometric ratio and in a manner to prevent backflow of the secondary air into the primary combustion region. A method for initiating and maintaining the combustion process is described as well as apparatus for carrying out the combustion process.

13 Claims, 59 Drawing Sheets

COMBUSTOR G

FIG. 11
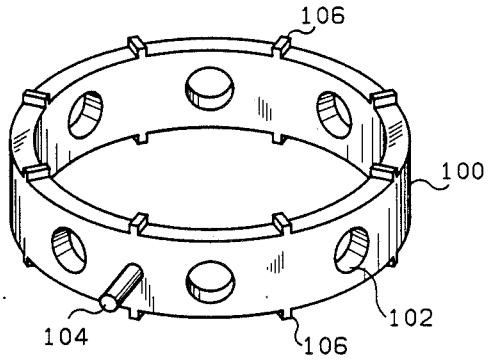
FIG. 12
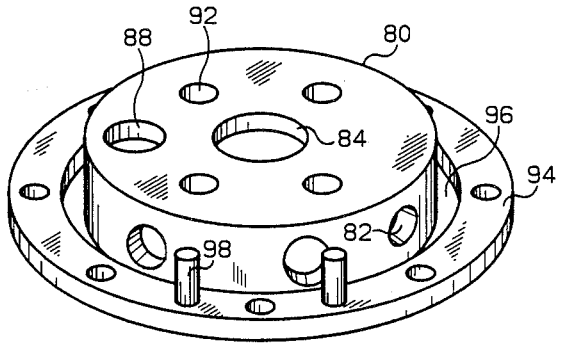
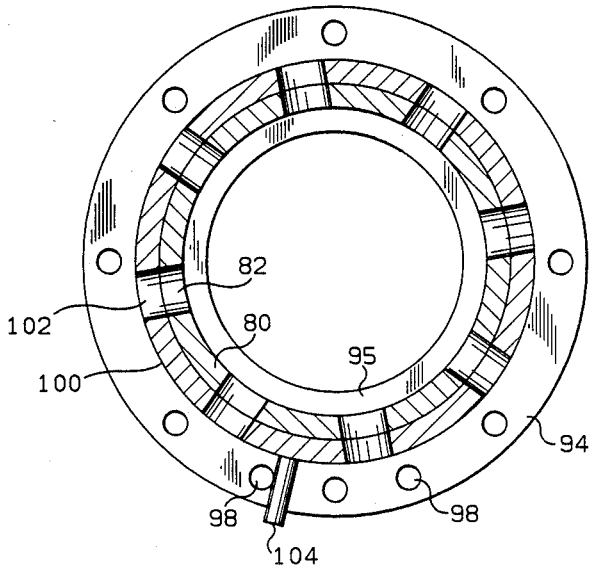
FIG. 13

COMBUSTOR G

COMBUSTOR H

COMBUSTOR I

COMBUSTOR H

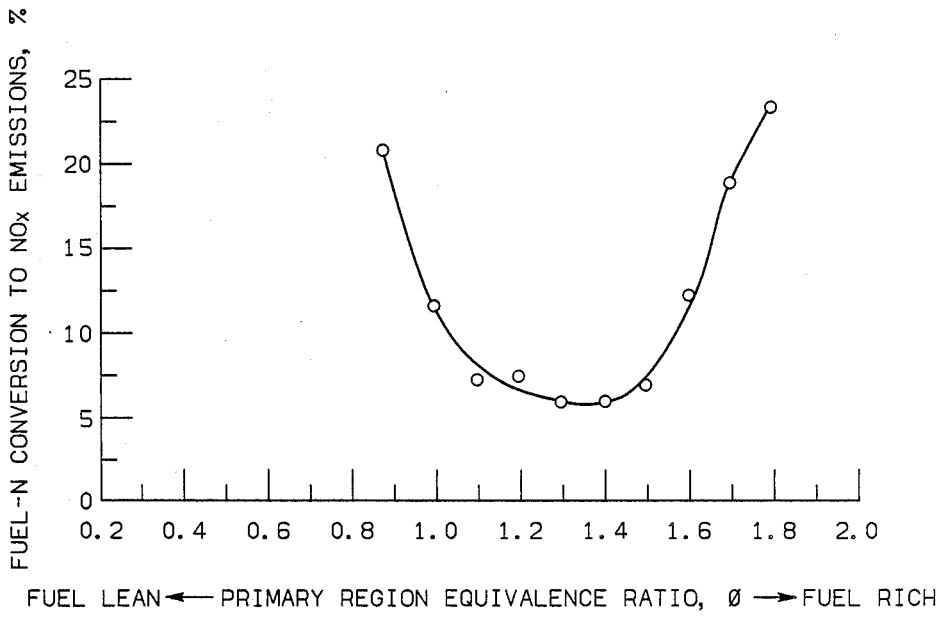
FIG. 38 (EX. I)

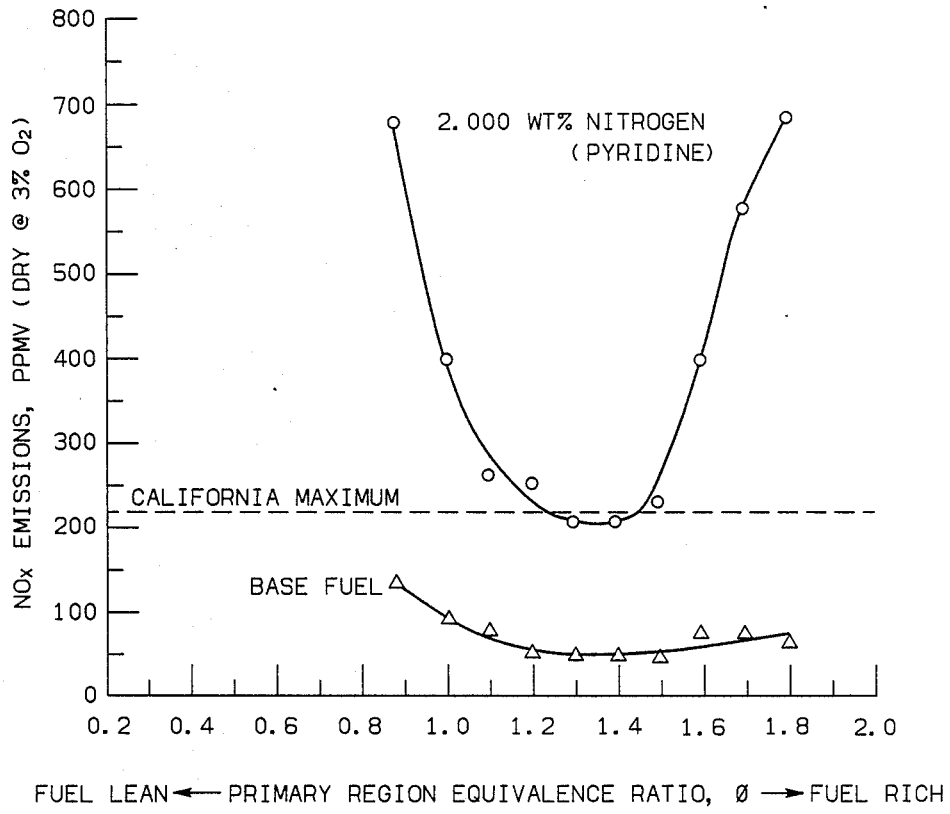
FIG. 39 (EX. I)

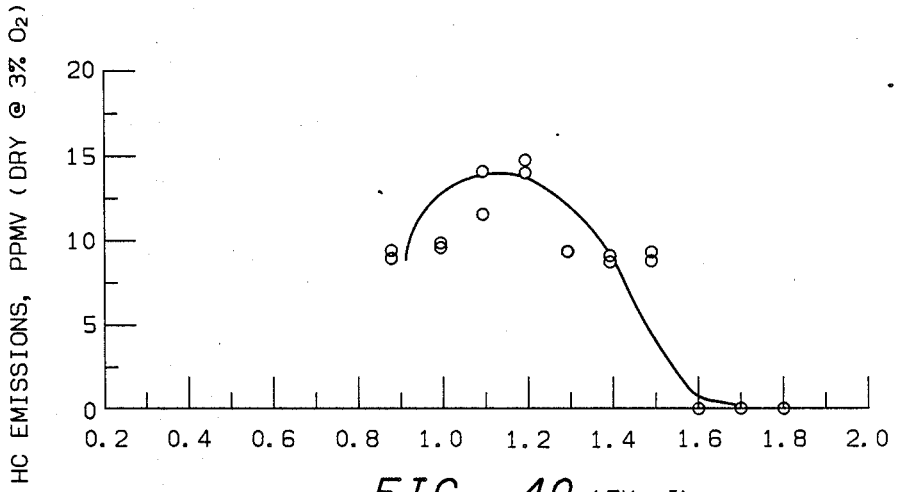
FIG. 40 (EX. I)
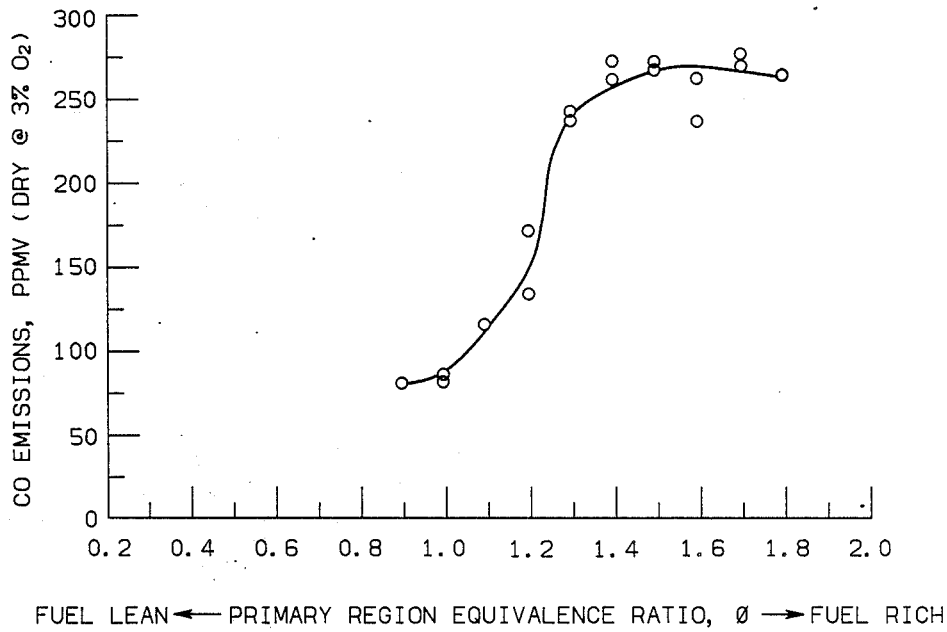
FIG. 41 (EX. I)

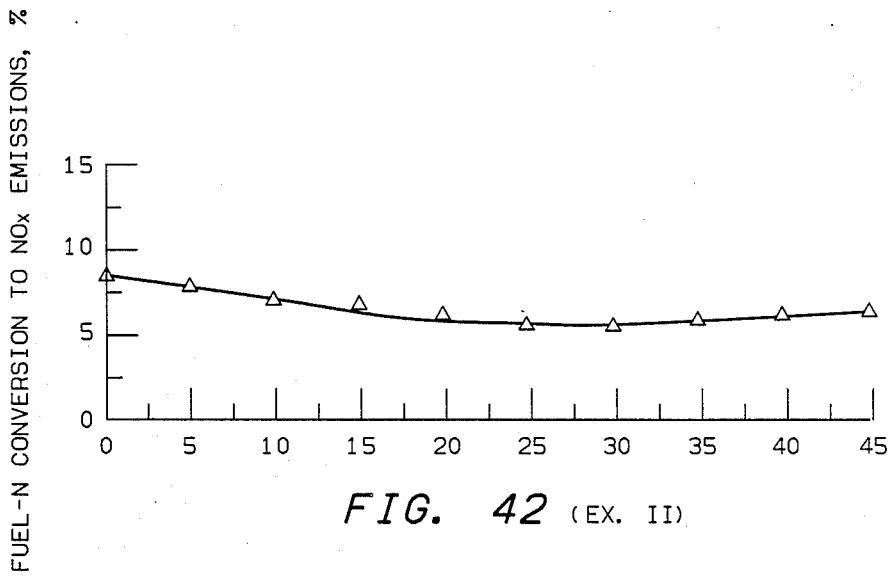
FIG. 42 (EX. II)
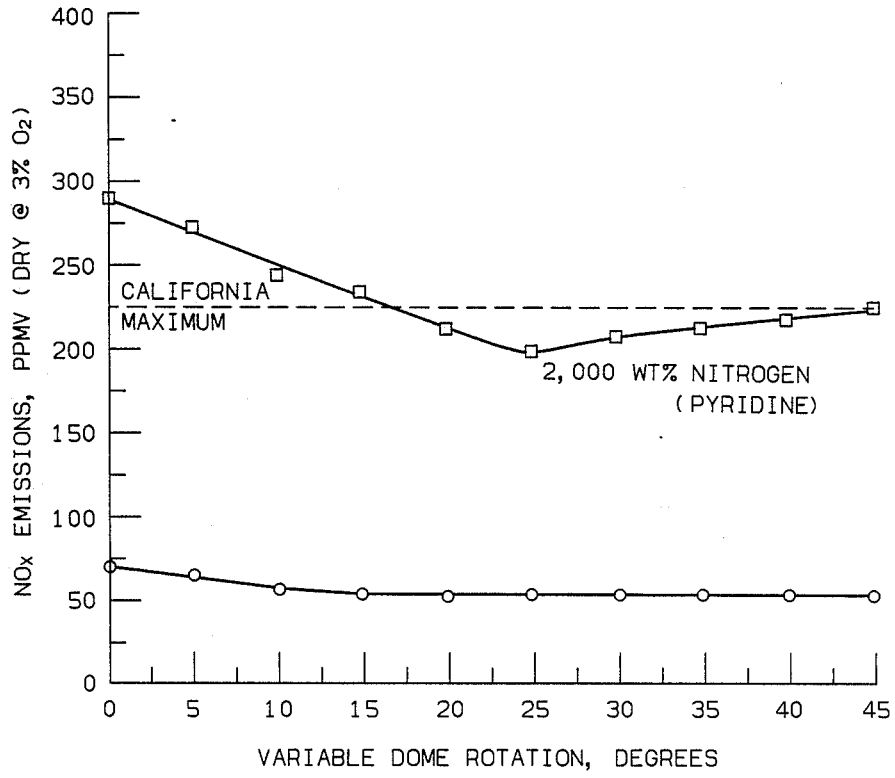
FIG. 43 (EX. II)

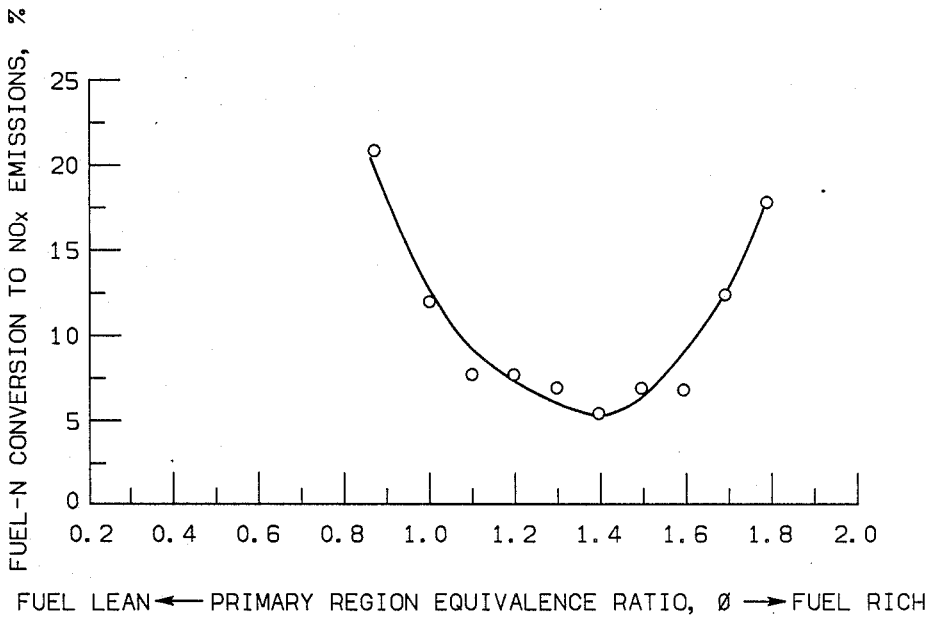
FIG. 44 (EX. II)

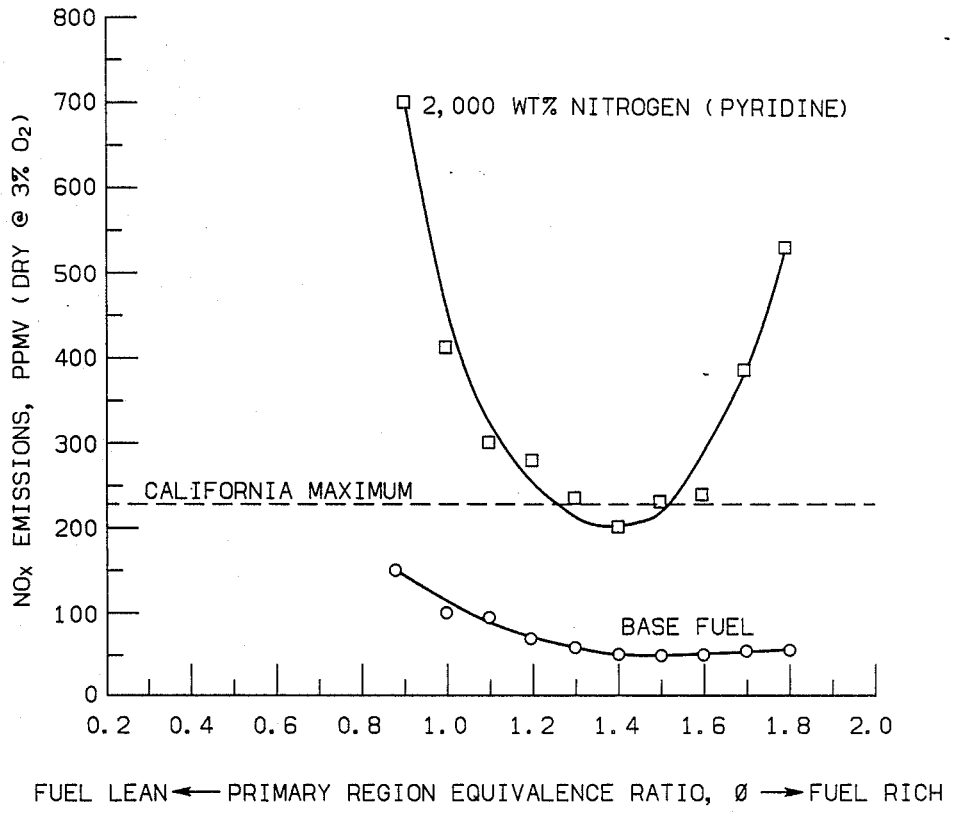
FIG. 45 (EX. II)

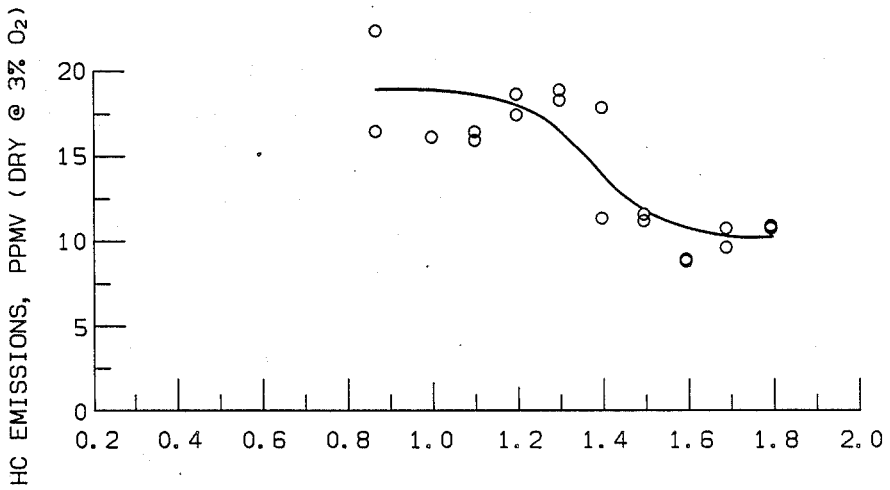
FIG. 46 (EX. II)
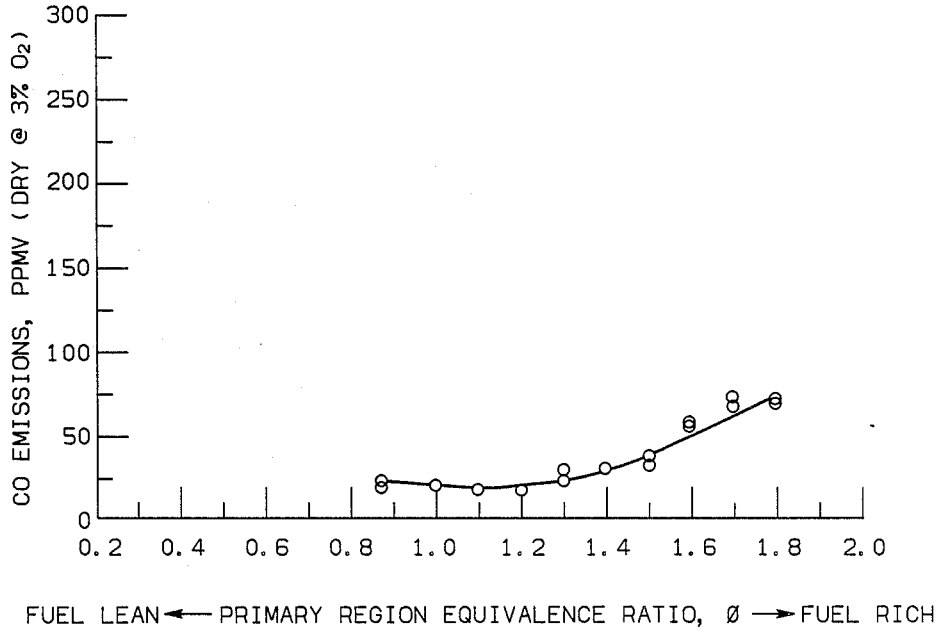
FIG. 47 (EX. II)

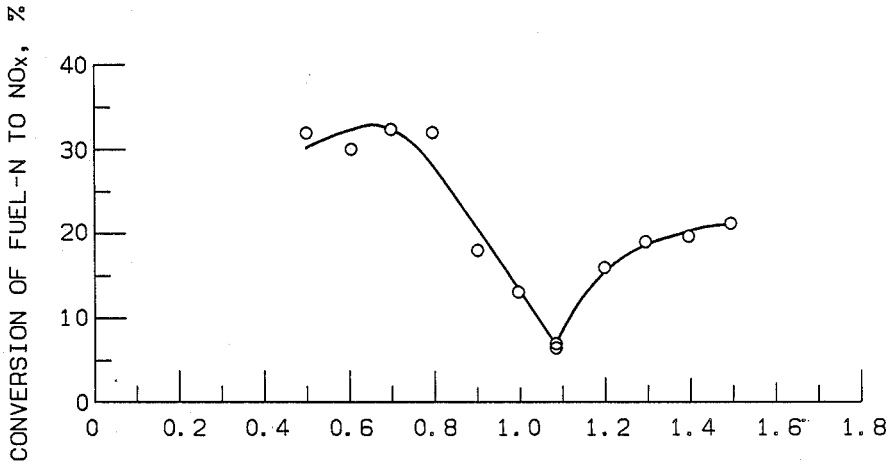
FIG. 48 (EX. IV)
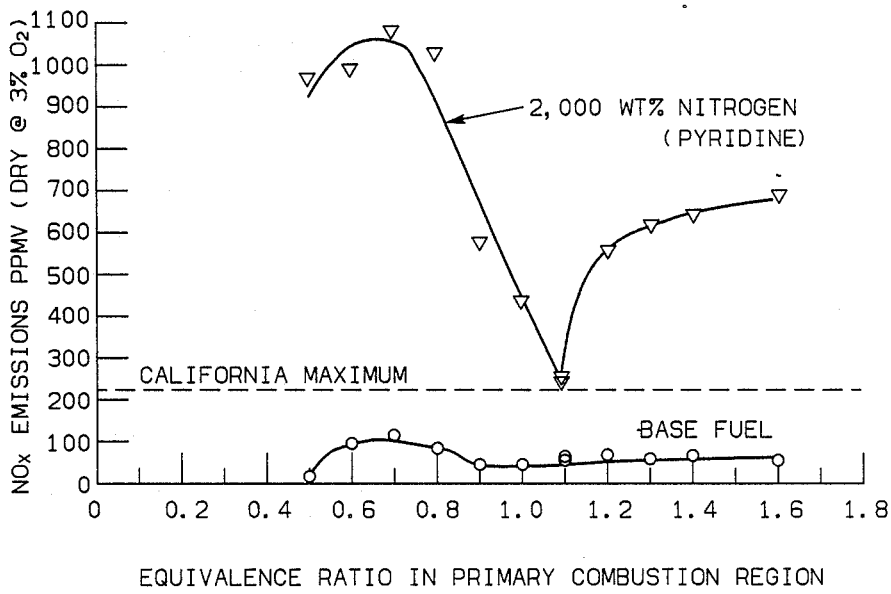
FIG. 49 (EX. IV)

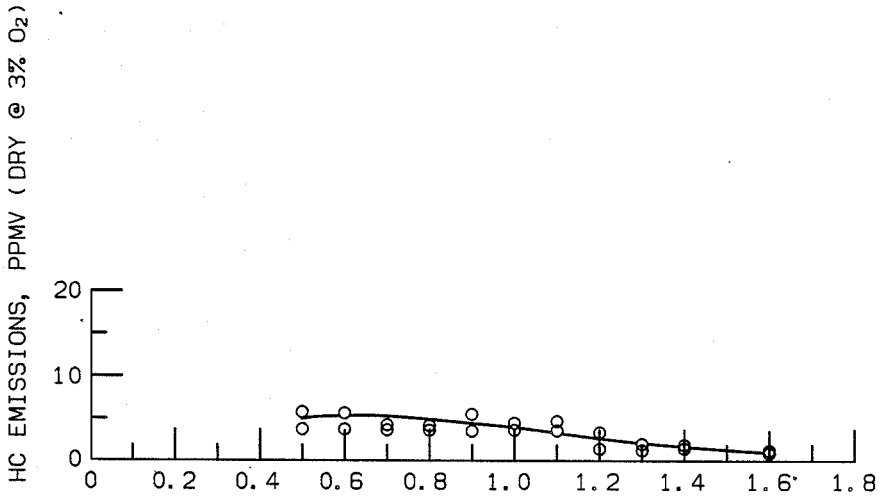
FIG. 50 (EX. IV)
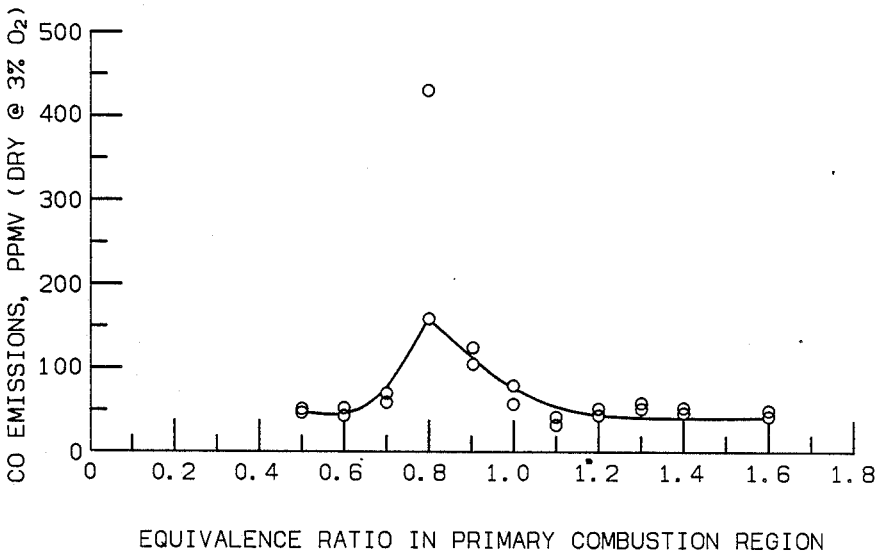
FIG. 51 (EX. IV)

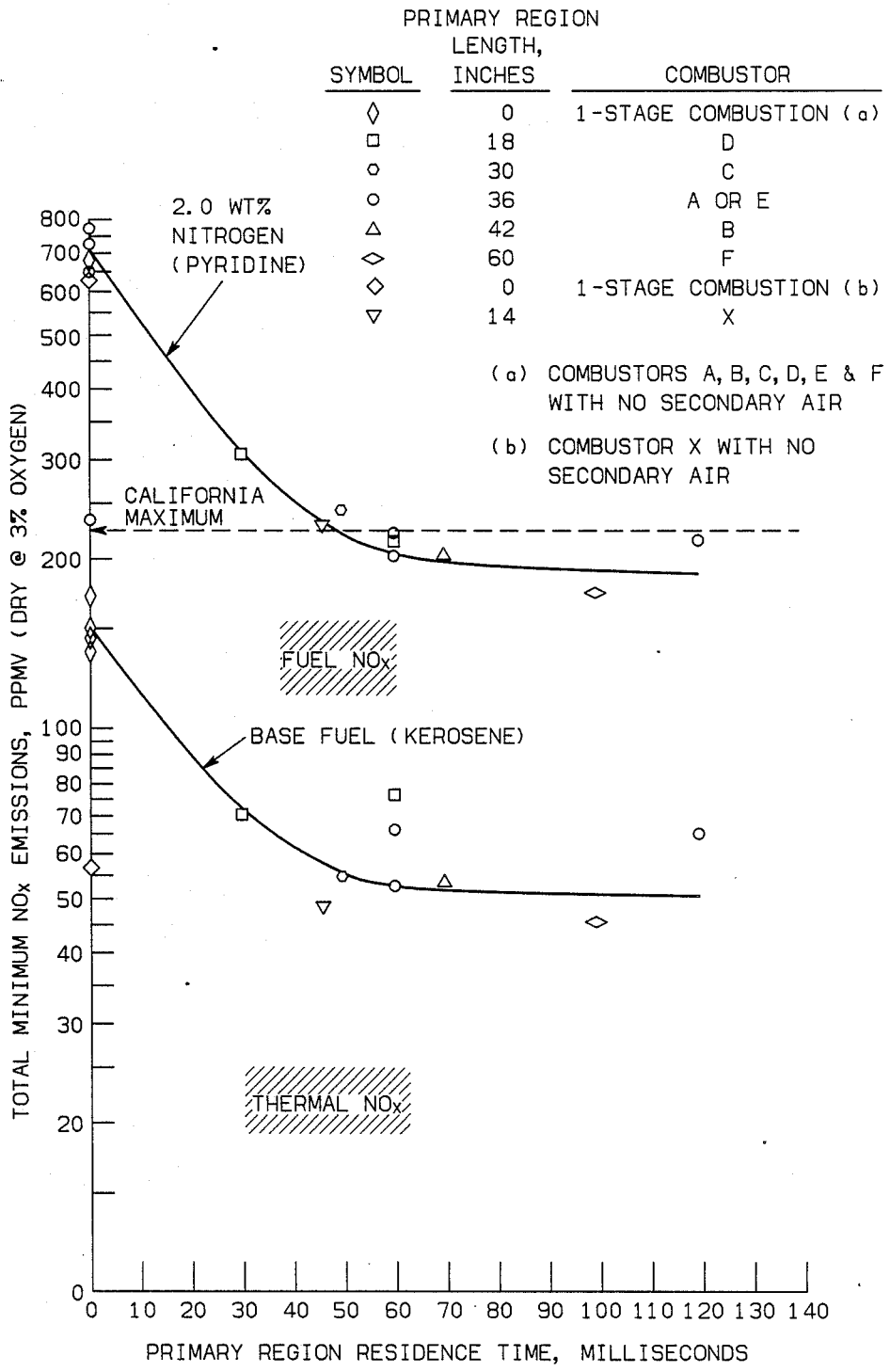
FIG. 52 (EX. V)

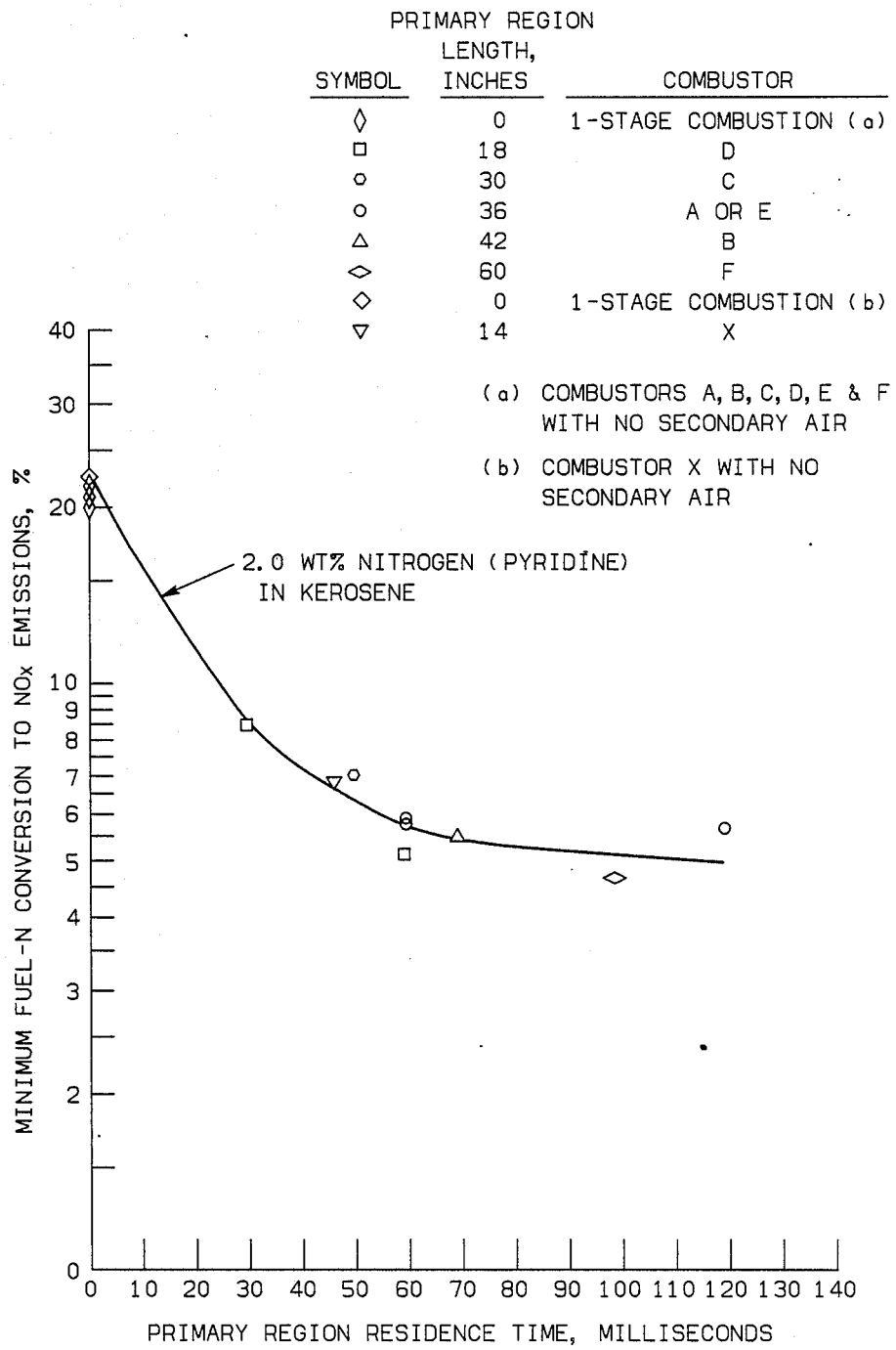
FIG. 53 (EX. V)

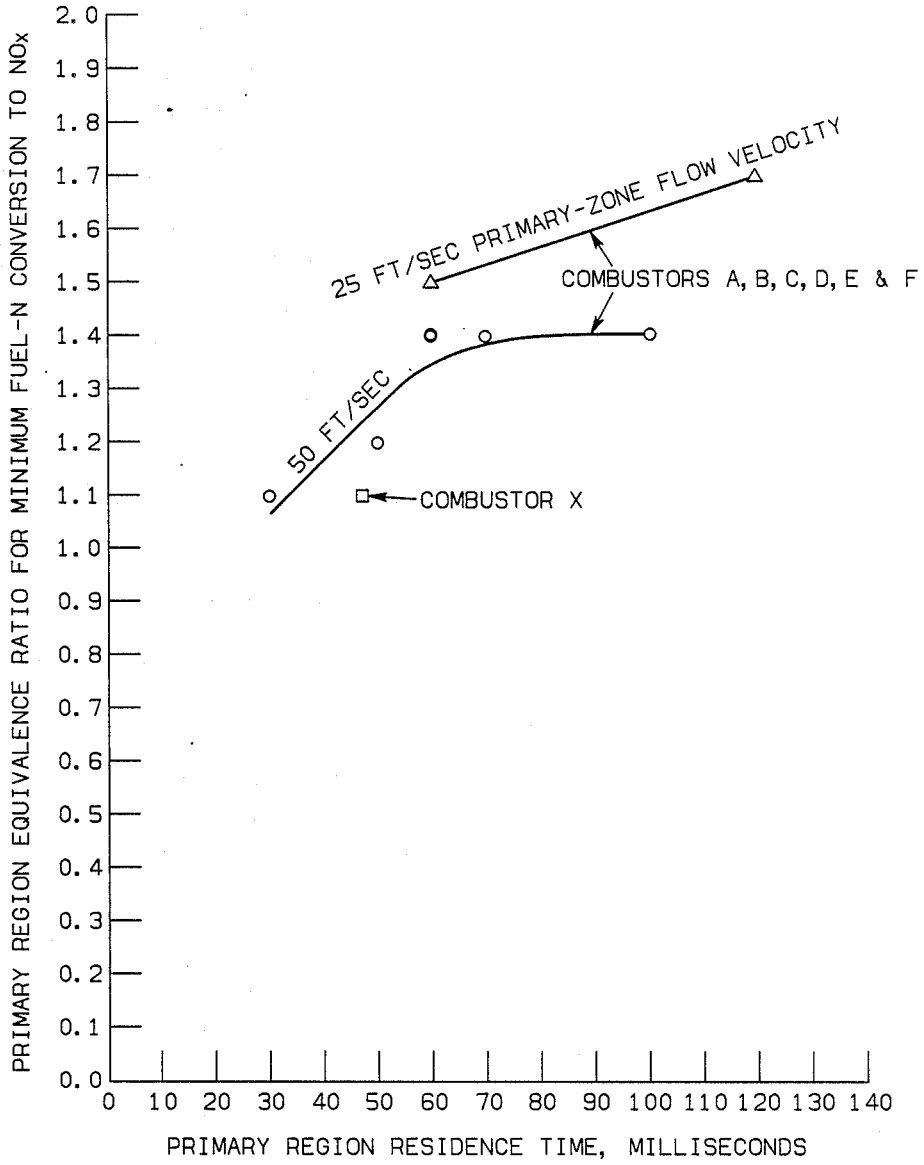
FIG. 54 (EX. V)

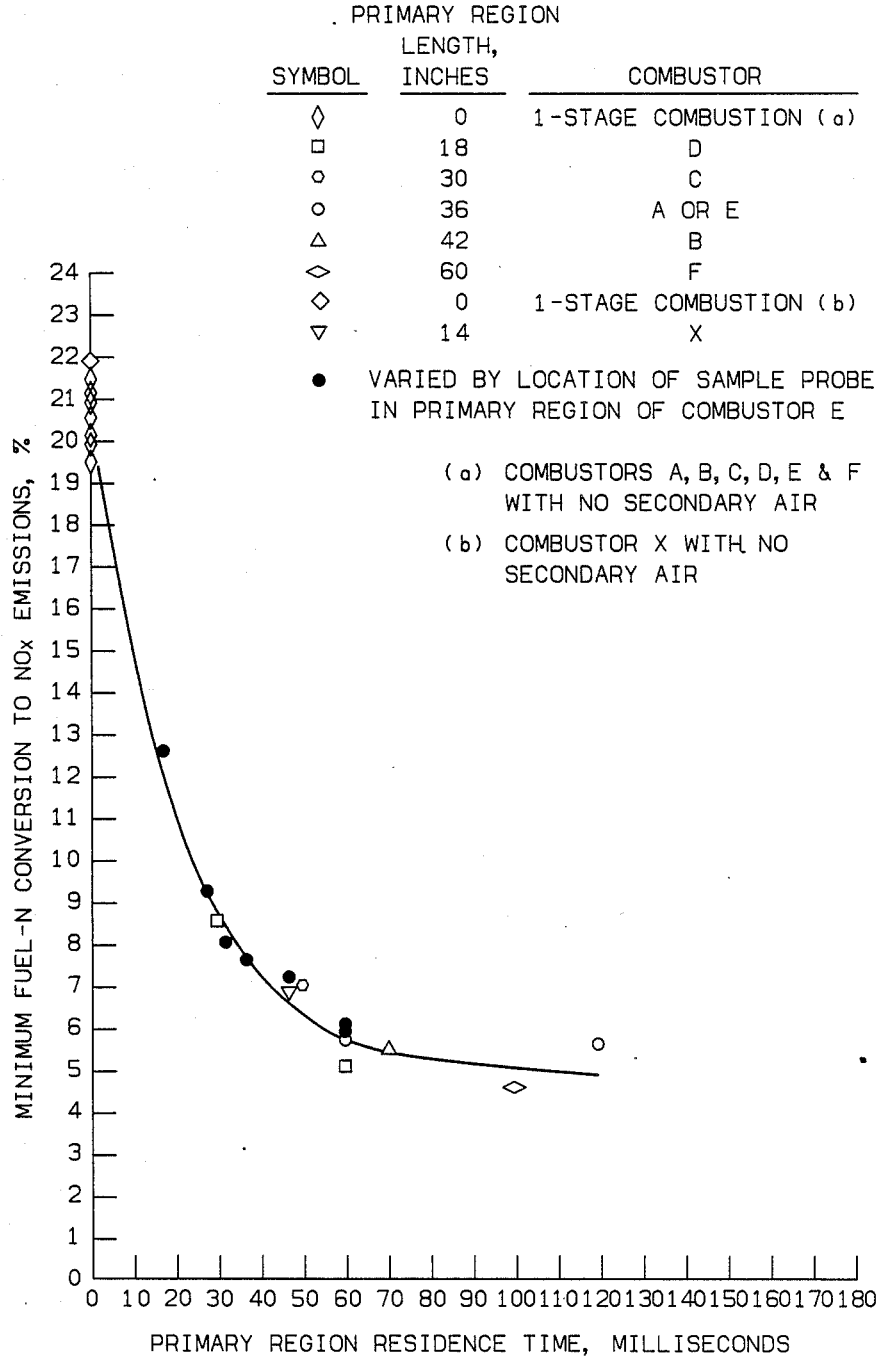
FIG. 55 (EX. V)

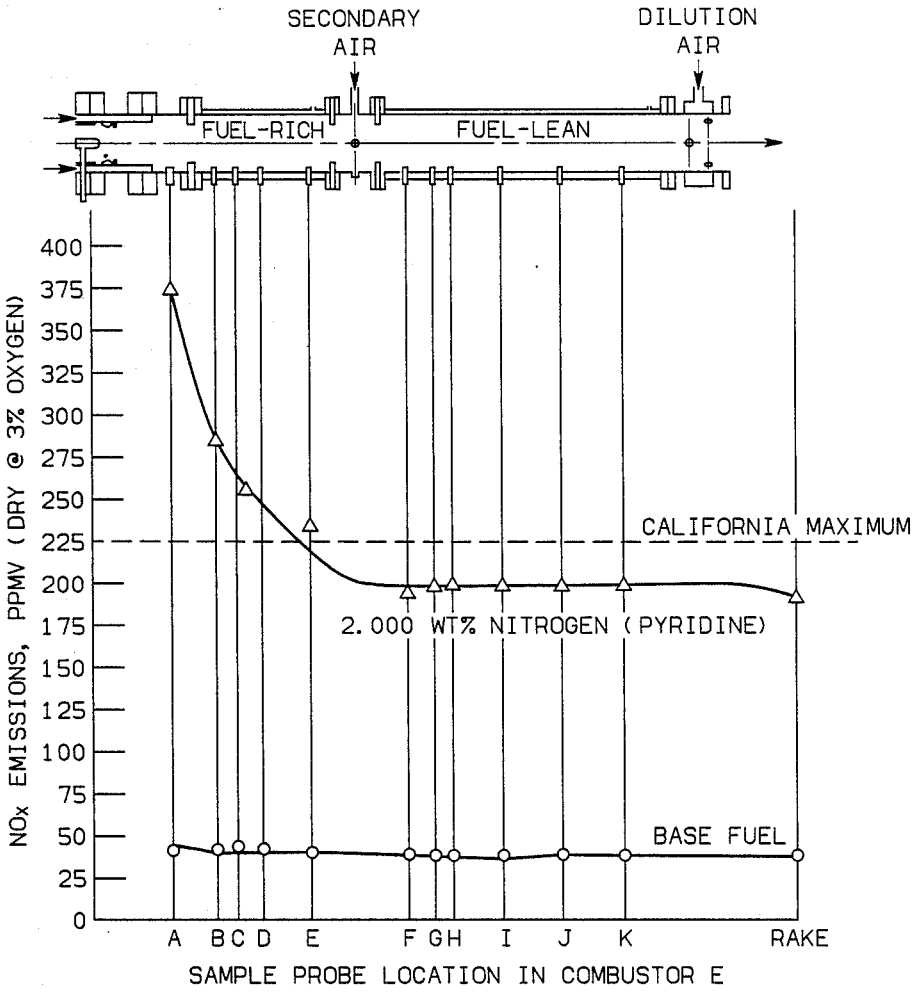
FIG. 56 (EX. V)

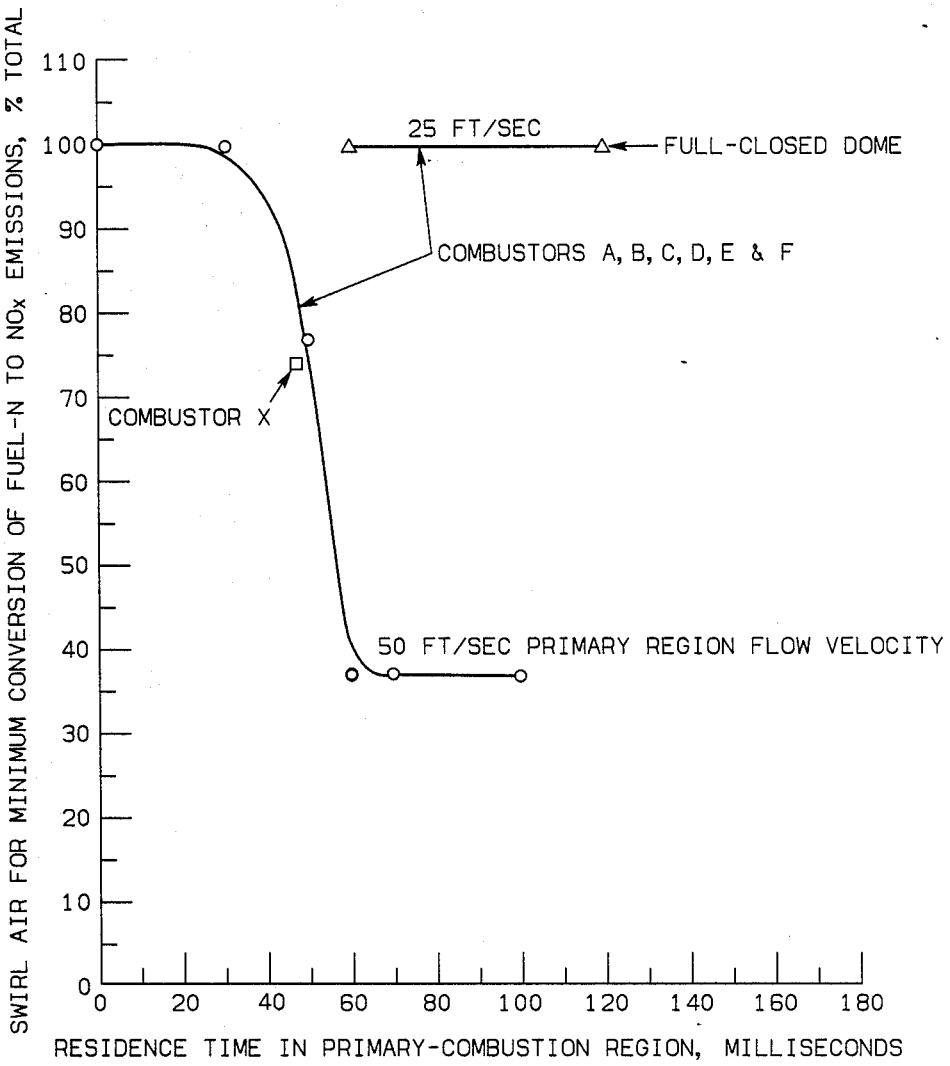
FIG. 57 (EX. VI)

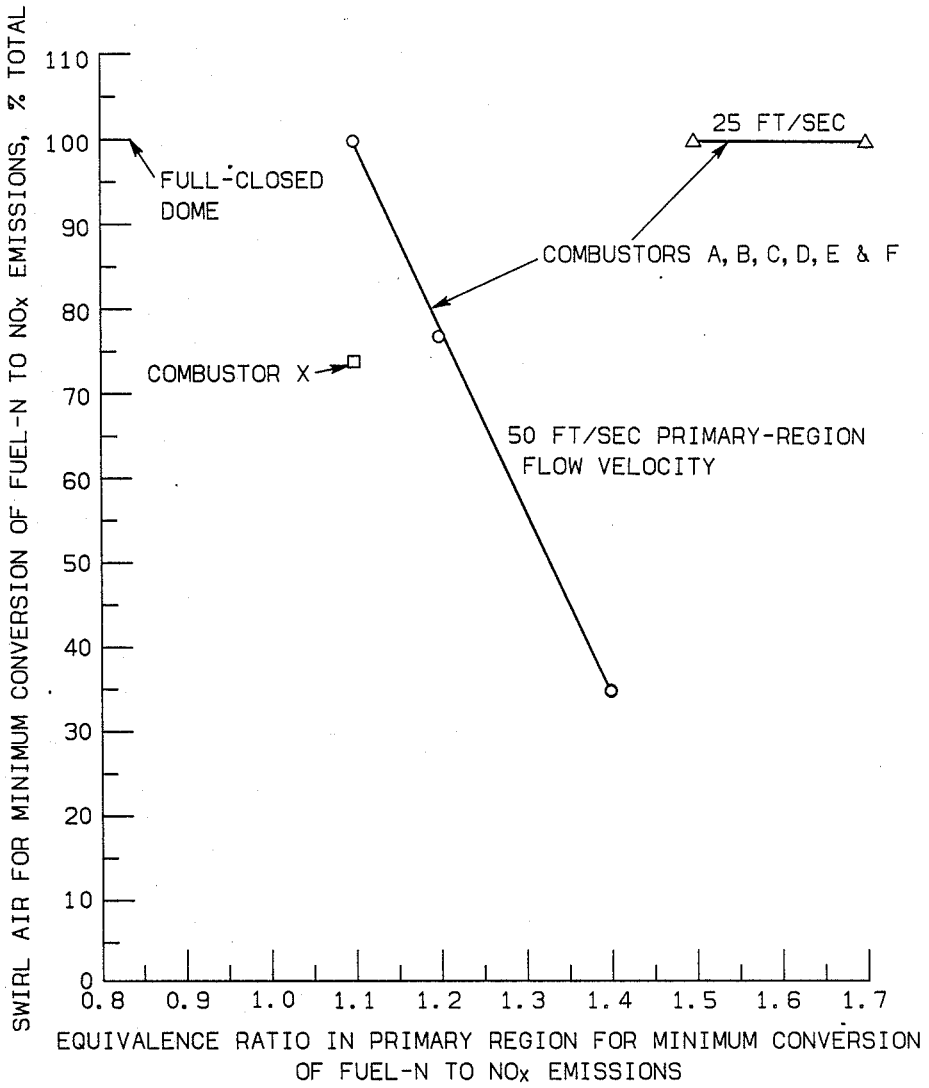
FIG. 58 (EX. VI)

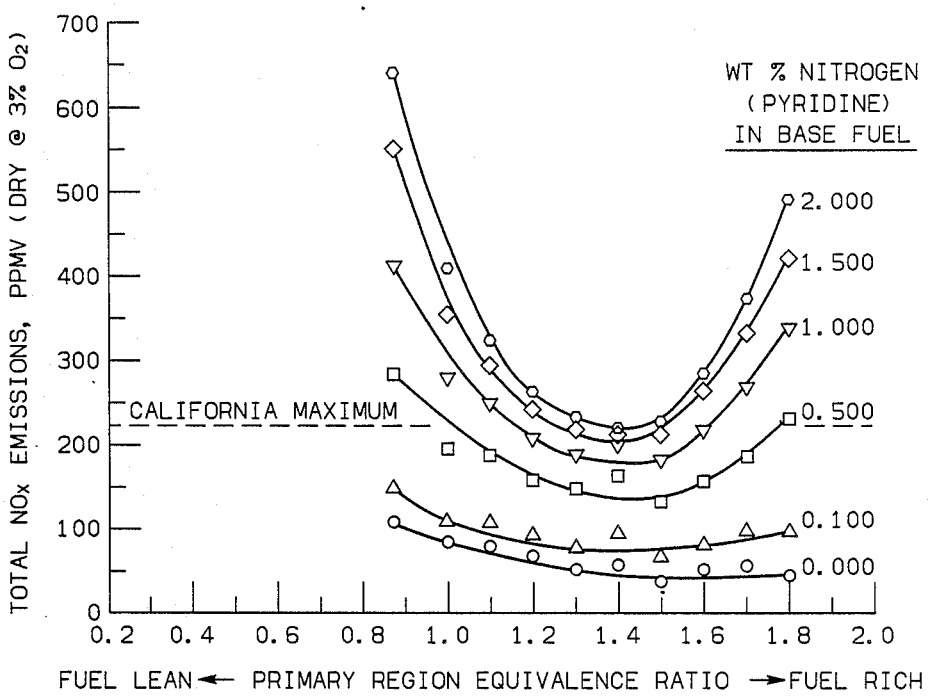
FIG. 59 (EX. VI)

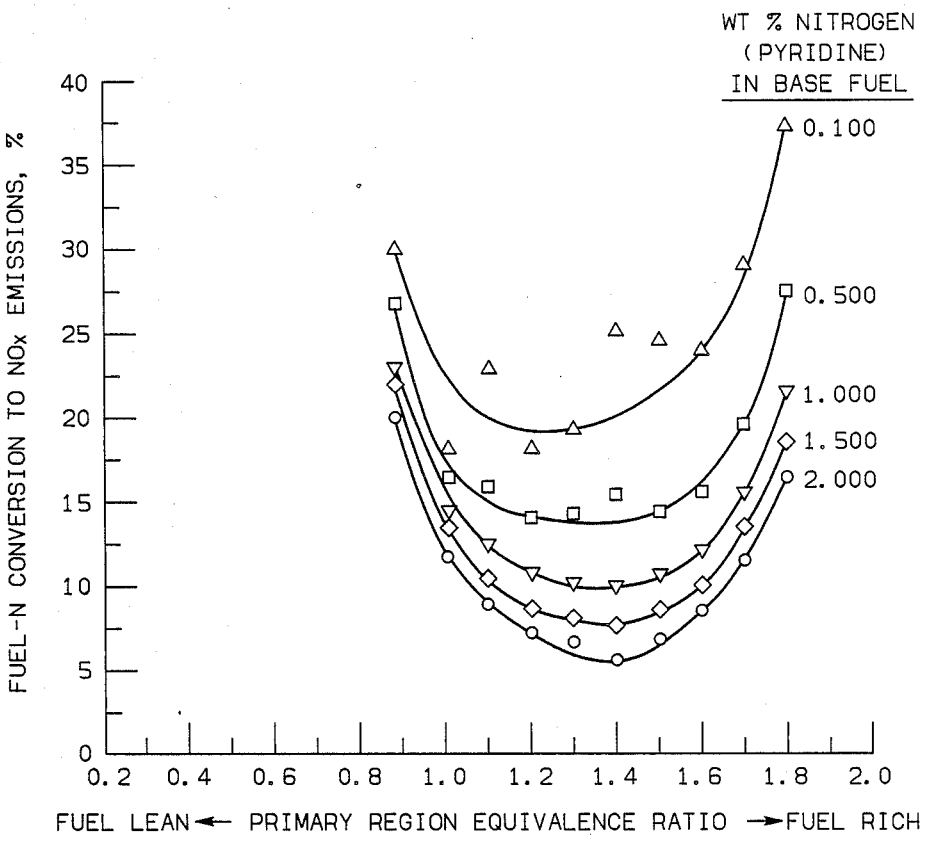
FIG. 60 (EX. VII)

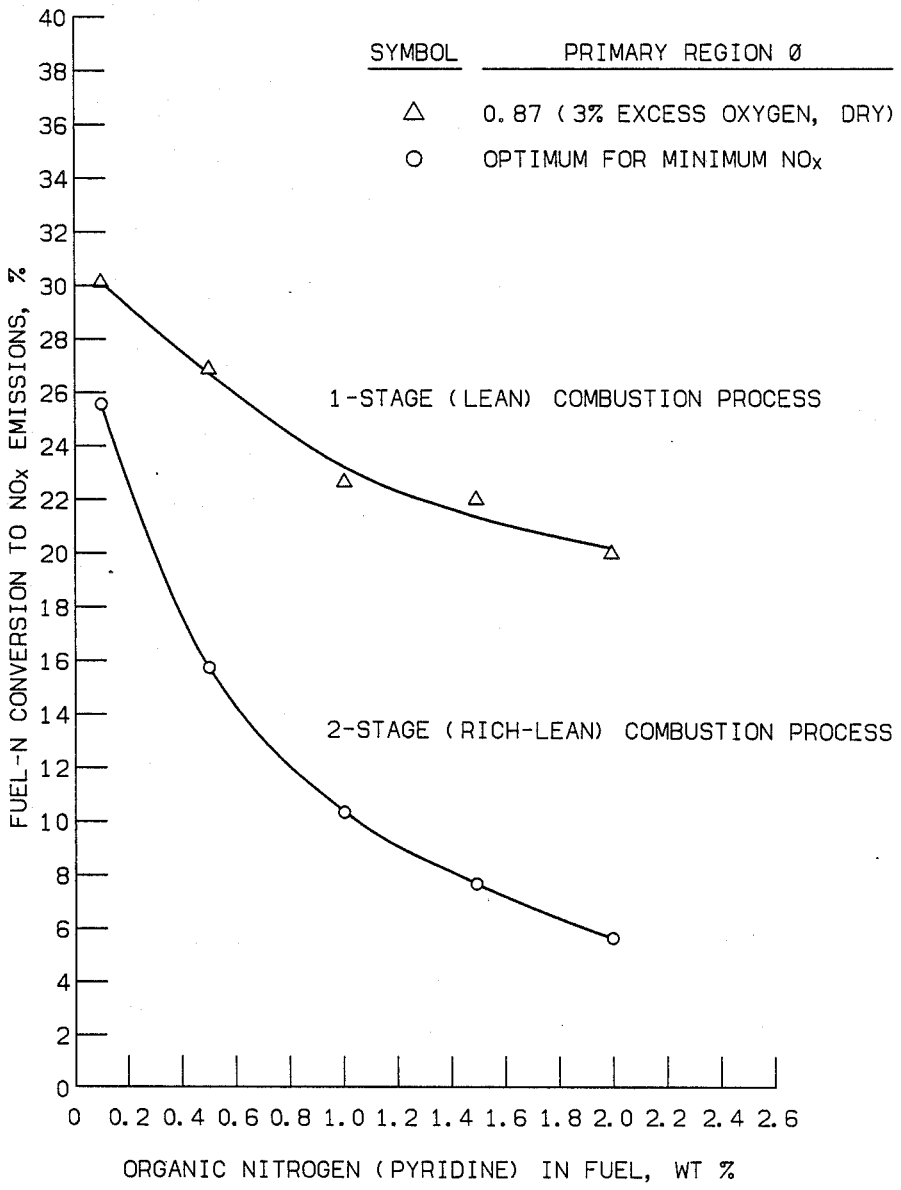
FIG. 61 (EX. VII)

METHOD FOR BURNING NITROGEN-CONTAINING FUELS

CROSS-REFERENCE TO RELATED APPLICATIONS

The present application is a divisional of application Ser. No. 272,442 entitled "Method and Apparatus for Burning Nitrogen-Containing Fuels" filed Jun. 10, 1981 and now Pat. No. 4,721,454, which in turn is a continuation-in-part of application Ser. No. 932,820, entitled "Method and Apparatus for Burning Nitrogen-Containing Fuels," filed Aug. 10, 1978 and now abandoned, which in turn is a continuation-in-part of application Ser. No. 800,361, entitled "Combustors and Methods of Operating Same", filed May 25, 1977 and now abandoned, all therefor the present inventors.

BACKGROUND OF THE INVENTION

The present invention relates to a method for burning nitrogen-containing fuels and apparatus therefor.

Air pollution has become a major problem in the United States and other highly industrialized countries of the world. Consequently, the control and/or reduction of said pollution has become the object of major research and development efforts by both governmental and nongovernmental agencies. It has been alleged, and there is supporting evidence, that automobiles employing conventional piston-type engines which burn hydrocarbon fuels are a major contributor to said pollution. Vehicle emission standards have been set by the United States Environmental Protection Agency (EPA) which are sufficiently restrictive to cause automobile manufacturers to consider employing alternate engines instead of the conventional piston engine.

Another source of such pollution is the exhaust gases from large stationary installations such as boilers in power plants, and large stationary gas turbine engines employed as a driving force in power plants and other large installations. It is anticipated that this portion of the problem will almost certainly be aggravated in the relatively near future by the necessity to use lower quality fuels such as heavy petroleum oils, shale oils, coal liquids, etc. which contain relatively large amounts of fuel-nitrogen, e.g., up to about 2 weight percent or greater, as compared to presently available fuels which contain very little, if any, fuel-nitrogen. For example, #4 and #6 petroleum oils contain about 0.1 to 0.5 weight percent nitrogen, two typical crude shale oils, hereinafter referred to in the specific examples, contain 1.85 and 1.93 weight percent of chemically bound nitrogen, respectively, and a typical crude, solvent refined coal oil contains from about 1.0 to 1.5 weight percent of chemically bound nitrogen. By comparison, a typical petroleum-derived #2 fuel oil contains about 0.024 weight percent nitrogen. If all of the chemically bound nitrogen in the fuel is converted to nitrogen oxides, generally referred to as "fuel $NO_x$", 1 percent by weight of nitrogen in a solvent refined coal oil, has the potential to produce about 1.928 pounds/million Btu or 1,300 ppmv (parts per million by volume at 3 percent excess oxygen, dry) of nitrogen oxides ($NO_x$) while 1.85 and 1.93 percent by weight of nitrogen in crude shale oils, will potentially produce about 3.288 and 3.440 pounds/million Btu (2595 and 2642 ppmv), respectively. In addition, nitrogen oxides, produced by the hot-air reactions at flame temperatures, and referred to as "thermal $NO_x$", also contribute to the total $NO_x$ pollutants in the flue gases from a combustion process.

The federal limit for the discharge of $NO_x$ pollutants into the atmosphere from steam generators burning liquid fossil fuel (1974 EPA New Source Performance Standards [NSPS] is 0.30 pounds/million Btu (about 230 to 237 ppmv for typical shale oils). Some State limitations are even more stringent, for example the California standard is 225 ppmv. These limits include both fuel $NO_x$ and thermal $NO_x$. While these standards can be met when burning low nitrogen (below about 0.1%), petroleum-derived fuel oils, serious complications are encountered when high nitrogen fuels such as heavy petroleum-derived fuel oils, crude shale oils and crude coal oils are burned under conventional utility boilers. For example, since thermal $NO_x$ increases with temperature, modern utility boilers, which preheat the combustion-supporting air to 600°–800° F. for improved efficiency, produce thermal $NO_x$ alone which can approach the specified emission standards. Consequently, in order to meet these standards, the conversion of fuel nitrogen to $NO_x$ emissions, in a fuel having about 2.0 weight percent bound nitrogen, should not be more than about 5 percent. It has been reported in the literature that, when shale oils with about 2.0 weight percent nitrogen are burned in a stationary boiler of an electrical generating station, $NO_x$ emissions on the order of 700 to 900 ppmv can be anticipated and, when solvent refined coal oils, with slightly more than 1.0 weight percent nitrogen, are burned, at least 20 to 50 percent of the fuel nitrogen is converted to $NO_x$ emissions (260 to 650 ppmv).

While it has been suggested that high levels of fuel nitrogen can be reduced by severe hydro-treating, such techniques have not been commercially developed and, even if available, pilot plant tests indicate that such refining of crude shale oils and crude coal oils would increase costs by about $3.00 to $5.00 per barrel.

It has also been suggested that $NO_x$ emissions from crude, high nitrogen fuels can be reduced by blending the high nitrogen fuel with low nitrogen petroleum-derived fuel oils or by burning crude, high nitrogen fuels in selected burners of a boiler while burning low nitrogen petroleum-derived fuel oils in other burners. In addition to requiring substantial volumes of petroleum-derived fuel oils, these techniques require additional equipment for handling and blending and/or feeding two separate fuels.

Another suggestion for reducing $NO_x$ emissions from high nitrogen fuels is the addition of a fuel additive, such as an additive containing manganese. Obviously, this technique adds the cost of the additive to the operation and requires facilities for handling and blending the additive.

To date the most promising technique has been a two-stage, rich-lean combustion process, in which a primary combustion zone is operated fuel-rich and a secondary combustion region is operated fuel-lean. However, even with the best of these techniques only limited success has been attained and the conversion of fuel-nitrogen to $NO_x$ emissions is still well above the governmental limits. For example, it has been reported that the $NO_x$ level, when burning crude, solvent refined coal oil containing 1.12 weight percent nitrogen, cannot be reduced below about 0.4 lb./million Btu without resorting to the additional techniques of blending with low nitrogen, petroleum-derived fuels or using additives. Similarly, the best of the two-stage techniques, heretofore available, have failed to reduce $NO_x$ emissions from crude shale oils, containing about 2.0 weight percent nitrogen, to values less than about twice the governmental maximums.

The major problems in past operations of two-stage, rich-lean combustion processes has been the failure to recognize that control of factors other than the rich fuel-air ratio is necessary in order to attain minimum $NO_x$ production, and that the efficiency of fuel utilization and control of other pollutants must also be taken into consideration. The almost universal thinking of those skilled in the art has been that, so long as combustion is initiated in a fuel-air mixture having a fuel-air ratio above the stoichiometric ratio (usually referred to as a fuel-air equivalence ratio above 1.0) and the flame is thereafter diluted with air to reduce the overall fuel-air ratio to below the stoichiometric ratio (a fuel-air equivalence ratio below 1.0), this is all that is necessary in order to accomplish the desired result. The ultimate efficiency of fuel utilization and the volume of unburned or partially burned fuel (generally indicated by the HC and CO content of the flue gases) has also been generally ignored by such prior art investigators.

SUMMARY OF THE INVENTION

It is therefore an object of the present invention to overcome these shortcomings of the prior art.

Yet another object of the present invention is to provide an improved method and apparatus for burning high nitrogen fuels.

Another and further object of the present invention is to provide an improved method for the combustion of high nitrogen fuels in which the $NO_x$ content of the flue gases is substantially reduced.

Yet another object of the present invention is to provide an improved method and apparatus for the combustion of high nitrogen fuels wherein the $NO_x$ content is substantially reduced while concomitantly maintaining high combustion efficiency.

A further object of the present invention is to provide an improved two-stage, rich-lean combustion method and apparatus for burning high nitrogen fuels.

Still another object of the present invention is to provide an improved method for initiating and maintaining an effective and efficient, two-stage, rich-lean combustion process for burning high nitrogen fuels.

As used herein and in the claims, unless otherwise specified, the terms "fuel-nitrogen", "chemically bound nitrogen", "organic nitrogen", and similar terms are employed to refer to nitrogen which is chemically bound into the fuel molecule. Also, as used herein and in the claims, unless otherwise specified, the terms "fuel-air equivalence ratio", "equivalence ratio" and the symbol "$\phi$" are employed to refer to the ratio of the fuel flow (fuel available) to the fuel required for stoichiometric combustion with the air available. Stated another way, said equivalence ratio is the ratio of the actual fuel-air mixture to the stoichiometric fuel-air mixture. For example, an equivalence ratio of 1.5 means the fuel-air mixture in the zone is fuel-rich and contains 1.5 times as much fuel as a stoichiometric mixture.

In accordance with the present invention, fuels containing chemically bound nitrogen are burned, in a two-stage, rich-lean combustion process, by introducing the fuel and at least one stream of primary air into a primary combustion region at a fuel-air ratio above the stoichiometric ratio and in a manner to intimately mix the fuel and air and establish a stabilized flame adjacent the upstream end of the primary combustion region; maintaining the flame in the primary combustion region for a period of time sufficient to produce a combustion product mixture containing less than a predetermined amount of $NO_x$ pollutants and abruptly terminating the primary combustion region while introducing at least one stream of secondary air into a secondary combustion region in an amount sufficient to reduce the overall fuel-air ratio below the stoichiometric ratio and in a manner to prevent backflow of the secondary air into the primary combustion region.

BRIEF DESCRIPTION OF THE DRAWINGS

FIGS. 38–47, inclusive, are data curves setting forth the results obtained in the test runs of the working examples given hereinafter.

FIGS. 48–61, inclusive, are data curves setting forth the results obtained in other test runs of the working examples given hereinafter.

DESCRIPTION OF THE PREFERRED EMBODIMENTS

Figure 1:
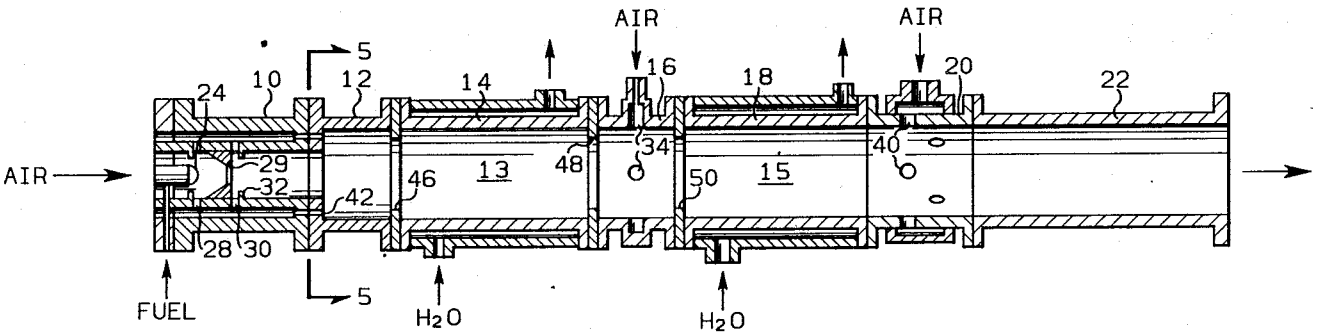
FIG. 1 is a view, partially in cross section, of a combustor, e.g., Combustor A, in accordance with the invention.

In its more specific aspects the present invention relates to an improved method of operating a two-stage, rich-lean process for the burning of fuels, containing a high concentration of chemically bound nitrogen, particularly heavy fuels, such as shale oils and coal-derived oils, improved methods of initiating and maintaining such combustion and improved apparatus therefor.

In a still more specific aspect, the improved method includes the controlled mixing of a predetermined fuel-rich ratio of fuel and primary air in the upstream end of a primary combustion region to intimately mix the fuel and air and establish a stabilized flame adjacent the upstream end of the primary combustion region and maintenance of the flame in the primary combustion region for a predetermined minimum residence time sufficient to produce a primary region combustion product mixture containing a preselected maximum amount of $NO_x$ pollutants; and abrupt termination of the primary combustion region along with the introduction of secondary air into a secondary combustion region in an amount sufficient to produce an overall fuel-lean ratio of fuel and air and in a manner to prevent backflow of the secondary air from the secondary combustion region into the primary combustion region.

Various means may be utilized to initially mix the fuel and the air and establish a stabilized flame in the upstream end of the primary combustion region. Preferably, a generally axial flow component is established and a generally radial flow component is established at a selected critical ratio.

The axial flow component comprises the fuel or a mixture of the fuel and a portion of the primary air, introduced in a generally axial direction, or one of these in combination with at least one separate stream of primary air, introduced in a generally radial direction. The fuel or fuel-air mixture is preferably introduced as an open cone having a 90° apex angle. When an additional air stream is introduced axially the air is preferably introduced about the fuel or fuel-air mixture so as to contact the fuel adjacent its point of introduction. The latter is preferably accomplished by introducing the fuel or fuel-air mixture as an open cone. The separate air stream may be introduced in a strict axial direction or as a swirling stream in a generally axial direction. Finally, the separate stream of air may be introduced through fixed area openings or through variable area openings to thus introduce a fixed or a variable amount of air in the axial direction.

The radial flow component comprises the remainder of the primary air introduced from a peripheral location about the fuel and in a direction generally inwardly toward the axis of the combustion zone to contact the axial flow component and produce a combustible mixture of fuel and air. The radially introduced primary air may be introduced in a strict radial direction or in a generally radial direction as a swirling stream and can comprise a plurality of separate streams spaced along the upstream end of the primary combustion region and any combination of strict radial or swirling streams. For example, a single swirling stream, plural swirling streams, such as two swirling streams rotating in opposite directions, a single strict radial stream, plural strict radial streams, a single strict radial stream and one or more swirling streams, etc. In the event that no axial air stream is introduced or the axial air stream is not variable it is preferred that one of the radial air streams be variable. Best results are obtained if the most upstream radial air stream is variable. In any case, the most upstream radial airstream should contact the fuel substantially immediately following the point of introduction of the fuel.

As indicated, the manner of introducing the fuel and primary air can assume various forms so long as an axial flow component and a radial flow component is established. The ratio of the axial flow component and the radial flow component is also a significant factor in obtaining minimum $NO_x$ pollutant production. While the ratio of the axial flow component and the radial flow component can be attained and maintained by externally adjusting the relative volumes of fuel and/or air introduced in the axial and radial directions, it is most effective and convenient to have either a variable axial or radial air stream and adjust the volume of the variable air stream.

Also, irrespective of the manner of introducing the fuel and primary air and irrespective of the adjustment of the variable air stream, it is preferred that the relative volumes of fuel and total primary air, introduced into the primary combustion region, be sufficient to establish and maintain a selected critical primary region fuel-air equivalence ratio between 1.0 and about 1.8, preferably between about 1.2 and about 1.7. The selected primary region fuel-air equivalence ratio should be correlated with the ratio of the axial flow component and the radial flow component. This is best accomplished by varying the ratio of the axial flow component and the radial flow component at a plurality of primary region fuel-air equivalence ratios within the stated range until a minimum value of $NO_x$ pollutants is attained.

In one aspect of the invention the mixture of fuel and air is constricted to an axial stream having a diameter smaller than the diameter of the primary region and is then expanded, either gradually or abruptly, to the full diameter of the primary region. Preferably, such constriction occurs immediately after the introduction of the most upstream radial air stream. More downstream ones of the streams of air may be introduced either into the thus constricted stream or during the expansion thereof.

In connection with one embodiment of the invention, where primary air is introduced in a swirling or tangential manner, the percent swirl or tangential air (of the total primary air) introduced downstream from the variable air is desirably maintained between about 35 and 100 percent by volume of the total primary air. It is also desirable where two swirl air streams are utilized, that the more downstream one of the two be larger than the other.

The flame thus established and stabilized adjacent the upstream end of the primary combustion region is maintained in the primary combustion region for a period of time sufficient to prevent the conversion of fuel-nitrogen to $NO_x$ pollutants from exceeding a predetermined maximum amount. The preselected amount of fuel $NO_x$ pollutants produced by fuel-nitrogen conversion is less than about 10 percent. In terms of lbs. $NO_x$/million Btu, this amounts to less than about 0.350 lb. fuel $NO_x$/million Btu for most fuels and a total fuel and thermal $NO_x$ of about 0.450 lb./MM Btu. The residence time necessary to accomplish this is usually at least about 35 milliseconds. Preferably, the conversion of fuel-nitrogen to fuel $NO_x$ pollutants is less than about 7.5 percent and ideally below about 5 percent (about 0.270 and 0.180 lb. fuel $NO_x$ or 0.365 and 0.275 lb. total $NO_x$/MM Btu, respectively). It has been found, in accordance with the present invention, that no significant decrease in the $NO_x$ pollutant content of the flue gas is attained when the residence time in the primary combustion region is above about 100 milliseconds. Therefore, as a practical matter, in order to maintain the overall length of the combustor within reasonable limits and maintain heat losses at a minimum, the residence time in the primary combustion region should not exceed about 140 milliseconds and preferably about 120 milliseconds.

It has also been found, however, that once maximum $NO_x$ pollutant reduction has been attained, the primary combustion region must be immediately and abruptly terminated. This also may be accomplished in several different ways. In general, at least one stream of secondary air is introduced into the secondary combustion region in an amount sufficient to reduce the overall fuel-air equivalence ratio of the combustion zone below the stoichiometric ratio (preferably about 0.87) and in a manner such that backflow of secondary air into the primary combustion zone is prevented. The latter may be accomplished by reducing the diameter of the flame path by mechanical means, such as by locating at least one annular baffle or a nozzle-type constriction immediately adjacent and, preferably, downstream from the point of introduction of the secondary air. The flame, thus diluted with secondary air, is then rapidly expanded into the secondary combustion region to attain intimate mixing of the combustion products of the primary combustion region and the secondary air.

It has been found that, if the primary region is not abruptly terminated, the secondary air will tend to backflow into the primary region, thus counteracting the advantage of the primary region and upsetting the critical ratio of the axial flow component and the radial flow component, the critical primary region fuel-air equivalence ratio and the critical primary region residence time, and/or a gradual transition from the primary region to the secondary region results. Such backflow of secondary air, gradual transition from the primary to the secondary region and/or extension of the primary region residence time beyond the limits previously discussed will result in significant increases in the $NO_x$ pollutant level, inordinately large volumes of CO in the flue gas and/or incomplete and inefficient burning of the fuel.

It has also been found, in accordance with the present invention, that the residence time in the secondary combustion region should be greater than about 15 milliseconds. This minimum secondary region residence time and the intimate mixing of the combustion products of the primary combustion region and secondary air are necessary in order to complete combustion of unburned fuel and partially burned fuel which result from the fuel-rich combustion in the primary combustion region. It has been found that a residence time of 15 milliseconds or greater will result in a carbon monoxide content in the flue gas of less than about 300 ppm by volume. Such a level of CO in the flue gas indicates that combustion has been essentially complete and efficient and effective use of the fuel has been attained.

In addition to controlling the previously-mentioned process variables, it has further been discovered that such variables are interdependent and should be correlated with one another in practicing the present invention. Specifically, the manner of introducing and contacting the fuel and primary air in the primary combustion region, the fuel-air equivalence ratio in the primary combustion region, the flame residence time in the primary combustion region and the manner of terminating the primary combustion region, including the volume and manner of introducing secondary air, must all be controlled and coordinated with one another. As will be shown by the examples hereinafter set forth, the nature of the fuel, particularly its volatility and nitrogen content, and the burner type and configuration cause the optimum values of these variables to change, both as to absolute values as well as in their relation to one another, thereby further emphasizing the necessity of proper control of such variables and their relationship to one another.

This interdependence of the operating variables and the proper correlation of each with the other will be apparent from the following description of the method of initiating and maintaining combustion of a fuel, containing chemically bound nitrogen, in a two-stage, rich-lean combustor, in accordance with the present invention.

The combustion process is initiated by determining the primary combustion region residence time at which minimum $NO_x$ pollutants are produced, determining the primary combustion region fuel-air equivalence ratio at which minimum $NO_x$ pollutants are produced and determining the ratio of the axial flow component and the radial flow component at which minimum $NO_x$ pollutants are produced. In certain instances, the secondary combustion region fuel-air equivalence ratio and residence time at which predetermined maximum amounts of CO and/or unburned and partially burned fuel are produced should also be determined. The order of making the specified determinations may be varied and any two or more of said determinations may be made simultaneously without departing from the invention. Once the combustion process is initiated, such combustion may be maintained by making one or more of the specified determinations and adjusting the corresponding process variable to a value at which minimum $NO_x$ pollutants are produced and/or the predetermined maximum amounts of CO and/or unburned and partially burned fuel are produced.

The primary combustion region residence time is dependent upon two major factors, namely; the length of the primary combustion region and the primary combustion region flow velocity. While the primary combustion region length, that is the distance between the tip of the fuel injection nozzle and the midpoint of the means for introducing secondary air, will generally be fixed, there are certain minimal requirements in accordance with the present invention. Specifically, the primary combustion region length should be selected such that a minimum primary combustion region residence time of at least about 35 milliseconds can be attained at practical primary combustion region flow velocities. As a practical matter, the maximum length of the primary combustion region will be limited to some extent by the particular environment in which the burner is to be utilized and the energy (heat) loss resulting from the utilization of the primary combustion region. Accordingly, the length of the primary combustion region should be as short as possible. The maximum length should therefore be such that a maximum residence time of about 140 milliseconds, and preferably a maximum residence time of 120 milliseconds will be attained. For example, in a combustor having an internal diameter of 6 inches, a length of about 58 inches is considered adequate. For combustors of larger or smaller diameter the length would be determined by utilizing approximately the same ratio of length to diameter. Having thus set the length of the primary combustion region, the primary combustion region residence time at which minimum $NO_x$ pollutants are produced is determined by varying the flow velocity at each of a plurality of primary combustion region fuel-air equivalence ratios between 1.0 and about 1.8. The velocity should be varied within practical limits. Obviously, if the velocity is too low, mixing of the fuel and air will be poor, thus producing a nonhomogeneous or heterogeneous mixture, and, if the velocity is too high, the flame will go out or will not stabilize adjacent the upstream end of the primary zone. While such velocity may be varied between about 1 and 500 feet/second, practical flow velocities are between about 5 and 100 feet/second, and preferably between about 5 and 50 feet/second.

It is apparent that the primary combustion region fuel-air equivalence ratio at which minimum $NO_x$ pollutants will be produced will be determined to some extent simultaneously with the determination of the primary combustion region residence time. However, this equivalence ratio is generally a rough approximation. Therefore, the primary region equivalence ratio at which minimum $NO_x$ pollutants are produced is preferably determined by varying the equivalence ratio between 1.0 and about 1.8 at the determined primary combustion region residence time.

The ratio of the axial flow component and the radial flow component can then be determined by varying said ratio at the determined primary region residence time and the determined primary region fuel-air equivalence ratio. However, it is preferred that the ratio of the axial flow component and the radial flow component be varied at each of a plurality of different primary region fuel-air equivalence ratios between 1.0 and about 1.8, to thereby simultaneously determine the ratio of the axial flow component and the radial flow component and the primary region fuel-air equivalence ratio at which minimum $NO_x$ pollutants are produced. As a practical matter, the preferred combustor, in accordance with the present invention, includes a variable dome surrounding the fuel injection nozzle and having axially or radially directed openings which may be adjusted. Accordingly, by simply varying the size of the dome openings, the ratio of the axial flow component and the radial flow component can be varied. In those instances where primary air is introduced at one or more points downstream from the variable primary air introduction point, variation of the dome openings will also vary the relative volumes of primary air introduced at the two points, since all of the primary air is introduced from a single source, the primary combustion region fuel-air equivalence ratio is set and the sizes of the primary air introduction ports downstream of the variable primary air introduction point are fixed. This is an important factor, since it has also been found that, when the primary air introduced downstream from the variable primary air introduction point is introduced in a swirling or tangential manner, the volume of air introduced through the swirl ports should be maintained between about 35 and 100 percent of the total air introduced in the primary combustion region.

The secondary combustion region residence time can be determined in the same manner as the primary region residence time. Specifically, the length of the secondary combustion region should be selected to produce a residence time of at least about 15 milliseconds at practical secondary combustion region flow velocities. At this equivalence ratio substantially complete combustion of unburned and partially burned fuel from the primary combustion region will be attained. This criterion will generally be met if the flue gas contains less than about 300 ppmv of CO emissions. For a 6-inch internal diameter combustor, a secondary combustion region length of about 33 inches will be adequate at the determined primary combustion region flow velocity. Since no significant reduction in CO emissions occurs at residence times beyond about 30 milliseconds, and preferably beyond about 25 milliseconds, the length of the secondary combustion region need not be greater than a value necessary to attain this residence time. Where the combustor is utilized in a boiler of an electrical generating plant or a like installation, the flame will be expanded directly into the heated region of the boiler after constriction and dilution with secondary air, as specified herein. In this case, the minimum secondary combustion region residence time will be readily met by the volume of the heated region and the total combustion zone can be shortened to a length just sufficient to include the means for constricting the flame and introducing secondary air. Preferably, the secondary combustion region, in this case, should also include a short section of the flame tube to assure intimate mixing of the secondary air with the combustion products from the primary combustion region.

The secondary combustion region fuel-air equivalence ratio is determined by varying the equivalence ratio between about 1.0 and 0.5 while maintaining the previously determined variables constant, and selecting the equivalence ratio at which the CO emissions are below about 300 ppmv. As a practical matter, a secondary combustion region equivalence ratio of about 0.87 will be used, since this represents a value of 3 percent excess oxygen (dry basis) in the flue gas, $NO_x$ emission limitations are generally measured at this level and this ratio has been found to produce CO emissions below the specified maximum.

To the extent that more definitive values of the various variables are desired, a curve of the variable versus minimum $NO_x$, HC or CO emissions can be plotted and the critical value of the variable may be selected as the minimum $NO_x$, HC or CO point on the curve.

Once the combustion process has been initiated, as previously discussed, there should be no need to make further changes, so long as the same fuel is utilized. However, should the measured $NO_x$ emissions and/or CO emissions increase significantly from those initially determined, appropriate adjustments of the previously discussed variables should be made. While any one or more of the primary combustion region variables may be adjusted, it will usually be adequate to adjust the variable primary air, since the volatility of the fuel is most likely to vary and such adjustment of the variable primary air will alter the fuel-air mixing and compensate for variations in fuel volatility. However, should the bound nitrogen content of the fuel change, the primary combustion region fuel-air equivalence ratio should also be adjusted and possibly the primary zone residence time.

Adjustments of the primary region fuel-air equivalence ratio and the ratio of the axial flow component and the radial flow component can be simultaneously made by adjusting the dome openings at each of a plurality of different primary combustion region fuel-air equivalence ratios on either side of the original ratio. If it is known, by test, that the nitrogen content is higher than the initial value, it will generally be sufficient to adjust the dome openings at each of a series of equivalence ratios above the original ratio. On the other hand, if it is known, by test, that the nitrogen content is lower than the initial value, it will usually be sufficient to adjust the dome openings at a plurality of different equivalence ratios below the original.

Referring now to the drawings, wherein like or similar reference numerals are employed to denote like or similar elements, the invention will be more fully explained.

Figure 2:
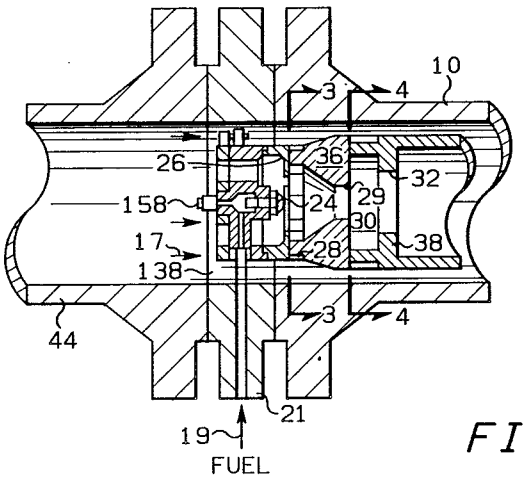
FIG. 2 is an enlarged view of the upstream end portion of the combustor of FIG. 1.

FIGS. 1–5, inclusive, illustrate a combustor in accordance with the invention. Preferably, said combustor comprises a flame tube having an upstream fuel-air mixing section 11, an intermediate primary combustion section or region 13 located downstream from and in communication with said mixing section 11, and a secondary combustion section or region 15 located downstream from and in communication with said primary combustion section 13. Said flame tube is provided at its upstream end with a dome member 17. A fuel inlet means 24 is provided for introducing a stream of fuel into the upstream end portion of said mixing section 11. As illustrated in FIGS. 1 and 2, said fuel inlet means comprises a fuel conduit 19 leading from a source of fuel and extending through fuel flange 21 into communication with the central cavity formed in the downstream side of dome member 17 and which is adapted to receive fuel nozzle 24 mounted therein. An annular orifice means is disposed on the downstream side of said dome member 17. Said orifice means can be formed integrally with said dome member or, as here illustrated, can preferably comprise an annular adapter 26 disposed between the downstream end of said dome member 17 and the upstream end of said flame tube. An orifice formed in said orifice means or adapter 26 can be considered to define the outlet from said dome member 17 and the inlet into said mixing section 11.

A first air inlet means is disposed in the wall of said flame tube for admitting a first stream of air into said mixing section 11 in a circular-like direction adjacent the inner wall thereof. Said first air inlet means preferably comprises a plurality of tangential slots 28 extending through the wall of the upstream end portion of said mixing section 11 at a first station in the flame tube adjacent said outlet from said dome member 17 and upstream from a first orifice 29. In a preferred embodiment a second air inlet means is disposed in the wall of said flame tube downstream from said first air inlet means for admitting a second stream of air into said mixing section 11 in a circular-like direction adjacent the inner wall thereof. Said second air inlet means preferably comprises a plurality of tangential slots 30 extending through the wall of the downstream end portion of said mixing section 11 at a second station in the flame tube adjacent and downstream from said first orifice 29. A second orifice 32 is disposed in said flame tube adjacent and downstream from said tangential slots 30. A third air inlet means, comprising at least one opening 34, is provided in the wall of said flame tube at a third station downstream from said second air inlet means 30 and said second orifice 32 for admitting a stream of air comprising secondary air into said secondary combustion section 15. If desired or necessary diluent air can be admitted through ports 40.

A fourth air inlet means, preferably variable, is provided in said dome member for admitting a variable volume of a third stream of air through said dome member, around said fuel inlet nozzle 24, and into said mixing section 11 of said flame tube. As described further hereinafter, said variable air inlet means comprises at least one air passage means of variable cross-sectional area provided in and extending through said dome member 17 into communication with said mixing section 11, and means for varying the cross-sectional area of said air passage means and thus controlling the volume of said stream of air admitted through said dome member and into said mixing section.

In some embodiments of the invention wherein a said second air inlet means, e.g., tangential slots 30, is not provided, said first orifice 29 can be considered to define the outlet from said mixing section 11 and the inlet to said primary combustion section or region 13. In those preferred embodiments wherein a said second air inlet means, e.g., tangential slots 30, is provided, said second orifice 32 can be considered to define the outlet from said mixing section 11 and the inlet to said primary combustion section or region 13.

Said flame tube can be fabricated integrally if desired. However, for convenience in fabrication, said flame tube can preferably be formed with the wall portion thereof which comprises said mixing section 11 divided into separate sections similarly as here illustrated. Thus, in one preferred embodiment said tangential slots 28 can be formed in an upstream first wall section 36 of said flame tube, preferably in the upstream end portion of said first wall section with the downstream wall of said adapter 26 forming the upstream walls of said slots 28. In this preferred embodiment said first orifice 29 is formed in the downstream end portion of said first wall section 36. In said preferred embodiment said tangential slots 30 can be formed in an intermediate second wall section 38 located adjacent and downstream from said first wall section 36. Preferably, said second wall section 38 is disposed with its upstream edge contiguous to the downstream edge of said first wall section 36, and said tangential slots 30 are formed in the upstream end portion of said second wall section 38 with the downstream edge of said first wall section 36 forming the upstream walls of said slots 30. In this preferred embodiment said second orifice 32 is formed in said second wall section 38 and adjoins said slots 30 formed therein. Preferably, the inner wall surface of said first wall section 36 tapers inwardly from the downstream edge of said tangential slots 28 to the upstream edge of said first orifice 29 to form an inwardly tapered passageway from said slots to said orifice. Preferably, the inner wall surface of said second wall section 38 extends radially outwardly from the downstream edge of said second orifice 32. The remainder of said flame tube can conveniently comprise the flanged spools or sections 10, 12, 14, 16, 18, 20, and 22 as illustrated in FIG. 1. For convenience, said spools 14 and 18 were provided with jackets for circulation of water or other coolant therethrough. Such cooling permitted operation of the combustor through a wide range of operating conditions including stoichiometric fuel-air mixtures without heat damage. A small amount of wall cooling air, admitted through ports 42, was used to cool the unjacketed spool 12.

In one presently preferred embodiment a third orifice means 46 is disposed at an intermediate location in said primary combustion section and downstream of said second air inlet means. Preferably, a fourth orifice means 48 is disposed in said primary combustion section upstream from and adjacent said third air inlet means. A fifth orifice means 50 is disposed in the upstream end portion of said secondary combustion section downstream from and adjacent said third air inlet means. Said third, fourth, and fifth orifice means aid in the mixing of the gases flowing through the flame tube and promote the homogeneity thereof.

It will be understood that the combustors described herein can be provided with any suitable type of ignition means and, if desired, means for introducing a pilot fuel to initiate combustion. For example, a sparkplug (not shown) can be mounted to extend into first combustion region 13.

Referring to FIG. 1, for example, for the purpose of calculating residence time in connection with the method of the invention, the primary combustion region can be considered to be the region from the downstream tip of fuel nozzle 24 to the midpoint of the air inlet ports 34, and the secondary combustion region can be considered to be the region from the midpoint of said ports 34 to the midpoint of the openings 40.

Said first orifice 29 and said second orifice 32 have been illustrated as being circular in shape and this is usually preferred. However, it is within the scope of the invention for either or both of said orifices to have other shapes, e.g., triangular. Said flame tube has been illustrated as being cylindrical in shape and this is usually preferred. However, it is within the scope of the invention for said flame tube to have any other suitable shape.

Figure 6:
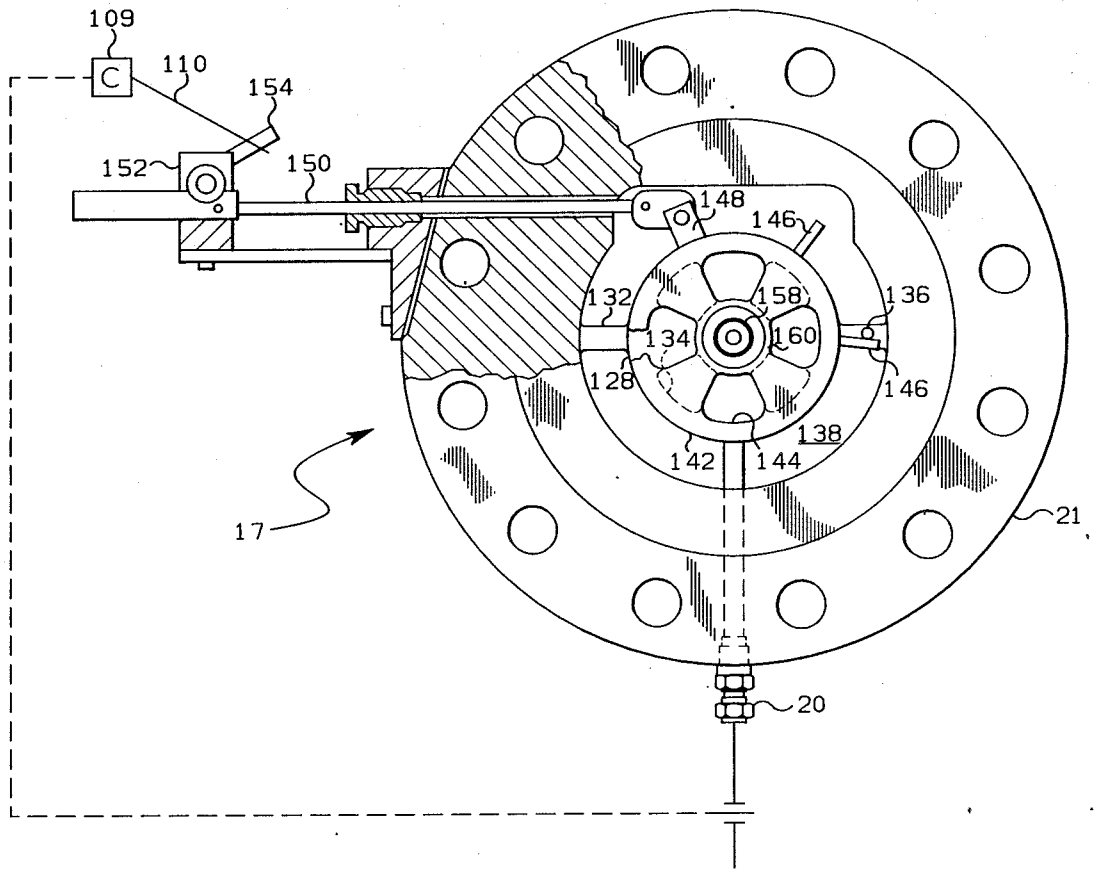
FIG. 6 is a view looking at the upstream side of a variable dome member, as shown in FIG. 2, and which can be employed in the combustors of the invention.
Figure 7:
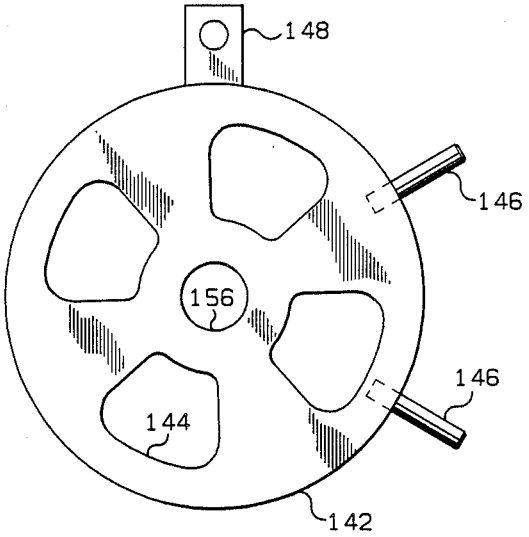
FIG. 7 is an enlarged view in elevation of an element of the dome member shown in FIG. 6.
Figure 8:
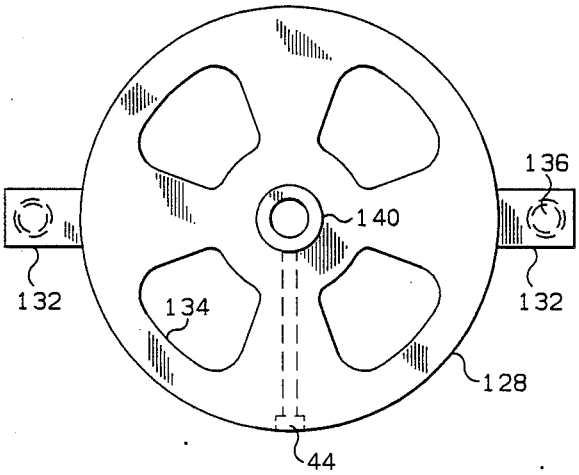
FIG. 8 is an enlarged view in elevation of another element of the dome member shown in FIG. 6.

Referring to FIGS. 6, 7, and 8, a variable dome member 17 comprises a fixed circular back plate 128 centrally mounted in an opening 138 provided in fuel flange 21 by means of a pair of mounting bars 132. A plurality of spaced apart openings 134, arranged in a circle, are provided in said plate 128. A stop pin 136 projects perpendicularly from one of said bars 132. Said opening 138 in fuel flange 21 is in communication with air supply conduit 44 (see FIG. 2). A centrally disposed circular boss member 140 projects outwardly from the upstream face of said fixed plate 128 for receiving and mounting a front adjustable plate 142 thereon.

Said front plate 142 is circular-like, and of the same size as, said fixed plate 128. A plurality of spaced apart openings 144 are provided in said front plate 142 and correspond in size and circular arrangement to that of said openings 134 in backplate 128. A pair of spaced apart stop pins 146 project perpendicularly from the side of said front plate 142. An actuator tab 148 projects perpendicularly from one side of said front plate at a location spaced from said stop pins 146. Push rod 150 is pivotally connected to said actuator tab 148 in any suitable manner as shown. Said push rod 150 can be actuated in a back and forth manner by means of roller mechanism 152 mounted on the outside of fuel flange 21 in any suitable manner. Flexible shaft 154 extends through a control panel (not shown) and is connected to a rotatable knot (not shown) for movement of said shaft 154, said roller mechanism 152, and said rod 150 for rotating said front plate 142 within the limits imposed by stop pins 146 acting against stop pin 136.

In assembly, said fuel flange 21 is mounted between adjacent flanges as shown in FIG. 2. The upstream end of the flame tube fits to adapter 26 which in turn is secured to the downstream face of dome member 17. Fuel conduit 19 extends through said flange 21 and communicates with a central cavity formed in the downstream side of dome member 17 which is adapted to receive fuel nozzle 24 mounted therein. The central opening 156 in front plate 142 fits into boss member 140 on backplate 128 and said front plate is held in sliding engagement with backplate 128 by means of cap screw 158 and washer 160. Said push rod 150, by virtue of the back and forth movement described above, rotates said front plate 142 to bring openings 144 therein into and out of register with openings 134 in said backplate 128 to thus vary the effective size of opening provided in variable dome 17 and vary the amount of air passed through said dome into mixing section 11 and then into primary combustion region 13. As shown in FIG. 2, said openings 144 and 134 are in full register and the dome member is completely open. As shown in FIG. 6, said openings are out of register and the dome member is completely closed.

In the practice of the invention, it is sometimes desirable to control the effective size of the openings in the variable dome 17 of the combustors of the invention in accordance with fuel flow to the combustor. This can be accomplished manually by means of the push rod 150 and associated elements. However, in continuously operating combustors which operate over a varied range of operating conditions, it is sometimes desirable that the effective size of the dome openings be controlled automatically. Any suitable control means can be provided for this purpose, for example, the control means diagrammatically illustrated in FIG. 6. Said control means can be adapted to the combustor of FIG. 1 by providing an orifice in fuel conduit 19, operatively connecting said orifice to a controller unit 109, and operatively connecting said controller unit by a suitable linkage 110, to shaft 154 of rack and roller mechanism 152 which moves push rod 150 back and forth. Thus, controller 109 responds to the flow of fuel through the orifice in conduit 19, actuates linkage 110, which is operatively connected to shaft 154, and programs the back and forth movement of rod 150. The specific control means comprising the orifice in fuel conduit 19, controller 109, and linkage 110 forms no part, per se, of the present invention. Said control means can be modified or substituted for by any means known in the art. An automatic control means such as described above can be employed on the combustors of the invention when said combustors are employed, for example, in a gas turbine engine, either stationary or mobile. In a mobile installation such as a vehicle, such a control means can be employed to vary the amount of air admitted through the dome member in accordance with fuel flow as said fuel flow changes with changes in speed of the vehicle. In a stationary installation such as a large gas turbine engine driving a standby generator in a power plant, such a control means can be employed to vary the amount of air admitted through the dome member in accordance with fuel flow when the generator must be put on the line rapidly.

Figure 10:
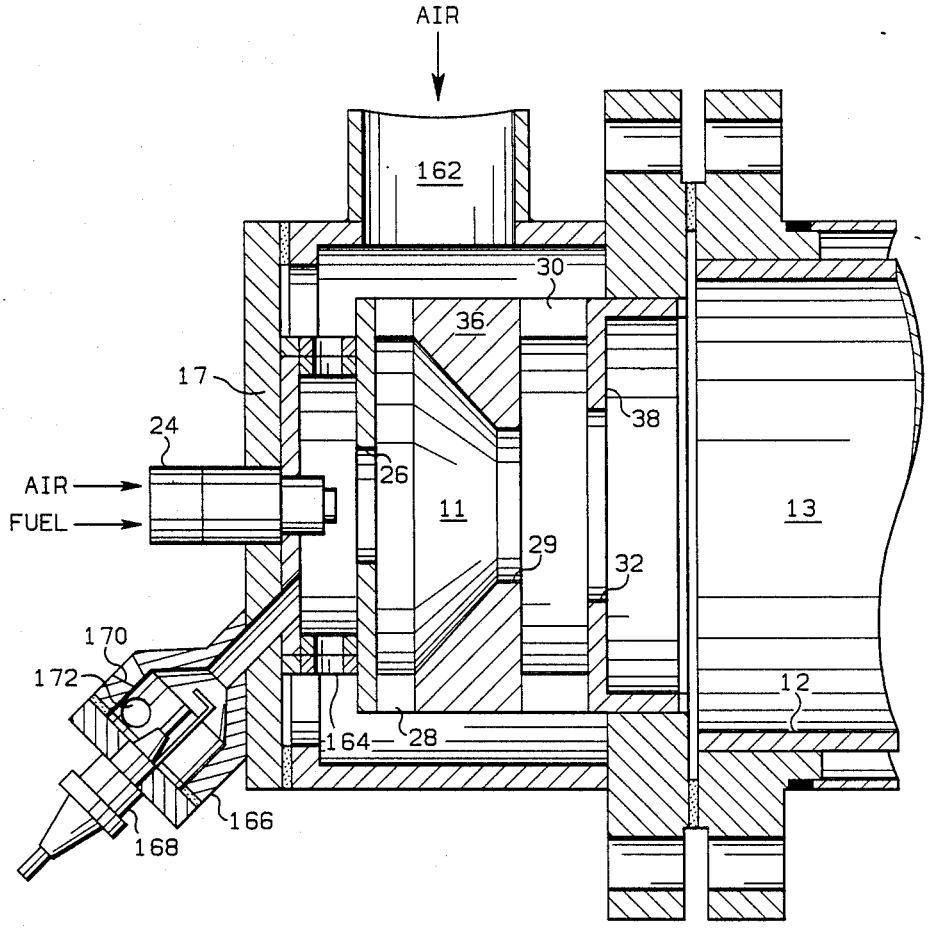
FIG. 10 is an enlarged view, partially in cross section, of a modification of the upstream end portion of the combustor of FIGS. 1 and 2.

FIG. 10 shows a modified dome member 17, mixing zone 11 and primary combustion region 13 for the combustor of FIGS. 1 through 5. In this modification, various elements have been simplified to make the combustor particularly suitable for the combustion of heavy oils, such as shale oil.

Specifically, the nozzle 24 (referred to in detail hereinafter) is adapted to thoroughly mix the fuel in air for improved atomization of the fuel. The remainder of the primary air to the primary region 13 of the combustor is introduced through conduit 162. Conduit 162 thus supplies primary air through tangential slot means 28 and 30 and through variable air inlet means 164. FIG. 40 also illustrates a suitable ignition means 166. Ignition means 166 is mounted to communicate with mixing region 11 through a passage through dome member 17. Ignition means 166 includes a sparkplug 168, a fuel inlet 170 (for a fuel such as propane) and an air inlet 172.

Referring to FIGS. 11, 12 and 13, the dome member can comprise a fixed generally cylindrical member 80 (see FIG. 12) closed at one end and open at the other end. A plurality of openings 82 are provided at spaced apart locations around the circumference of said cylindrical member 80 adjacent the closed end thereof. An opening 84 is provided in said closed end for receiving a fuel nozzle. The outlet of said fuel nozzle would be positioned similarly as shown for nozzle 24 in FIG. 2. Another opening 88 is provided in said closed end for receiving an igniter means (not shown) which would also extend to a position adjacent the outlet of the fuel nozzle. Openings 92 are provided for receiving mounting bolts (not shown) for mounting the dome member onto the central portion of a fuel flange such as fuel flange 21. Said central portion of the fuel flange would be adapted to accommodate the fuel nozzle similarly as shown in FIG. 2, and also the igniter means. A mounting flange 94 is connected to and provided around the open end of said cylindrical member 80 for mounting said member 80 on the upstream end of a combustor flame tube, similarly as shown in FIG. 2. A groove 96 is provided in said flange 94 around the open base of said cylindrical member 80. A pair of spaced apart stop pins 98 project from said flange 94 perpendicular thereto and adjacent said cylindrical member 80. An orifice 95, preferably tapered inwardly, is provided in said flange 94 adjacent and in communication with the open end of said cylindrical member 80.

The adjustable throttle ring 100 of FIG. 11 is mounted around said cylindrical member 80 and is provided with a plurality of spaced apart openings 102 therein of a size, number, and shape and at spaced apart locations, corresponding to said openings 82 in cylindrical member 80. Said throttle ring fits into groove 96 in flange 94. An actuator pin 104 projects outwardly from the outer surface of said throttle ring 100 and coacts with said stop pins 98 to limit the movement of said ring 100. Friction lugs 106 are provided on the top and the bottom of said ring 100 for movably bearing against the surface on which cylindrical member 80 is mounted, and the bottom of groove 96, respectively. FIG. 13 is a cross section of ring 100 mounted on member 80.

Any suitable means can be provided for actuating actuator pin 104. Such actuating means can comprise a Y-shaped yoke which fits around actuator pin 104, with the bottom leg of the Y connected to a rotatable control rod which extends through the outer housing or casing of the combustor. Rotation of said control rod will pivot the Y-shaped yoke and coact with said pin 104 to cause rotation of throttle ring 100 within the limit of the space between stop pins 98 and thus adjust the register and effective size of the opening provided by openings 82 and 102. As shown in FIG. 13, said openings 82 and 102 are in direct register with each other to provide the maximum opening into the dome. When flange 94 is mounted on the upstream end of a flame tube, such as the flame tube in FIG. 1, air introduced through openings 82 and 102 will be introduced radially, e.g., around and generally perpendicular to the direction of introduction of fuel. Said openings 82 and 102 have been illustrated as being circular, and this is usually preferred. However, said openings can be rectangular, e.g., square, if desired.

Figure 14:
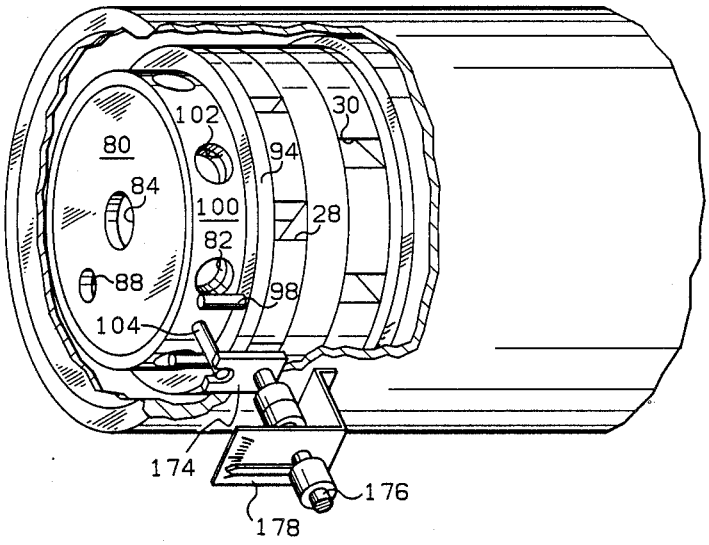
FIG. 14 is a perspective view, partially in cross section, of the variable dome of FIGS. 11, 12 and 13, mounted in the combustor of FIG. 10.

FIG. 14 shows the variable air inlet means of FIGS. 11, 12 and 13 mounted in the dome 17 of the combustor shown in FIGS. 1 through 5 or that of FIG. 10. FIG. 14 also shows a suitable operating mechanism including pivot arm 174, control shaft 176 and dome rotation indicator 178. This particular variable dome member is preferred when burning heavy fuels.

Figure 15:
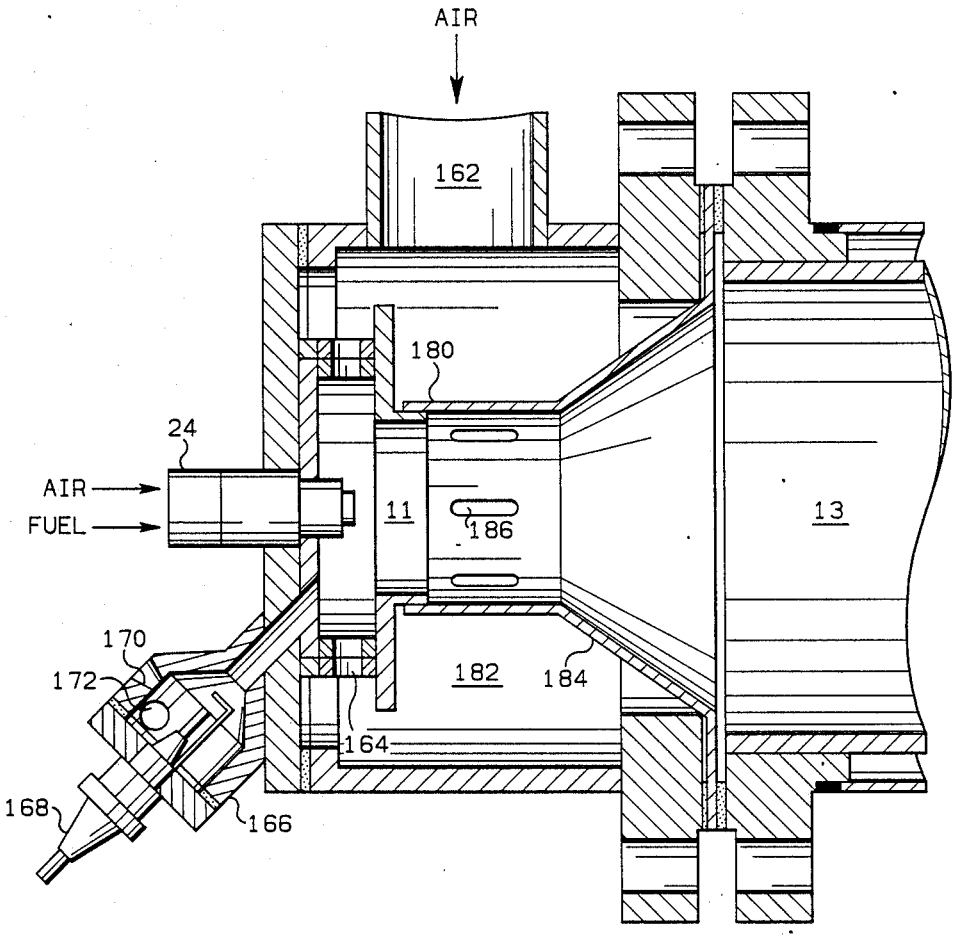
FIG. 15 is an enlarged view, partially in cross section, of the upstream end portion of another combustor, in accordance with the invention.

FIG. 15 of the drawings shows an alternative mixing-primary combustion region 11–13 which can be utilized in the practice of the present invention. The structure of FIG. 15, in an overall sense, is similar to that of FIG. 10 and, therefore, is also well suited for the combustion of heavy oils, such as shale oil.

The apparatus of FIG. 15 differs from that of FIG. 10 in the manner of introducing primary air and mixing the fuel and air. Specifically, a neck section 180 is formed downstream of nozzle 24 to form an annular primary air chamber 182. Neck means 180 diverges outwardly, in the downstream direction, to substantially the full diameter of the flame tube, thus forming flared or diverging section 184. All of the primary air, beyond that utilized in nozzle 24, is introduced through variable dome 164 and slots 186. This means of introduction of primary air causes the air to radially impinge against the stream of air-fuel from nozzle 24, thus bringing about intimate mixing and stabilization of the flame adjacent the upstream end of the primary combustion zone.

Figure 16:
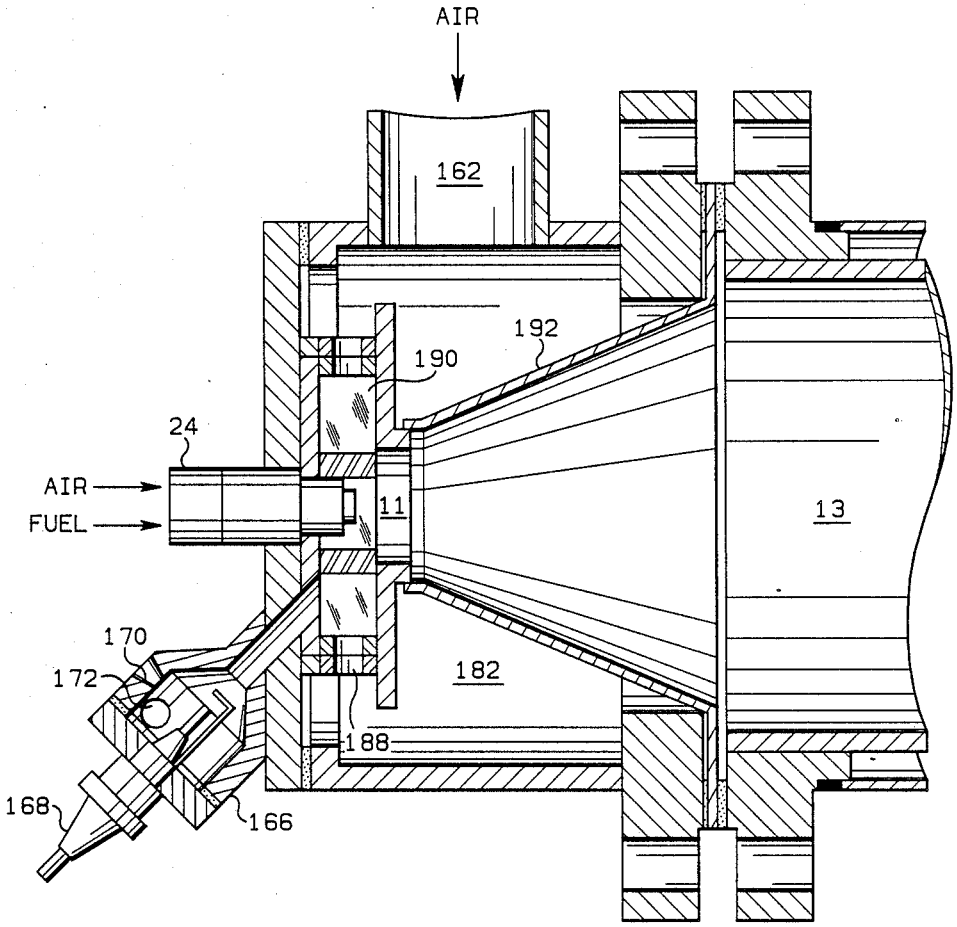
FIG. 16 is an enlarged view, partially in cross section, of the upstream end portion of yet another combustor, in accordance with the invention.

FIG. 16 shows still another mixing-primary combustion region 11–13 which is adapted to attain intimate mixing of a heavy fuel, such as shale oil, and air and stabilize the flame adjacent the upstream end of the primary region.

The combustor of FIG. 16 is similar to the previous embodiment of FIG. 15, except that a single primary air introduction means 188 (in addition to the air introduced through nozzle 24) is provided which combines the features of a variable air inlet and tangential air introduction. More specifically, primary air introduction means 188 includes fins 190, disposed at 45° angles such that the air entering through the variable inlet enters the mixing region 11 tangentially or in a circular manner, as through the air inlet means 28 and 30 of FIGS. 1 through 5, 9 and 10. The structure of FIG. 16 also includes a flared or diverging section 192, similar to section 184 of FIG. 15, but shortens the neck section 180 of FIG. 15.

In all of the embodiments of the mixing-primary combustion regions 11–13, previously discussed, intimate mixing is attained in the mixing region 11 and the flame is stabilized adjacent the upstream end of primary combustion region 13. However, it should be recognized that there is no sharp line of demarcation separating the mixing region 11 and the primary region 13, since, as previously stated, the upstream end of the primary combustion region 13 is considered to begin at the tip of the fuel nozzle 24 and the primary combustion region flame is established and stabilized at slightly different points in the upstream end of the primary combustion region in the several embodiments described. Hence, the mixing region 11 and the primary combustion region actually merge into a single multi-function mixing-primary combustion region, but, in all cases, the flame is stabilized "adjacent the upstream end of the primary combustion region". Viewed in another way, the upstream end of the primary combustion region can be said to differ in location for differing embodiments and, in essence, be located approximately at the point along the mixing region-primary combustion region 11–13 where the primary combustion region flame is stabilized. In this case, it is then most accurate to say that the flame is stabilized "adjacent the point where the mixing region 11 and the primary combustion region 13 merge."

By contrast to the mixing-primary combustion region 11–13, there is, in fact, a definite, sharp line of demarcation between the primary combustion region 13 and the secondary combustion region 15. This line of demarcation is "adjacent the point of introduction of secondary air." Previously discussed FIGS. 1 and 10 and FIGS. 17, 18 and 19, illustrate several embodiments of combustors adapted to establish an abrupt change from the fuel-air ratio of the primary combustion region 13 to that of the secondary combustion region 15, while at the same time preventing back-flow of secondary air into the primary combustion region 13 and creating intimate mixing in the secondary combustion region 15.

In the embodiment of FIGS. 1 and 10, the above is accomplished by converging and then expanding the flame front by virtue of orifices 48 and 50 and the radial introduction of secondary air through radial air inlet ports 34 located between the two orifices.

Figure 17:
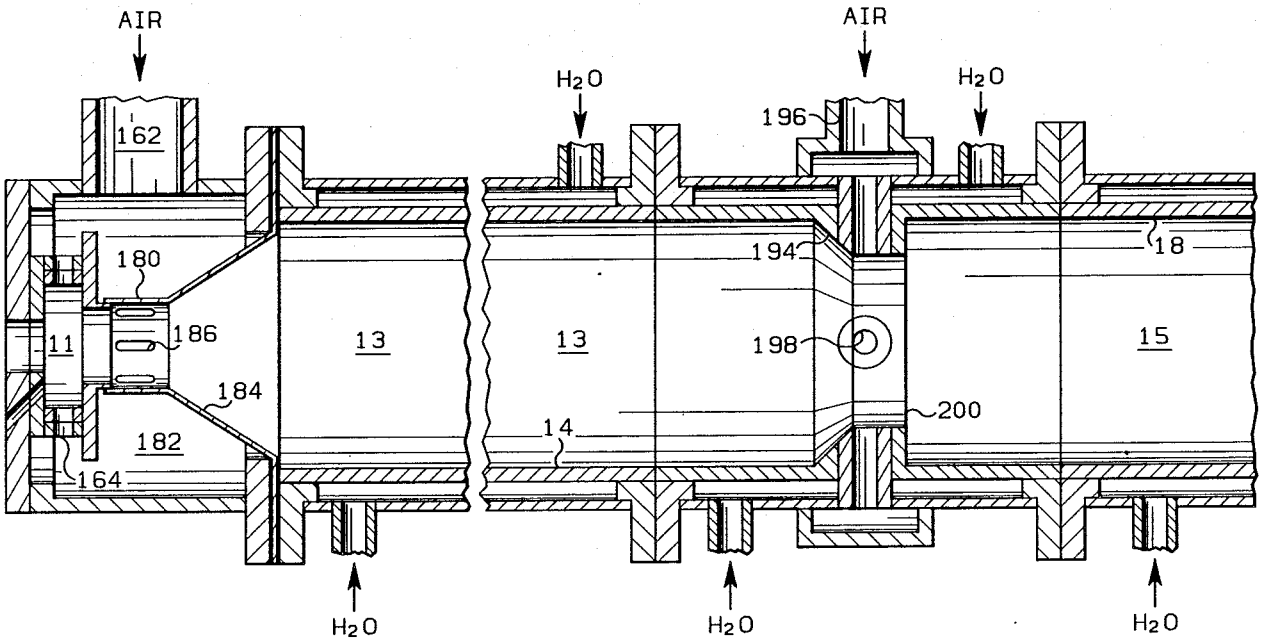
FIG. 17 is a cross-sectional view of the upstream end portion of the combustor of FIG. 15 together with a partial view of a modified central portion of a combustor which can be utilized with any of the previously illustrated upstream portions of combustors in accordance with the invention.

FIG. 17 shows a combustor with the specific mixing-primary combustion region 11–13 of FIG. 15 but a modified means for terminating the primary combustion region. In this embodiment, the flame front is converged and then expanded by locating a nozzle in the combustor while simultaneously introducing secondary air in a radial fashion into the vena-contracta of the nozzle. Specifically, an annular, angular ring 194 converges, in a downstream direction, from the full diameter of the primary combustion region 13 to a reduced diameter. Secondary air is then introduced radially downstream of ring 194 through conduit 196 and air inlet ports 198. Still further downstream, an annular ring or flange 200, having an inside diameter equal to the inside diameter of ring 194, is located. The embodiment of FIG. 17 accomplishes the same results as that of FIGS. 1 and 10; namely, an abrupt change from the fuel-air ratio of the primary combustion region 13 to that of the secondary combustion region 15, prevention of back-flow of secondary air into the primary combustion region 13 and intimate mixing in the secondary combustion region 15, but has the advantage that sharp corners, where carbon can collect, are eliminated.

Figure 18:
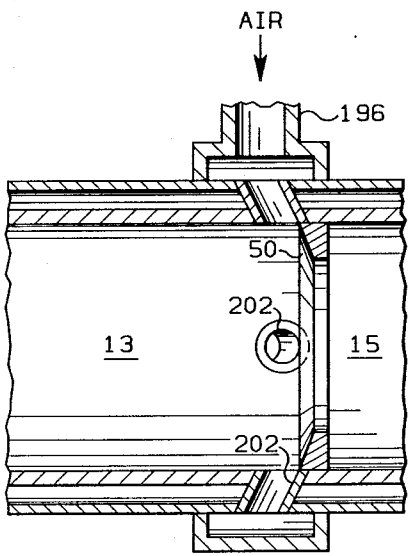

FIG. 18 shows still another means of introducing secondary air to provide an abrupt change from the fuel-air ratio of the primary combustion region 13 to that of the secondary combustion region 15, prevent back-flow of secondary air into the primary combustion region 15 and provide intimate mixing in the secondary combustion region 15. This is accomplished by providing secondary air inlet ports 202 which introduce secondary air radially and at an angle toward the downstream end of the combustor. An orifice means 50 similar to that of FIG. 1 is provided.

Figure 19:
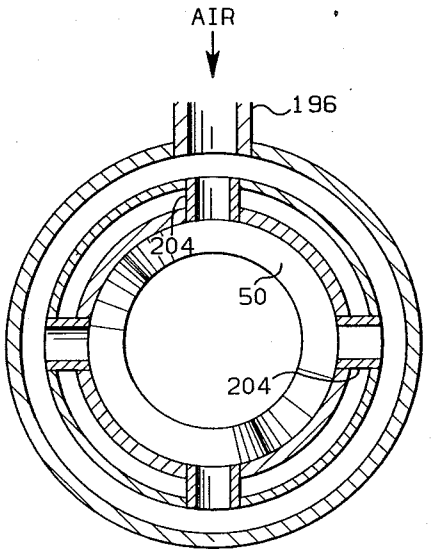
FIGS. 18 and 19 are partial cross-sectional views of two modified central portions of combustors useful in accordance with the invention.

FIG. 19 illustrates yet another means of introducing secondary air, in which radially-disposed secondary air inlet tubes 204 extend into the flame tube to form a reduced diameter central dilution region. Orifice means 50 is located as in previously discussed FIG. 1.

Figure 22:
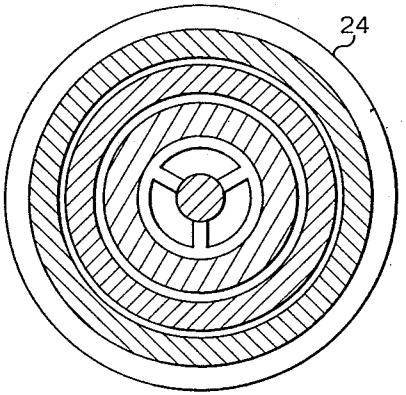
FIGS. 21 and 22 are cross-sectional views, taken along the lines 21—21 and 22—22, respectively, of FIG. 20.
Figure 21:
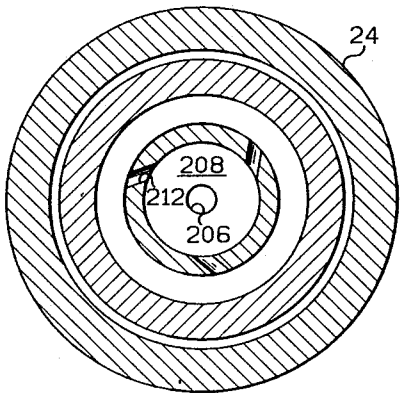
Figure 20:
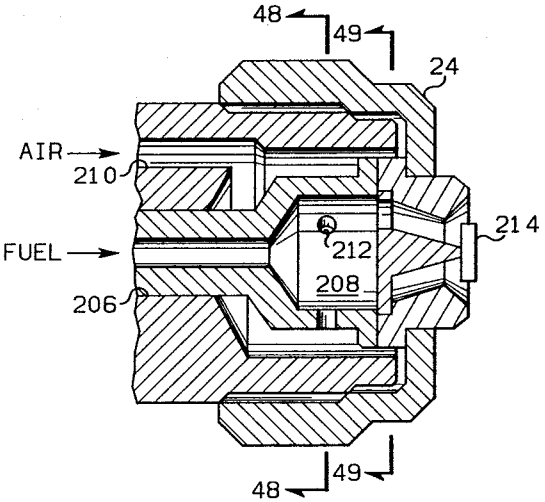
FIG. 20 is a partial cross-sectional view of a nozzle useful in the combustors of the invention.

FIGS. 20, 21 and 22 show in greater detail the fuel nozzle 24.

In accordance with FIGS. 20, 21 and 22, fuel is introduced through passage 206 and thence into mixing chamber 208. Air is introduced through passage 210 and thence tangentially into mixing chamber 208 through air inlet means 212. The fuel and air are intimately mixed in chamber 208 and then impinge or blast against impingement or blast plate 214. This particular type of fuel nozzle is particularly advantageous for use with heavy fuels, such as shale oil, since impingment of the fuel-air mixture against plate 214 serves to break up droplets of the fuel. The particular nozzle illustrated is available from Delavan Manufacturing Co., West Des Moines, Iowa as an "Air blast nozzle" and is available for different flow capacities and fuel-air ratios. The plate 214 is also adjustable so as to alter the exit angle from the nozzle. As used in the present invention, the exit angle of the fuel-air mixture was selected to be about 90°.

In one method of operating the combustor of FIGS. 1–8, a stream of fuel is introduced into the upstream end portion of mixing section 11 via fuel nozzle 24. Said fuel nozzle can be any suitable type of nozzle, e.g., a spray nozzle, an air assist nozzle, etc. The type of nozzle employed will depend to some extent at least, upon the type and properties of the fuel being used. A first stream of air is introduced into said mixing region 11 in a swirling or circular-like direction around said stream of fuel. Preferably, said first stream of air is introduced in a circumferential direction, around said fuel, and tangential the inner wall of said mixing section, as by means of tangential slots 28.

Figure 3:
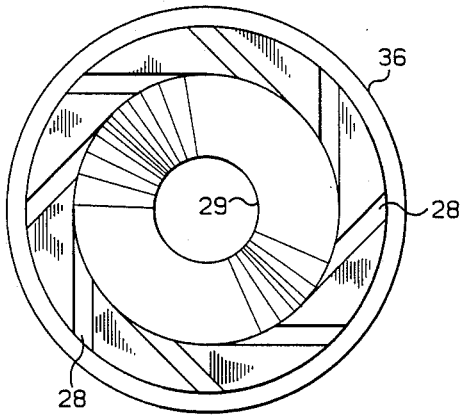
FIG. 3 is an enlarged view, in elevation, taken along the line 3—3 of FIG. 2 and illustrating one set of tangential entry ports or slots.
Figure 4:
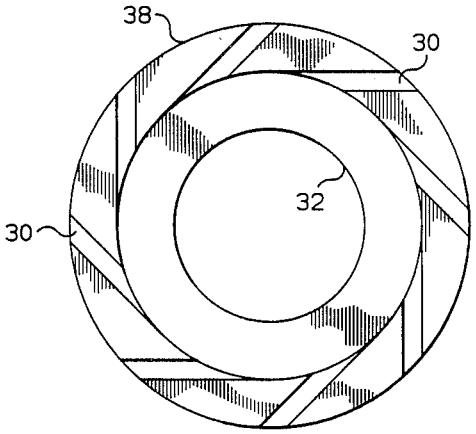
FIG. 4 is an enlarged view, in elevation, taken along the line 4—4 of FIG. 2 and illustrating another set of tangential entry ports or slots.
Figure 5:
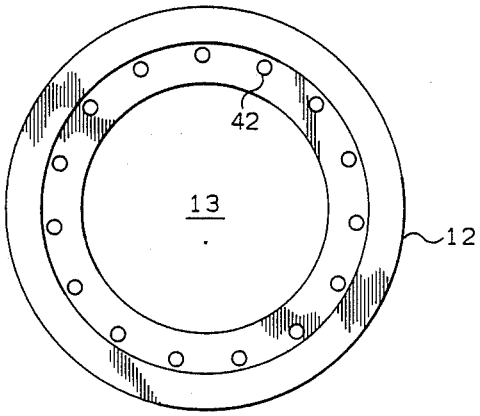
FIG. 5 is a view, in elevation, taken along the line 5—5 of FIG. 1.

Preferably, a second stream of air is introduced into said mixing region 11 in a swirling or circular-like direction around said stream of fuel. Said second stream of air will also preferably by introduced in a circumferential direction, around said fuel, and tangential the inner wall of said mixing section, as by means of tangential slots 30. Said first stream of air, and said second stream of air when used, can have the same direction of swirl or a different direction of swirl, e.g., both clockwise, both counterclockwise, or one clockwise and one counterclockwise. Preferably, the directions of swirl will be opposite as illustrated in FIGS. 3 and 4. When employing the slots 28 illustrated in FIG. 3 the direction of swirl will be clockwise, looking downstream. When employing the slots 30 illustrated in FIG. 4 the direction of swirl will be counterclockwise, looking downstream. It is also preferred that the volume of said second stream of air be greater than the volume of said first stream. This is preferred so as to more effectively counteract or neutralize the swirl of the first stream of air, as well as the axial component of the stream flowing axially in the mixing section, and thus provide a more homogenous mixture of fuel and air flowing from said mixing region into the primary combustion region. Said first and second streams of air thus comprise primary combustion air.

Said first stream of air, and/or said second stream of air when used, and said stream of fuel form a fuel-rich combustible mixture which is passed from said mixing region 11 into the primary combustion region 13. In said primary combustion region only partial combustion of said fuel-rich combustible mixture is caused to occur and a mixture comprising hot combustion products and partially combusted fuel is formed. Said combustible mixture is maintained in said primary combustion region for a period of time which is sufficient to provide a total residence time in said mixing region and said primary combustion region which is sufficient to reduce the conversion of fuel-nitrogen to $NO_x$ emissions.

Said combustion products and partially combusted fuel mixture is then passed into the secondary combustion region which is located downstream from and in communication with said primary combustion region. A stream of secondary air is introduced into said secondary combustion region via ports 34, located at the upstream end thereof. In said secondary combustion region the combustion is completed under fuel-lean conditions with the resultant burnout of CO to $CO_2$.

Thus, the combustors discussed can be operated in a manner and the methods of the invention comprise an operation, wherein no axial air is introduced into the upstream end portion of mixing region 11. As shown by the examples given hereinafter such a method of operation gives good results and is one preferred method of operation, depending upon circumstances.

However, generally speaking, there will be more situations where it will be preferred to introduce a third stream of air into the upstream end of, and generally axially with respect to, said mixing region, e.g., through dome member 17. Thus, generally speaking, such a method of operation can be said to be a more preferred method, again depending upon the circumstances or situation. When said third stream of air is used, either one or both of said first and second streams of air can be used in combination therewith. When only one of said first and second streams of air is used, the above-referred to third stream of air will become the second stream of air introduced into said mixing region.

When introducing said third stream of air through a variable dome member such as dome member 17, or through a nonvariable dome member, one presently preferred method of introducing said stream of fuel is to introduce same in the form of a hollow cone which diverges from its point of origin. Said third stream of air is then introduced around the stream of fuel, intercepts said cone, and mixes with said fuel.

Another preferred method of operation, particularly when using a heavy fuel, comprises introducing said third stream of air through a variable dome member such as that illustrated in FIGS. 11, 12 and 13. In such instances said third stream of air is introduced around said fuel in a generally radial direction which is generally perpendicular to the direction of introduction of said fuel.

Figure 23:
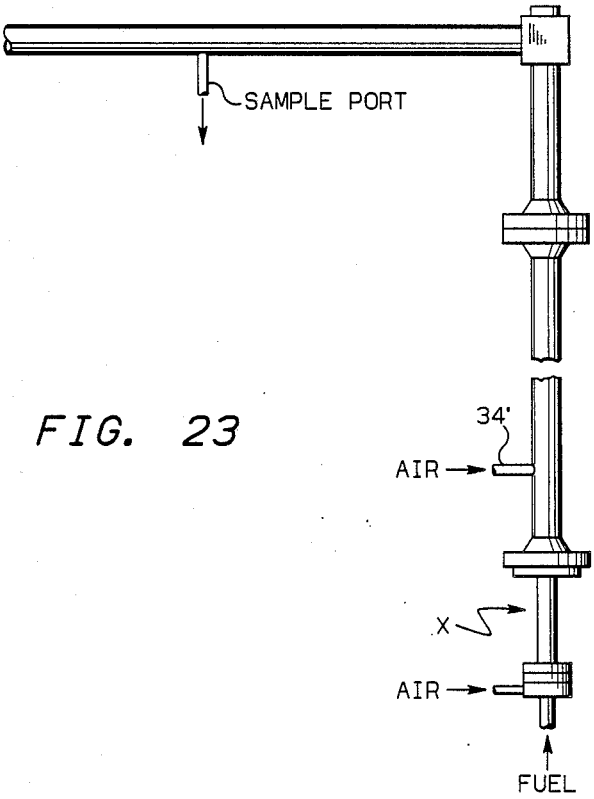
FIG. 23 is a diagrammatic illustration of a combustor test installation and includes Combustor X, another combustor in accordance with the invention.
Figure 24:
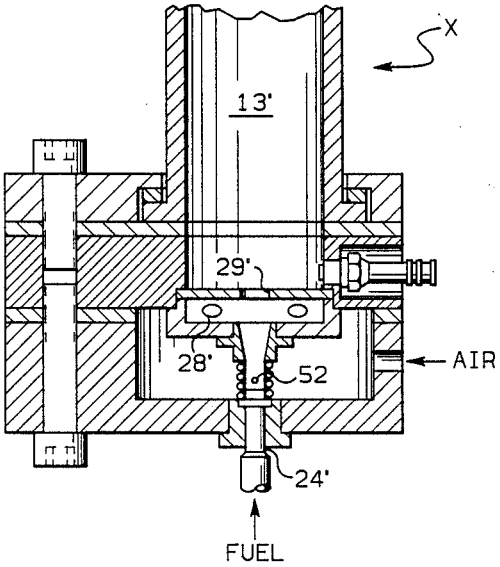
FIG. 24 is a diagrammatic illustration in cross section of said Combustor X, shown above in FIG. 23.

Referring now to FIGS. 23 and 24 there is illustrated another combustor (designated herein as Combustor X) in accordance with the invention. Said Combustor X comprises an upstream fuel-air mixing section 11', an intermediate primary combustion section 13' located downstream from and in communication with said mixing section, and a secondary combustion section 15' located downstream from and in communication with said primary combustion section. Said mixing section 11' is defined at its downstream end by an orifice plate or means having an orifice 29' formed therein. A first air inlet means comprising tangential entry ports 28' is provided for introducing a first stream of air into said mixing section 11', similarly as in the combustor illustrated in FIGS. 1 and 2. Although only one tangential air entry means is illustrated in FIG. 24, it is within the scope of the invention to provide said Combustor X with a second tangential air entry means, similarly as in the combustor illustrated in FIGS. 1 and 2.

As illustrated in FIG. 24, said Combustor X is provided with means for introducing a second stream of air into mixing section 11' in admixture with the stream of fuel. Said second stream of air is introduced into said stream of fuel via radial port(s) 52 supplied from the same plenum chamber supplying tangential entry ports 28'. As illustrated in FIG. 24, said Combustor X is not provided with a variable dome member. However, it is within the scope of the invention to do so. It is also within the scope of the invention for fuel nozzle 24' in FIG. 24 to be any suitable type of fuel nozzle, including an air-assist fuel nozzle. Preferably, said secondary air inlet means can comprise a plurality of fingers extending into the flame tube.

The operation of said Combustor X is substantially like that described above and elsewhere herein for the operation of the combustors represented by FIGS. 1 and 2. Said operation will be clear to those skilled in the art in view of the disclosure herein.

In the above-described methods of operating the combustors, or combustion zones, of the invention, which introduce air tangentially, in accordance with one embodiment of the invention, the amount of swirl air introduced into the mixing region 11 or 11' will be within the range of from about 35 to 100 percent of the total air introduced into said mixing region and then into the primary combustion region. Stated another way, the amount of air introduced through the dome member and/or with the fuel and into said mixing region can be an amount of up to 65 percent of said total air.

As shown by the examples given hereinafter, which utilize a light fuel with high nitrogen content, it has been found that the total amount of air introduced into said mixing region and then into the primary combustion region should be an amount (relative to the amount of fuel) which is only sufficient to form a fuel-rich combustible mixture of fuel and air having a fuel-air equivalence ratio within the range of from 1.05 to about 1.7, if one is to obtain a significant reduction in the amount of fuel-nitrogen which is converted to $NO_x$ emissions, e.g., to 10 percent or less. When it is desired to obtain a further reduction in said conversion, e.g., to 7.5 percent or less, said fuel-air equivalence ratio should be maintained in the range of from about 1.14 to about 1.56.

As shown by said examples given hereinafter, it has been surprisingly discovered that there is a definite relationship between said fuel-air equivalence ratio ($\phi$) and the total residence time in said mixing region and said primary combustion region. It has been found that, for relatively light fuels, said residence time should be maintained within the range of from about 30 to about 120 milliseconds, preferably 45 to 75 milliseconds in many instances, and should be sufficient, when correlated with said fuel-air equivalence ratio, to significantly reduce the conversion of fuel-nitrogen to $NO_x$ emissions, e.g., to less than 10 percent. The correlation or relationship between said fuel-air equivalence ratio and said residence time is discussed further hereinafter in connection with the examples.

It has also been surprisingly discovered that for the best results, e.g., the minimum conversion of fuel-nitrogen to $NO_x$ emissions, when tangentially introduced air is used, the amount of swirl air used should also be correlated with said fuel-air equivalence ratio and said residence time. This correlation is discussed further hereinafter in connection with the examples.

FIGS. 25, 26, 27 and 28 schematically illustrate burners, in accordance with the present invention, which are specifically designed for use in furnaces, boilers, process heaters and the like. These burners all have in common the fact that the heated zone of the furnace, heater or boiler becomes the downstream portion of the secondary combustion zone and, accordingly, the portion of the secondary combustion zone forming an integral part with the primary combustion zone is extremely short, generally just of sufficient length to permit the introduction of secondary air in accordance with the present invention.

Figure 25:
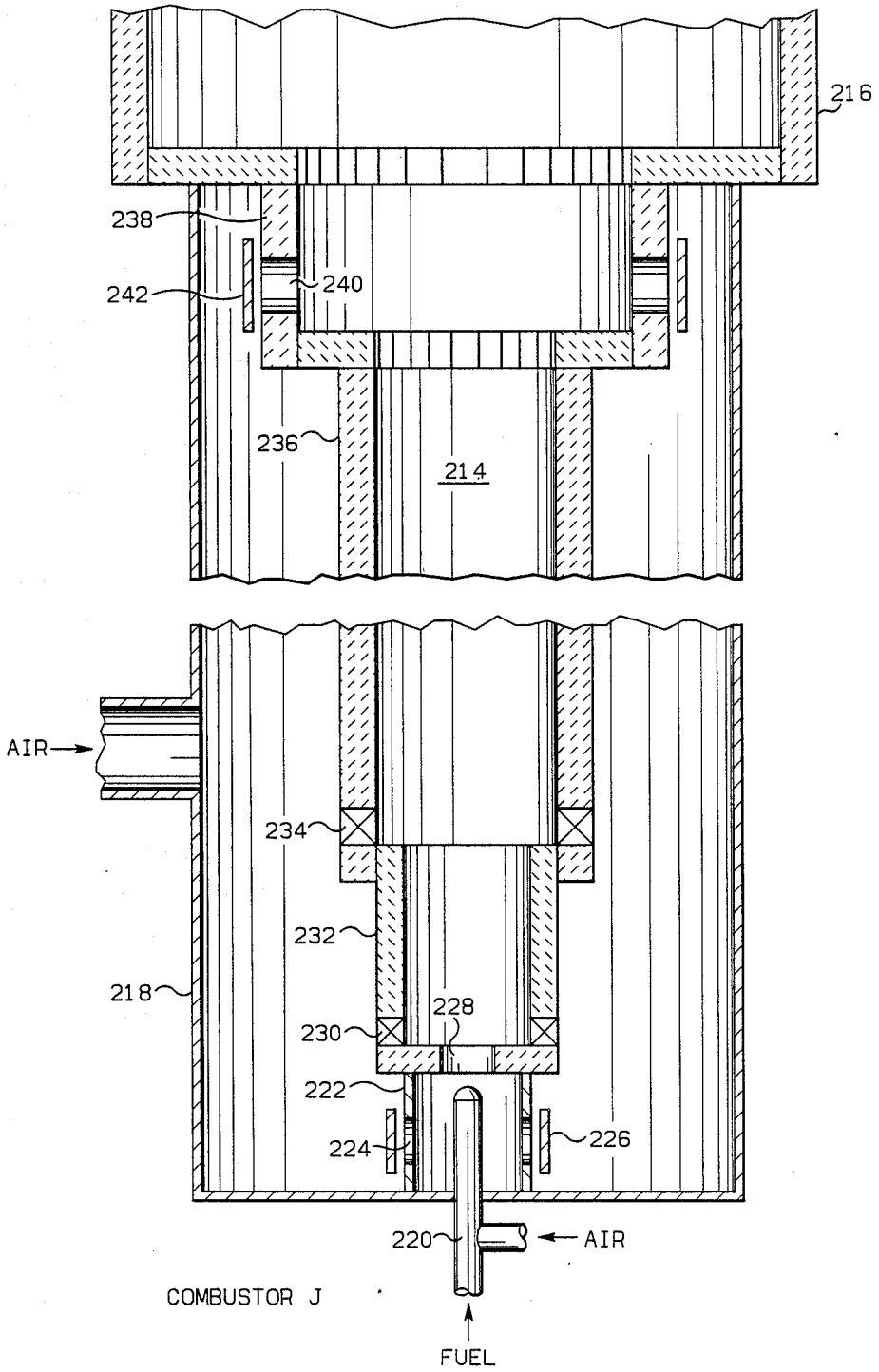
FIGS. 25–29 are cross-sectional, schematic illustrations of a series of burners of the present invention adapted for use in or as process heaters, industrial furnaces, boilers.

The combustor of FIG. 25, referred to herein as combustor J, accomplishes intimate mixing of the fuel and a first volume of air or primary air by means of a configuration of the type shown in FIG. 10 hereinabove described and the primary combustion zone is abruptly terminated and the secondary combustion zone initiated by a step-type, abrupt expansion as set forth in U.S. Pat. No. 4,205,524. Specifically, the main body section 214 of the burner is comprised of ceramic sections and is attached to the main heating section 216 of a furnace generally constructed of fire brick. The burner 214 is surrounded by air plenum 218 which supplies most of the primary air to the burner as well as all of the secondary air. Fuel is supplied at a central location and in an axial direction by an air blast atomizer, utilizing a part of the first volume of air or primary air. The fuel nozzle extends into the air plenum and is surrounded by a wall 222 defining an air introduction or mixing zone. A second portion of the primary air is introduced through air slots 224, the size of which are adjustable by means of damper 226. While the second portion of primary air entering through slots 224 enters in a radial direction, this direction is changed to axial as the air exits the zone 222 through reduced diameter throat 228. Thus, the fuel and first portion of the primary air and the second portion of the primary air form the axial flow component referred to herein. A third portion of the primary air is introduced through tangential, counterclockwise primary air slots 230. This air thus introduced in a generally radial direction then mixes with the fuel and air from the air blast nozzle and slots 224 in zone 232. Finally a fourth portion of the primary air is introduced through tangential, clockwise air slots 234. Accordingly, the air entering through slots 230 and 234 form the generally radial flow component referred to herein. While section 232 is referred to as a mixing zone, in actual practice when the burner is operating at peak performance the flame will be seated adjacent throat 228 of the burner. Fuel rich combustion thus takes place in sections 232 and 214 of the burner, resulting in the production of an effluent containing unburned fuel CO and carbon dioxide and most of the nitrogen in the form of elemental nitrogen. The flame front leaving section 214 of the burner is then abruptly expanded into section 238. Section 238 is provided with air slots 240 through which the secondary air or the remainder of the air is introduced so as to produce a fuel lean mixture. A damper 242 is also provided to adjust the volume of this air. The air through slots 240 enters radially and is of sufficient velocity to essentially penetrate the flame front to its axis and mix with the moving front and effluent from the primary combustion region. The addition of air through the secondary air slots 240 thus produces an overall fuel lean fuel air mixture. This mixture is then again expanded into the heating zone 216 of the furnace. This expansion completes the mixing of the primary zone effluent or flame front and the secondary air. By way of example, section 232 has a length to diameter ratio of about 1. A fuel-air mixing zone forming a part of zone 236 also has a length diameter ratio of 1 and, what may be termed the $NO_x$ reduction portion of zone 236, is about 4 feet long at a flow velocity of about 50 feet per second. In the operation of this burner the air introduced would be approximately 2.8 percent to the air blast nozzle, 26.6 percent through slots 224, 14.1 percent through slots 230 and 21 percent through slots 234, thus introducing a first volume of air or primary air equal to 64.5 percent of the total air to combustion system. The remaining 35.5 percent of the total air is introduced through secondary air slots 240 to produce an overall fuel/air ratio having 3 percent excess oxygen or a fuel/air equivalence ratio of 0.87. Thus, under these designed conditions, the fuel/air equivalence ratio in the primary combustion region or fuel-rich region would be 1.35. As in previous configurations the flame is seated adjacent the constriction 228 (the end of nozzle 220 and the primary combustion as fuel-rich combustion extends from this point to the secondary air introduction slots 240.

Figure 26:
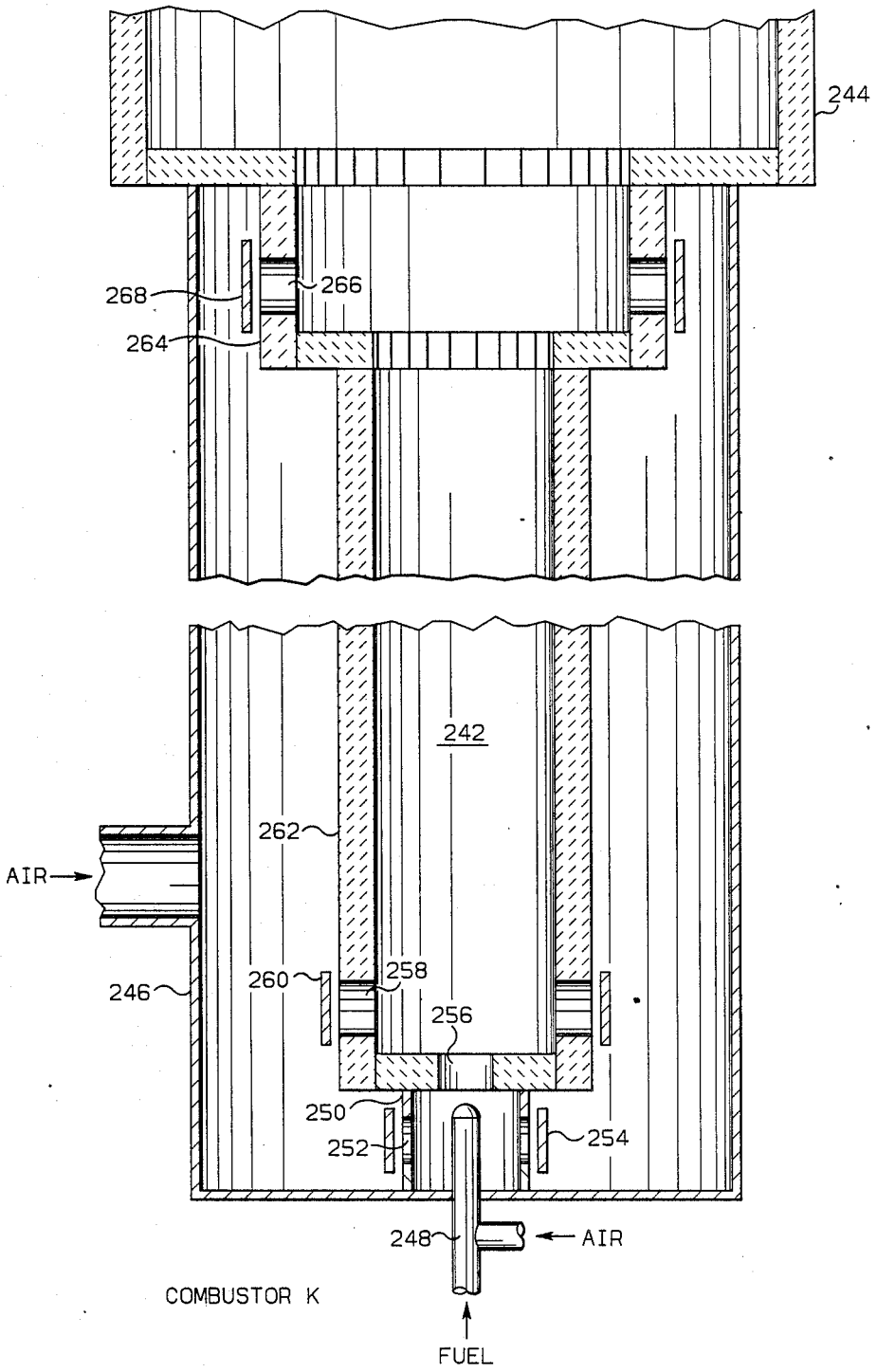

FIG. 26 shows yet another embodiment of the present invention specifically designed for use with a process heater, boiler or the like. The burner of FIG. 26 utilizes a fuel-primary air mixing configuration similar to that of FIG. 15 heretofore described and an abrupt termination means for the introduction of secondary air and mixing of the secondary air with the flame front of the character set forth in U.S. Pat. No. 4,205,524.

Specifically, the burner 242 is connected to heated section 244 of a furnace, boiler or the like. As in the previous embodiment, the heated region 242 comprises the downstream portion of the fuel lean or secondary region of the combustion system. Burner 242 is surrounded by air plenum 246 which supplies most of the primary air and all of the secondary air to the burner system. Fuel is supplied by air blast atomizer 248 which utilizes a first part of the first volume of air or primary air. Atomizer 248 extends into mixing section 250 which is supplied with air through air introduction slots 252. A second portion of the first volume of air or the primary air is introduced through slots 252 and this volume is controlled by a damper 254. As in the previous embodiment, the air enters through slots 252 in a generally radial direction. However, in mixing section 250 and passage through restricted neck portion 256 the second portion of primary air becomes an axial flow component along with the fuel and air from air blast atomizer 248. A third volume of primary air is introduced through air slots 258 which are controlled by damper 260. The air introduced through slots 258 is introduced in a true radial direction and becomes the sole radial flow component. Simplified mixing occurs in this particular arrangement, both due to the sudden expansions of the air-fuel mixture from orifice 256 and by the air penetrating toward the core of the mixture in the axial direction from slots 258. The air-fuel mixture is ignited and the flame seated adjacent the orifice 256 and the flame front passes through the primary combustion region 262 as a fuel-rich mixture. Effluent from section 262 comprises flue gases containing unburned and partially burned fuels. This effluent is then expanded abruptly into section 264 where it is diluted to a fuel lean overall mixture by the introduction of sufficient secondary air through slots 266. The size of slots 266 is controlled by damper 268 and the mixture is then further expanded into the heating section 244 of the furnace or the like. As in the previous embodiment, abrupt termination of the primary combustion zone occurs as a result of the expansion of the flame front in section 264 the radial or axial introduction of the secondary air through slots 266 and the further expansion into the furnace proper 244. In this particular burner a typical arrangement would have a fuel-air mixing section downstream from slots 258 and having a length/diameter ratio of about 1 in section 262 of the burner followed by $NO_x$ reduction zone about 4 feet long at a flow velocity of 50 feet per second. To achieve a fuel/air equivalence ratio in the primary combustion section or zone of about 1.55, air distribution would be approximately 2.4 percent to air blast atomizer 248, 23.3 percent through slots 252, 30.6 percent through slots 258 and the remainder of 43.7 percent through slots 266, thus providing an overall fuel air equivalence ratio of 0.87 at 3 percent excess oxygen.

Figure 27:
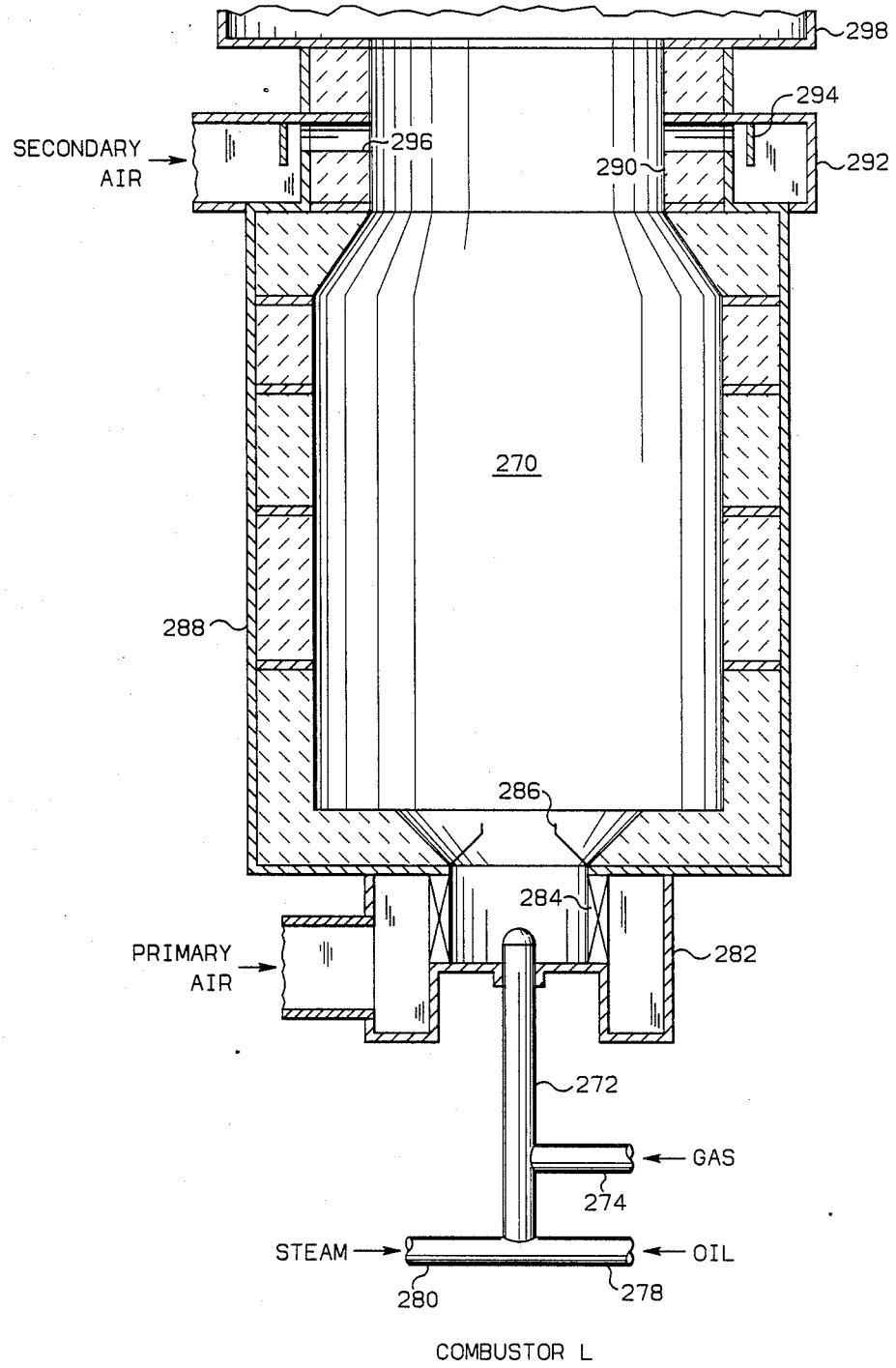

Yet another embodiment of the present invention, specifically designed for use as a burner with a combustion system in which the heated zone of a furnace, boiler or other heater comprises a secondary combustion zone, is shown in FIG. 27. The embodiment of FIG. 27 includes a fuel and primary air mixing configuration of the character shown in detail in FIG. 16 and a means for abruptly terminating the primary combustion zone of the character previously described in connection with FIGS. 1, 9, 17, 18 and 19. As previously shown in FIGS. 25 and 26, a rather long primary combustion zone was illustrated. However, in many instances where the burner is to be utilized in a combustion system for a heater, boiler or the like, space limitations are a determining factor and thus a long burner is not acceptable. Consequently, the burner of FIG. 27 is designed to fit into a shorter space than the two previous burners and for this purpose has a substantially larger diameter than the burners of FIGS. 25 and 26 so as to provide essentially the same residence time in the primary combustion zone. Since the primary combustion region, and thus the flame front passing through the primary combustion zone, is larger in cross section in this particular configuration it is helpful to have the improved abrupt termination means for the termination of the primary zone and the initiation of the secondary zone, wherein improved mixing is attained by reducing the peripheral dimensions of the flame front and introducing the secondary air either immediately prior to the reduction of the dimensions of the flame front or into the reduced dimension section of the flame front and then abruptly expanding, in this case into the heated zone of the furnace or the like. The burner 270 of FIG. 27 was designed as an actual prototype burner for burning shale oil with a heat output of 10 million BTU. The burner 270 is provided with fuel nozzle 272 having a gas inlet 274, for introducing gas to ignite the burner, and a fuel inlet 278, in this case a shale oil inlet, and a steam inlet 280. It is well known that the sensible heat of the steam makes steam superior atomizing medium for extremely heavy material such as shale oil, as opposed to air as an atomizing means. However, an air blast atomizer or the like as shown in the previous embodiments could just as readily be utilized. All of the primary air is introduced to the burner 270 through a primary air plenum 282. All of this primary air passes through spin vanes 284 which provide a swirling motion to the air introduced a generally radial direction. Consequently, in the configuration illustrated herein, fuel is the sole axial flow component and the air through spin vanes 284 is the sole radial flow component. These two flow components mix in the central region of the air plenum 282 and are passed through necked down orifice portion 286 and abruptly expanded into the primary combustion zone 288. The volume of air passing through the spin vanes 284 could be adjustable by means of a damper, as specifically illustrated in FIG. 16, but none is used in the present application, control of the volume of air being made upsteam of its introduction into the plenum 282 by appropriate damper means. The flame front passing through primary combustion region 288 is then gradually reduced in diameter to the diameter of orifice 290. Thus, the abrupt primary zone termination means shown specifically is that illustrated in FIG. 17 as opposed to that of FIGS. 1 and 9. The reason for this is that this particular configuration is better for a heavy oil or the like which has a tendency to produce carbon deposits. By gradually reducing the diameter of the flame front the pockets which would be formed by abrupt reduction to the orifice size are eliminated, thus reducing the probabilities of carbon deposit and the like. In this particular instance, secondary air is introduced through a secondary air plenum 292, separate from the primary air plenum. However, as is obvious to anyone skilled in the art and as was done in the previous embodiments, a single air plenum may supply both primary or secondary air or they may be separate as in the present case and controlled by external valves or one or both may be controlled by dampers such as the damper 294 on the secondary air slots 296 of the present embodiment. Secondary air is introduced radially into the reduced diameter portion of the flame front, thus increasing penetration of the secondary air to the central axis of the flame front and enhancing mixing and rapid conversion from a fuel rich configuration to a fuel lean configuration. The mixture is then further mixed by abrupt expansion into the heated region of the furnace proper 298. This particular configuration had a 6-inch diameter throat 286, a primary zone diameter of 28 inches, and a diameter of 20.5 inches for orifice 290. The length of the primary combustion region from the upstream edge of the secondary air inlet 296 to the throat 286 was 44 inches and the portion of the secondary combustion region from the upstream edge of secondary air slots 296 to the heated zone 298 of the furnace proper was 7 inches. As previously indicated, damper 294 adjusts the size of secondary air openings 296 which, in the specific case shown, comprise twelve 2-inch diameter holes.

Figure 28:
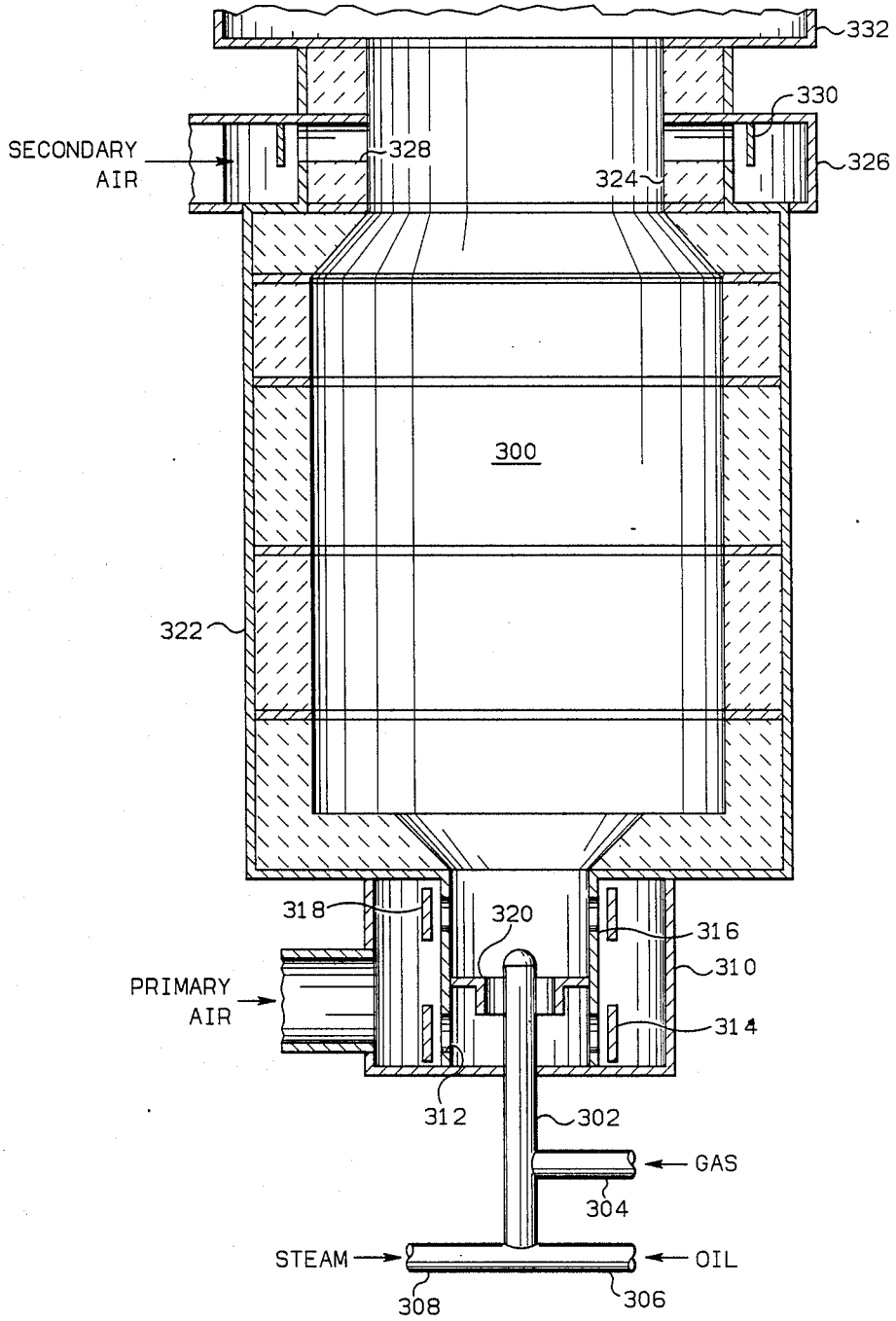

Yet another embodiment, designed as a prototype of a process burner having a 10 million BTU output, is illustrated in FIG. 28. The configuration of the primary air and fuel mixing mechanism is of the general character shown in detail in FIG. 15 of the drawings, while the means for abruptly terminating the primary combustion region and initiating the secondary combustion region or going from the fuel rich combustion region to the fuel lean combustion region is specifically the type shown in the previous example and described with respect to FIG. 17 of the drawings. Specifically, the burner 300 is provided with a fuel nozzle 302 having an ignition gas inlet 304, a fuel oil inlet 306 and a steam inlet 308. This nozzle extends into a primary air plenum 310. In this particular embodiment a first portion of primary air is introduced through air slots 312, which are controlled in size by damper 314, and a second portion of the primary air is introduced through air slots 316, controlled by damper 318. As is obvious from the illustration of FIG. 28 the air introduced through air slots 312 is introduced in an initial radial direction but becomes a portion of the axial flow component by passing through reduced diameter throat 320 surrounding the downstream end of nozzle 302. The air introduced through air slots 316 then intercepts and mixes with the axial flow component by passage radially through slots 316. The air-fuel mixture then expands into the primary combustion region 322, initially gradually and then abruptly. The initial gradual configuration is simply designed to produce a smooth transition from the mixing region to the burner proper and is generally dictated by the thickness of the walls of the burner, the design being, of course, adapted to prevent formation of carbon, etc. in this transition zone. However, as in the previous embodiments, the expansion into the large diameter primary combustion zone also aids in the mixing of the fuel and air. The flame front which is generally seated adjacent the entry to the primary combustion zone then passes through the primary combustion zone, is gradually reduced in diameter and passes through reduced diameter orifice 324. All of the secondary air is introduced into secondary air plenum 326 and thence through radial air inlets 328, which are controlled by damper 330. Finally, the flame front, mixed with sufficient secondary air to provide a lean overall fuel-air mixture, is abruptly expanded into the furnace proper 332. The embodiments of FIGS. 27 and 28, referred to as combustors L and M, respectively, were successfully tested for the burning of shale oil, as will be hereinafter illustrated by the examples.

Figure 29:
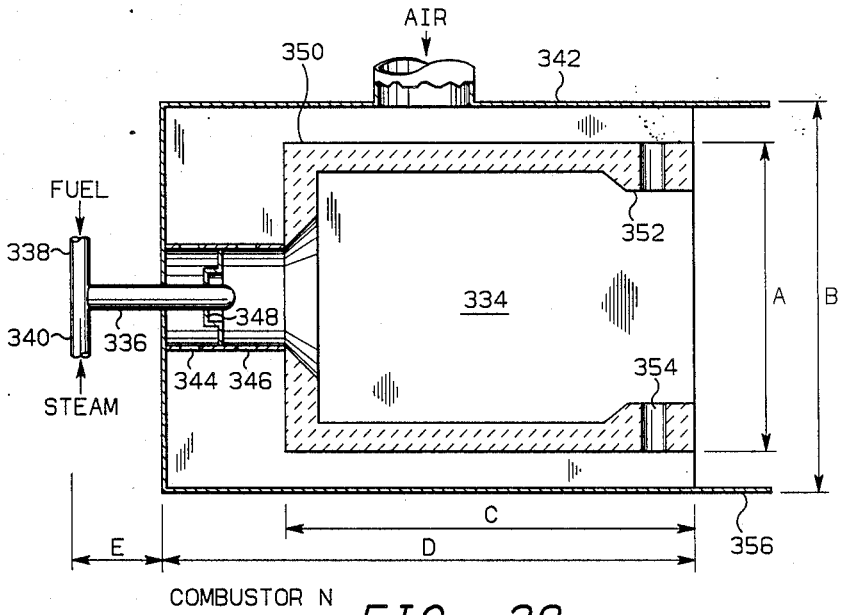

FIG. 29 illustrates a schematic arrangement of the burner of FIG. 28 adapted for commercial use with relative dimensions referred to thereon. Specifically, burner 334 is provided with a fuel nozzle 336, supplied with fuel through line 338 and steam through line 340. All of the primary and secondary air is supplied to common air plenum 342. In contrast to the embodiment of FIG. 28, burner N of FIG. 29 does not have dampers controlling the volume of primary and/or secondary air introduced into the burner. This would be the usual, most simplified version of the burner for use in industrial operations. Specifically, the relative volumes of primary and secondary air would be controlled by properly selecting the size of openings through which the various streams of air are introduced into the furnace, thus one would control only the volume of air to the air plenum so as to produce an overall fuel/air ratio of a predetermined amount, in most cases 3 percent excess air or a fuel/air equivalence ratio of 0.87. Primary air is introduced through air inlets 344 and 346, respectively. The air through inlets 344 becomes a part of the axial flow component by flow through orifice 348 around fuel nozzle 336. The primary air introduced through inlets 346 is the sole radial flow component in this particular configuration. The mixture of air and fuel is then expanded into the primary combustion region 350, as in the previous embodiment, and the flame front is then gradually reduced in diameter to the diameter of orifice 352. Secondary air is then introduced through air inlets 354 into the reduced diameter flame front and, finally, the mixture is expanded abruptly into the furnace proper or heated section of an industrial facility 356.

The following table illustrates the relative dimensions of burners of the character illustrated in FIG. 29, designed for heat outputs from 10 million to 100 million BTU, respectively.

TABLE

| Burner Size MM BTU/Hr. | A Fire Box O.D., in | B Wind Box Dia., in. | C Fire Box Length, in. | D Wind Box Length, in. | E Fuel Gun Extension, in. |
|---|---|---|---|---|---|
| 10 | 37 | 44 | 56 | 66 | 19 |
| 15 | 42 | 50 | 62 | 74 | 19 |
| 18 | 44 | 53 | 66 | 78 | 19 |
| 25 | 48 | 58 | 73 | 85 | 19 |
| 40 | 54 | 64 | 83 | 99 | 19 |
| 60 | 60 | 72 | 95 | 113 | 22 |
| 80 | 66 | 78 | 105 | 125 | 24 |
| 100 | 70 | 82 | 113 | 135 | 24 |

The burner schematically shown in FIG. 29 is shown in a horizontal position as opposed to the vertical position shown in FIGS. 25 through 28. Thus, it is obvious that the burners may be mounted on a furnace or the like in either direction without, in any way, affecting the operation thereof. In addition, the burner of FIG. 29 is a forced draft configuration with an integral windbox and is operable on either a gaseous or a liquid fuel. Thus, an extremely simple yet highly effective burner, for use on a wide variety of fuels, is provided herein which has the capability of reducing $NO_x$ pollutants below EPA standards irrespective of the type of fuel or the amounts of fuel bound nitrogen.

Figure 30:
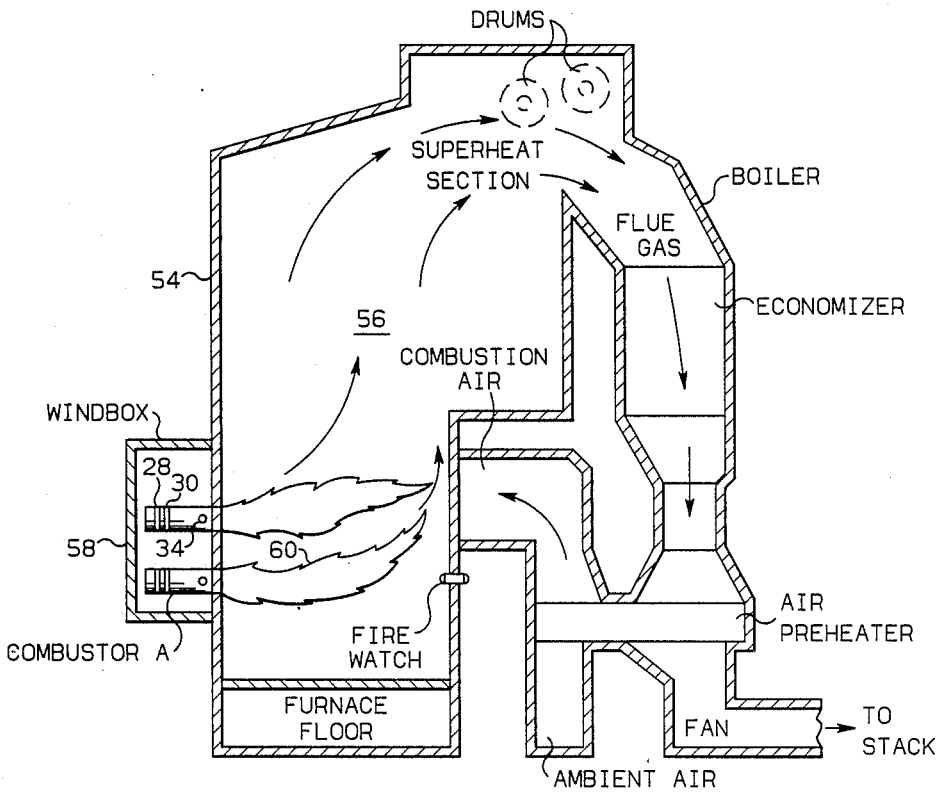
FIG. 30 is a diagrammatic view in elevation illustrating a combustor(s) of the invention installed in the wall of a power plant boiler and employed in combination with said boiler.

Referring to FIG. 30, there is illustrated a combustor of the invention employed in combination with a furnace such as the furnace of a boiler. Any of the combustors of the invention can be so employed. Said combustor can be employed with any type furnace comprising a shell 54 which encloses a heated region 56. In the practice of this combination of the invention, the flame tube of at least one said combustor would be mounted on said shell 54 so as to discharge into said heated region 56. Said combustors can be mounted on said shell in any suitable manner. Preferably, said combustor will be mounted with a shortened secondary combustion section on the outside of said shell in windbox or plenum chamber 58, as indicated in FIG. 30, for supply of the primary air inlets 28 and/or 30, and secondary air inlet 34. If desired, said combustor can be provided with a variable dome as described above for the admission of a variable, peripheral stream of primary air into the mixing region. If desired said variable dome can also be supplied with air from windbox 58, or can be supplied from a separate source of air.

By so mounting the combustor with a shortened secondary combustion section outside shell 54, and with the combustor discharging combustion products 60 into the heated region 56, said heated region becomes the downstream portion of the secondary combustion region. There is thus provided a unitary combustion zone in which the above-described methods of the invention can be carried out under the operating conditions described herein.

Figure 31:
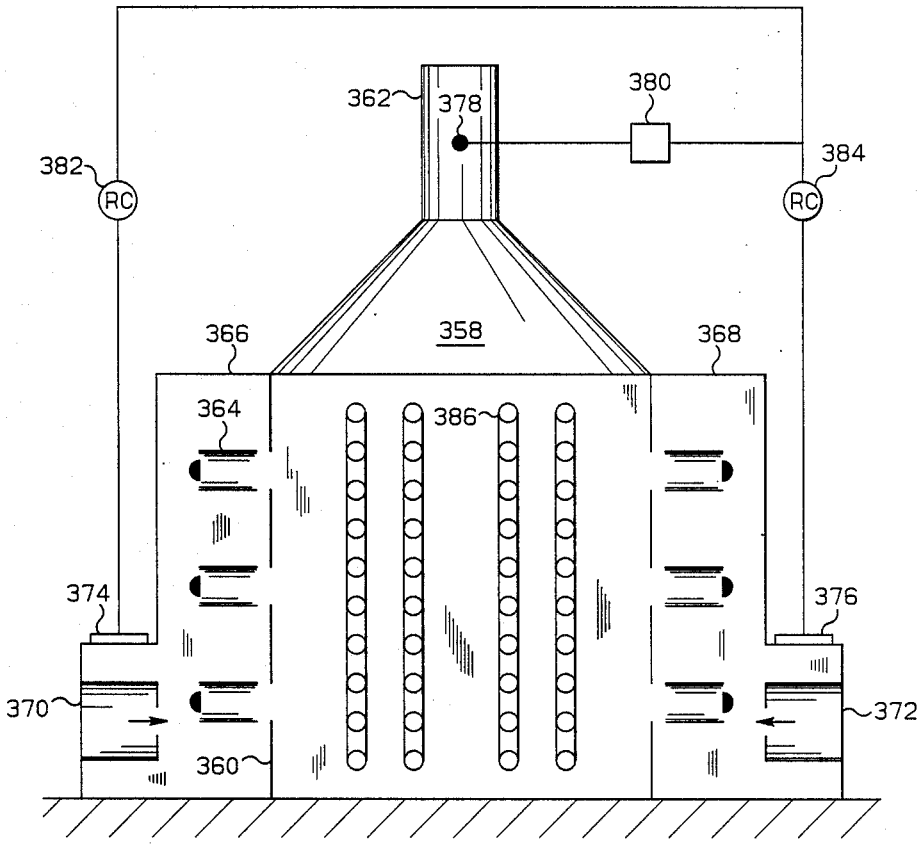
FIGS. 31 and 32 are elevational and top cross-sectional schematic views of a process heater utilizing burners of the character shown in FIGS. 25–29.
Figure 32:
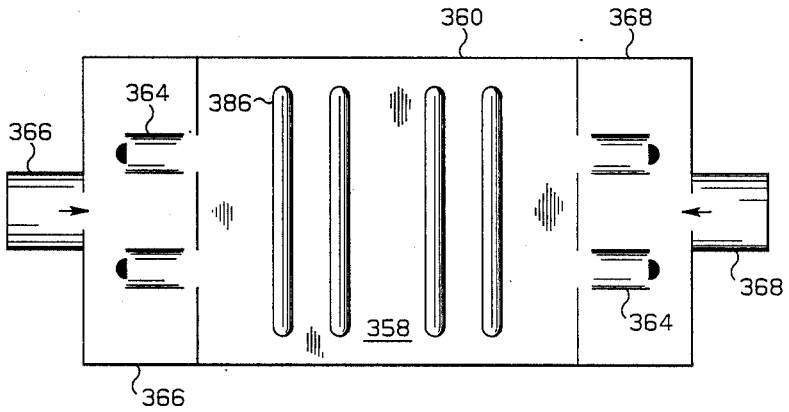

FIGS. 31 and 32 of the drawings illustrate schematically an arrangement for utilizing a plurality of burners in accordance with the present invention in an industrial process heater. Specifically, the illustrated arrangement could be utilized as a crude oil heater for a crude oil cracking unit in a refinery. In accordance with FIGS. 31 and 32, the process heater or furnace is designated generally as 358. The furnace 358 comprises a primary heated section 360 which discharges flue gases through stack 362. Discharging into the heated section of the furnace 360 are a plurality of burners of the character illustrated in FIGS. 25 through 29, respectively, in this case comprising 12 such burners 364. As in the previous embodiments described, the burners are each provided with primary and secondary air and fuel and discharge into the main heating section of the furnace 360 which becomes the downstream portion of the secondary combustion region of the burners. Both primary and secondary air is provided to the burners through common air plenums 366 and 368, respectively. Air is supplied to plenums 366 and 368 by appropriate blowers 370 and 372, respectively. Air to blowers 370 and 372 is drawn in from the atmosphere by appropriate means controlled by dampers 374 and 376, respectively. The dampers are in turn controlled by continuously or intermittently sampling the exhaust gas through stack 362 by means of sampling means 378, passing the sample through oxygen analyzer 380 and utilizing the signal from analyzer 380 for the control of dampers 374 and 376 through recorder-controllers 382 and 384. In the particular instance shown, the crude oil to the crude oil cracking unit passes through heat exchange tubes 386 mounted in heated section 360 of the furnace or heater. In a typical operation of such a unit, the size of the primary and secondary air inlets can be predesigned to obtain the desired split between the volume of primary and secondary air as in FIG. 29, or the primary and secondary air inlets can be provided with appropriate dampers. In the latter case the dampers in the primary and secondary air inlets would be adjusted to obtain the desired split of the total air flow to the burners. The fuel flow would be established for the level of heat release desired from the burner. Then the total air flow would be adjusted to reach a level of, for example, 3 percent excess air in the exhaust gas. While 3 percent is typical, more or less can be tolerated with the lower limit established by exhaust smoke or excessive carbon monoxide emissions and the higher levels carrying with them a heat loss to the excess air flowing through the furnace.

Another type of installation would be to place an individual air plenum around all of the burners, doing away with the separate air lines to the primary and secondary air inlets or the two individual plenums. With more than one burner, the individual plenums would be manifolded to the central air blower, or blowers, with dampers to control the air split between burners and assure a balance in the quantity of air flow to each burner. While air flow to the individual burners could be judged by utilizing the pressure drop across the dampers and pressure in the plenum chambers, primary control of the furnace would still rest upon analysis of the exhaust gas to maintain a desired level of excess oxygen, usually 3 percent as indicated. The design illustrated in FIGS. 30 and 31 shows two major banks of burners firing across the heat exchange tubes. Separate blowers would supply air to each plenum as indicated to balance air flows. However, this could be done using one larger blower with the air flow split by dampers. While not shown, heat exchangers may be utilized to preheat the inlet air using the exhaust gas from the heater stack. Primary and secondary air flows will be split by selective sizing of the openings to the burners and fuel flow would be adjusted using fuel pressure to balance flows in the different burners. As before, the overall control of the stoichiometry in the furnace will be ultimately by maintaining the oxygen level in the exhaust gas at a fixed level, for example, about 3 percent.

Figure 33:
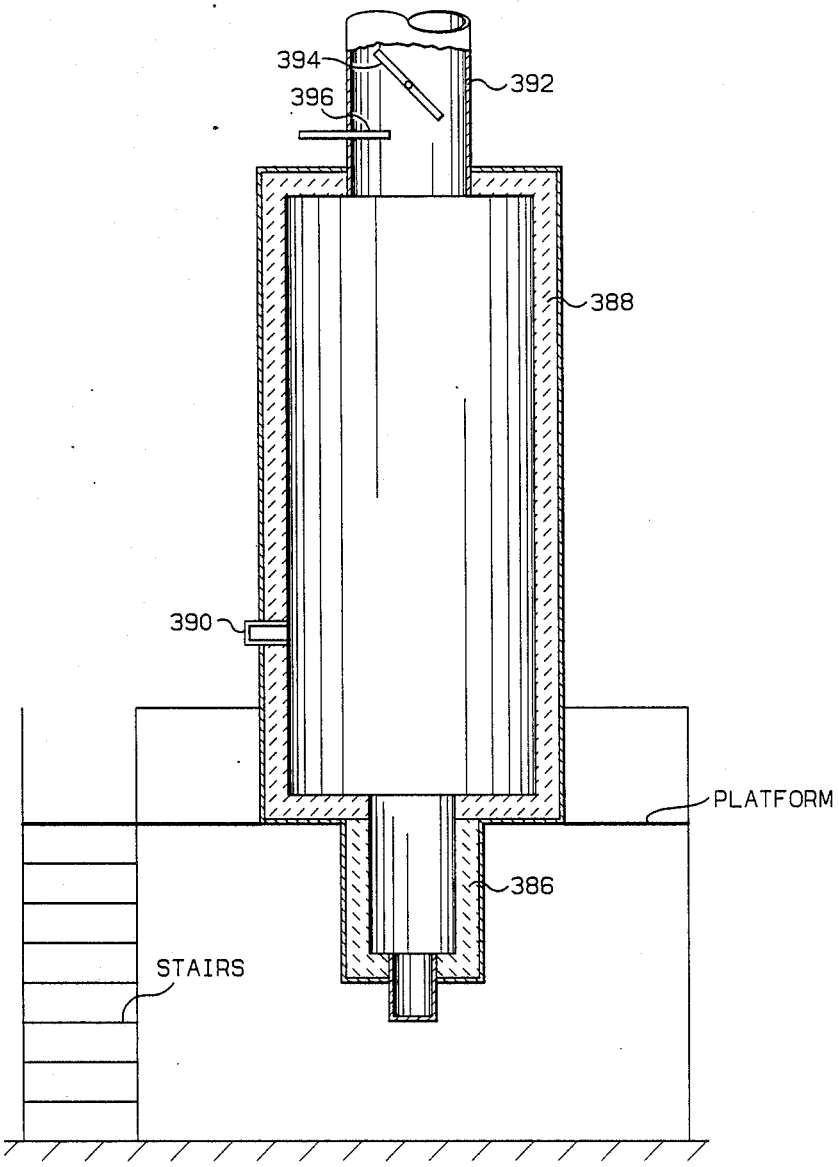
FIG. 33 is a cross-sectional schematic view of a test furnace incorporating a burner as illustrated in FIGS. 27 and 28.

FIG. 33 of the drawings shows, schematically, a test furnace arrangement utilized to test the 10 million BTU burners illustrated in FIGS. 27 and 28. In accordance with FIG. 33, the burner 386 fires vertically into the furnace proper 388. Thus, the furnace 388 becomes the downstream portion of the secondary combustion region. The furnace has a 6-inch internal liner of fire brick with an outer steel shell. The burner was provided with a window 390 designed to observe the character of the flame in the furnace. The furnace had an internal diameter of about 6 feet and a total length of about 16 feet. The furnace discharged into an exhaust stack 392, provided with an appropriate damper 394. Probes for gas samples, temperature and pressure measurements extended into the stack at point 396.

Figure 34:
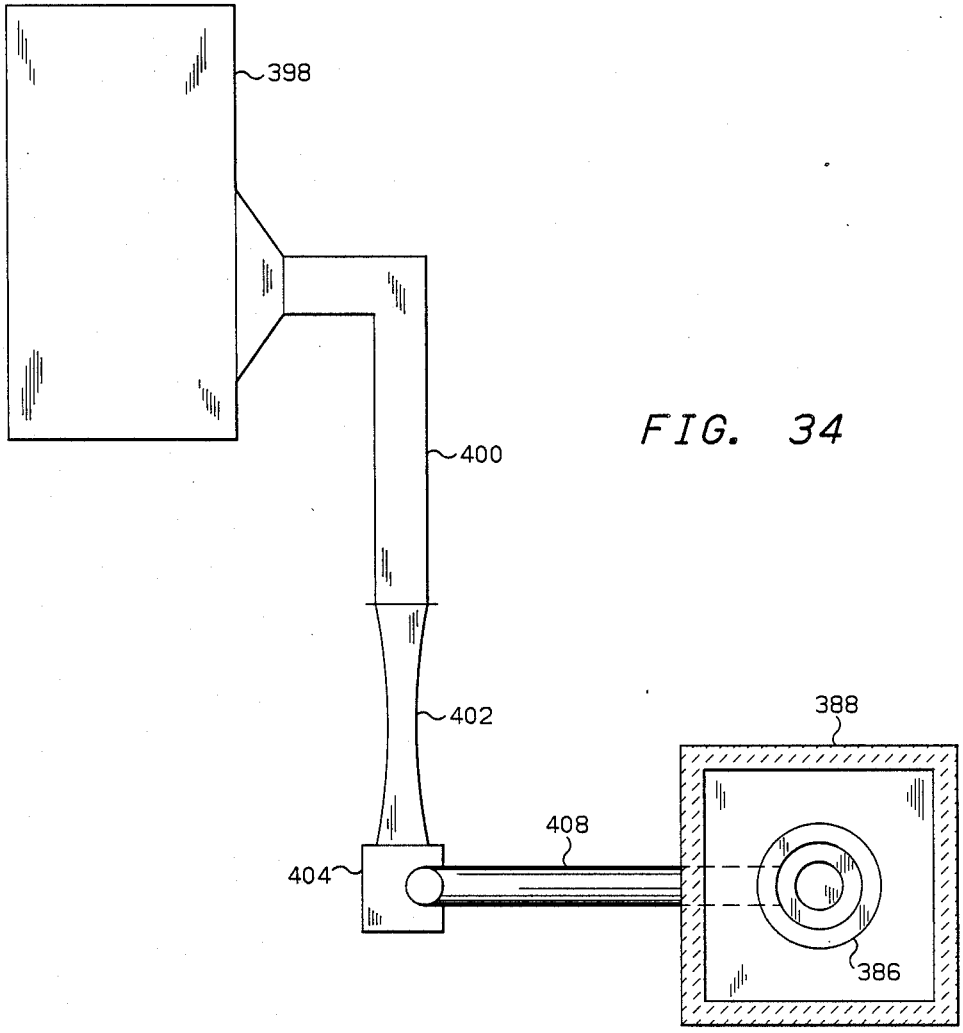
FIGS. 34 and 35 are schematic plan and elevational views, respectively, partially in section, of the air supply system utilized for the test furnace of FIG. 33.
Figure 35:
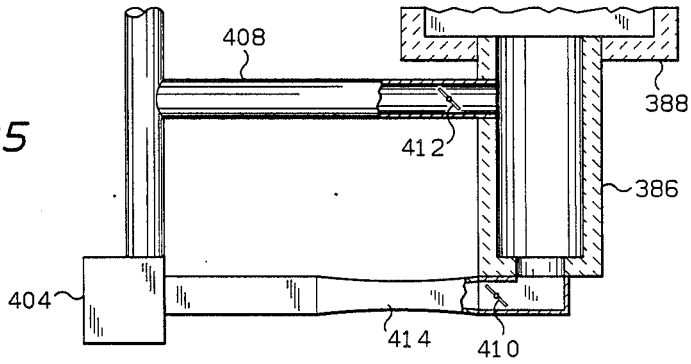

FIGS. 34 and 35 show, schematically, air supply systems for the furnace of FIG. 33. All air was supplied from an air blower and preheater 398 through conduit 400. Conduit 400 was provided with a 16-inch Venturi 402 and terminated in an air header 404. From air header 404 the air was split between a primary air conduit 406 and a secondary air conduit 408. Primary and secondary air conduits 406 and 408 were provided with appropriate control dampers 410 and 412, respectively. In addition, primary air supply line 406 was provided with an 8-inch diameter Venturi 414.

Figure 36:
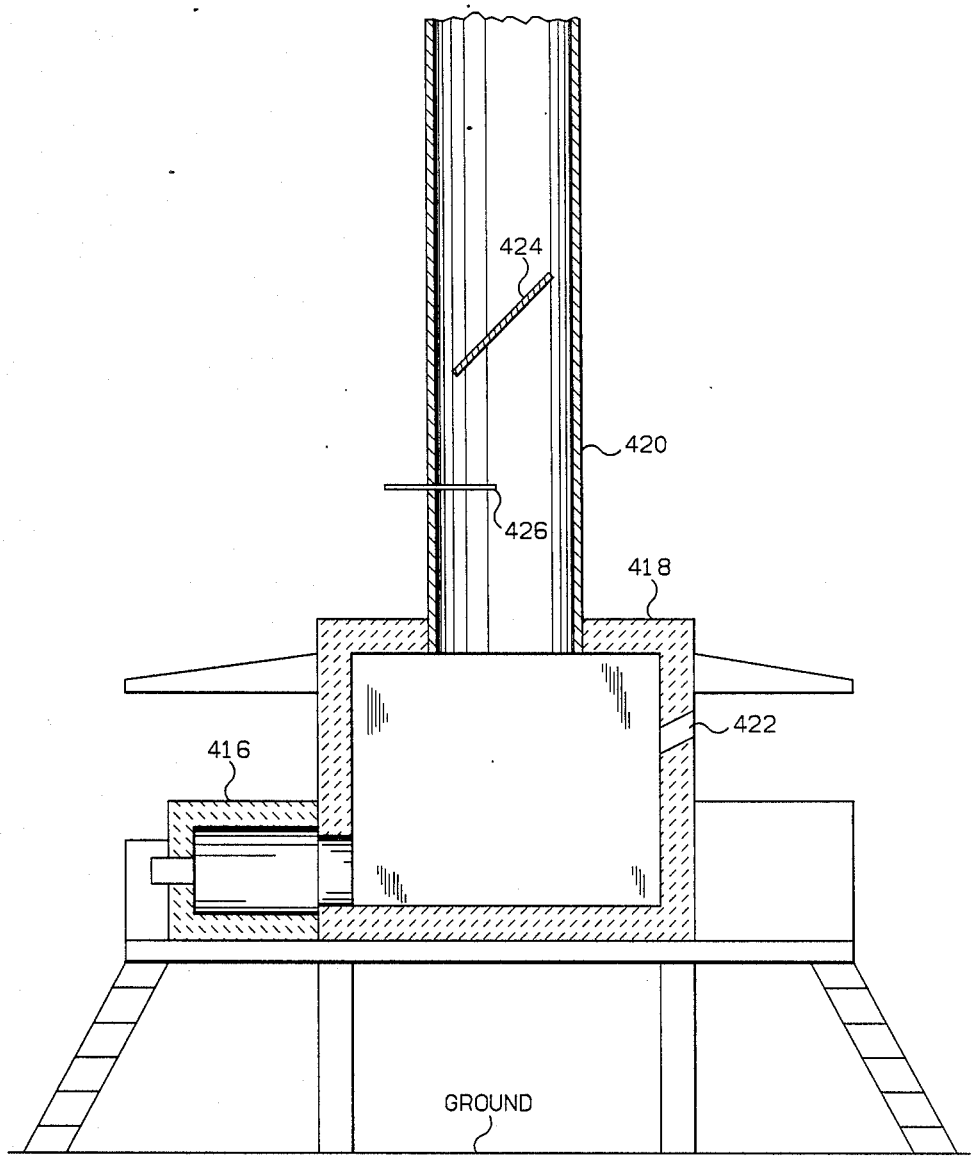
FIG. 36 is a cross-sectional, schematic view of a test furnace incorporating a burner as illustrated in FIGS. 27 and 28.

The schematic of FIG. 36 shows the installation of the test burners of FIGS. 27 and 28 to fire horizontally into another test furnace arrangement. In this particular instance, the burner 416 was designed to fire horizontally into the furnace so as to provide better access to the controls of the burner, etc. The furnace also differed from that of FIG. 33 to the extent that the furnace of FIG. 33 was what could be termed a "hot wall" furnace in that the furnace shell tended to maintain the temperatures within the furnace and to a great extent have exhaust gases exiting the furnace at higher than desired temperatures, thus reconverting some of the thermal nitrogen into thermal $NO_x$. By contrast, furnace 418 is referred to as a "cold wall" furnace, to the extent that it is provided a steel shell with a water wall for cooling. Furnace 418 discharges exhaust gases through stack 420. The furnace was provided with an observation window 322. The wall thickness of the furnace was approximately 9 inches and the diameter of the furnace about 12 feet. Stack 420 was 4 feet in diameter and was provided with an appropriate damper 424 and samples of the gas and the temperature and pressure of the exhaust gas were taken at point 426 in the stack.

Figure 37:
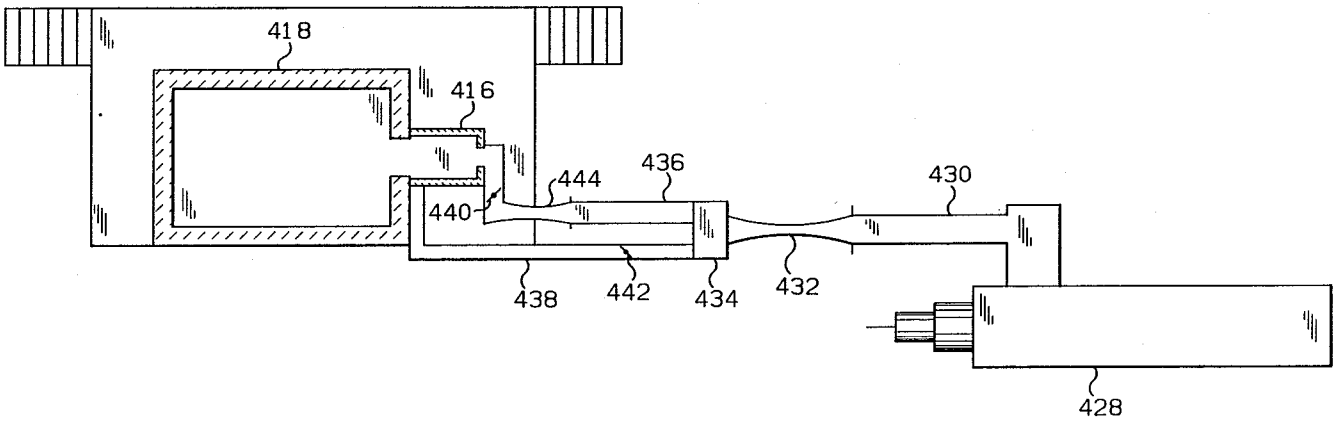
FIG. 37 is a schematic plan view, partially in section, of the air supply system for the test furnace of FIG. 36.

FIG. 37 illustrates schematically the air supply system for the furnace of FIG. 36. In FIG. 37, air was supplied for both primary and secondary air to the burner by air blower and preheater 428. This air was discharged through a main air conduit 430, provided with a 16-inch Venturi 432 and terminated in an air header 434. The air from air header 434 was then split into a primary air conduit 436 and a secondary air conduit 438. The primary air conduit is provided with a primary air damper 440 and secondary air conduit was provided with an air damper 442. The primary air conduit 436 is also provided with an 8-inch Venturi 444.

In any of the above-described methods of operation, the relative volumes of the various streams of air can be controlled by varying the sizes of the inlet openings therefor, relative to each other. The above-described variable domes can be employed for controlling the axially or radially introduced air. Flow meters or calibrated orifices can be employed in the conduits supplying the other streams, if desired.

As to general operating conditions, it is within the scope of the invention to operate the combustors or combustion zones employed in the practice of the invention under any conditions which will give the improved results of the invention. For example, it is within the scope of the invention to operate said combustors or combustion zones at suitable inlet air temperatures of up to about 1500° F., or higher; at pressures within the range of from about 1 to about 40 atmospheres, or higher; at flow velocities within the range of from about 1 to about 500 feet per second, or higher; and at heat input rates within the range of from about 30 to about 1200 Btu per pound of air. Generally speaking, the upper limit of the temperature of the air streams will be determined by the means employed to heat same, e.g., the capacity of the regenerator or other heating means, and materials of construction in the combustor or combustion zone, and/or the turbine utilizing the hot gases from the combustor. For a furnace type installation, preheating should be limited to 600° to 300° F. Generally speaking, operating conditions in the combustors of the invention will depend upon where the combustor is employed. For example, when the combustor is employed with a high pressure turbine, higher pressures and higher inlet air temperatures will be employed in the combustor. Thus, the invention is not limited to any particular operating conditions. As a further guide to those skilled in the art, but not to be considered as limiting on the invention, presently preferred operating ranges for other variables or parameters are: heat input, from 30 to 500 Btu/lb. of total air to the combustor; combustor pressure, from 3 to 10 atmospheres; and reference air velocity, from 50 to 250 feet per second.

The following examples will serve to further illustrate the invention.

EXAMPLE I

A test program was carried out to investigate the effect of the equivalence ratio $\phi$ in the primary combustion region on the conversion of fuel-nitrogen to $NO_x$ emissions. Said test program was carried out employing Combustor A, a combustor in accordance with the invention. Said Combustor A had a configuration essentially like that illustrated in FIG. 1, and its design characteristics are set forth in the schematic representation thereof set forth in FIG. 9. Said test program comprised operating the combustor over a program comprising the 10 different sets of test or operating conditions set forth in Table I below.

As set forth above, said Combustor A was provided with a variable dome whereby the amount of air (axial air) introduced through said dome into the mixing region and then into the primary combustion region could be varied. As shown in a subsequent example herein, the amount of the swirl air (introduced via the tangential openings), relative to the amount of said axial air, introduced into the mixing region and then into the primary combustion region, has an effect on the conversion of fuel-nitrogen to $NO_x$. Thus, in each of said 10 sets of operating conditions set forth in Table I, the amount of swirl air is the optimum amount for obtaining minimum conversion of fuel-nitrogen to $NO_x$. Said optimum amount was determined by carrying out a series of test runs, at each of said 10 test conditions, wherein the amount of axial air was varied by rotating the dome in five degree increments over its entire range (0 to 45 degrees), i.e., from fully closed to fully open.

In said runs a first stream of tangential air was introduced through tangential slots 28, a second stream of tangential air was introduced through tangential slots 30, a third stream of air (axial-when admitted) was introduced through the openings in the dome 17, and a stream of fuel was introduced via fuel nozzle 24, with all of said streams being introduced into the mixing region 11 located in the upstream end portion of the combustor. A stream of secondary air was introduced via ports 34, and a stream of dilution or quench air was introduced via ports 40. The total amounts of said streams of air and fuel are set forth in said Table I. Flow velocity in the primary combustion region was held constant at 50 feet per second so as to maintain the residence time therein constant at 60 milliseconds. The equivalence ratio $\phi$ in the secondary combustion region was held constant at 0.87 so as to achieve three percent excess oxygen (dry basis) in the exhaust gases. Test conditions 9 and 10 were included in the program so as to extend the range of the primary combustion region equivalence ratio $\phi$ to 0.87 in order to simulate the operation of a single-stage combustor.

The test program included two groups of runs I and II carried out under the same conditions as described above. In the Group I runs a base fuel, Philjet A-50 (a kerosine), was used. Said base fuel contained zero percent fuel-nitrogen. In the Group II runs the fuel used was a synthetic fuel consisting of said base fuel to which there had been added sufficient pyridine to result in said base fuel containing 2.000 weight percent of fuel-nitrogen.

During each of said runs the exhaust gas from the combustor was analyzed under specifically controlled conditions to determine the concentration of $NO_x$, CO, and unburned hydrocarbon (HC). Since the base fuel contained no fuel-nitrogen, the $NO_x$ values from the Group I runs were due to thermal $NO_x$ and said Group I runs established a base for thermal $NO_x$ produced at each test condition. Then, since the Group II runs were carried out at the same test conditions, the $NO_x$ values therefrom established the total $NO_x$ produced at each said test condition. The theoretical amount of $NO_x$ which would have been produced from the fuel-nitrogen in the synthetic fuel used in said Group II runs, if all of said nitrogen had been converted to $NO_x$, was calculated to establish the theoretical $NO_x$ (t $NO_x$). Subtraction of the $NO_x$ values in the Group I runs from the $NO_x$ values in the corresponding Group II runs established the increment of $NO_x$ (i $NO_x$) produced from the fuel-nitrogen at each test condition. Then, $iNO_x/NO_x \times 100 =$ percent conversion of fuel-nitrogen to $NO_x$ at each test condition.

FIGS. 38, 39, 40 and 41 of the drawings set forth the results of said runs. Referring to said FIG. 38, the results there set forth show that when it is desired to maintain the conversion of fuel-nitrogen to $NO_x$ emissions at 10 percent or less, the equivalence ratio in the primary combustion region should be maintained within the range of from about 1.04 to about 1.6; and within the range of from about 1.14 to about 1.51 when it is desired to maintain said conversion at less than 7.5 percent. It will be noted that the minimum conversion of about 6 percent was obtained over the range of 1.3 to 1.4 equivalence ratio, and that above 1.4 the percent conversion increased rapidly. Referring to FIG. 39, the curve for the Group II runs (2.0 weight percent nitrogen in the fuel) shows that over the equivalence ratio range of about 1.24 to about 1.44 the total $NO_x$ produced was less than the Calif. maximum of 225 parts per million by volume. FIG. 40 shows the level of unburned hydrocarbons, or HC emissions, in the flue gas and FIG. 41 the level of CO emissions in the flue gas.

Figure 9:
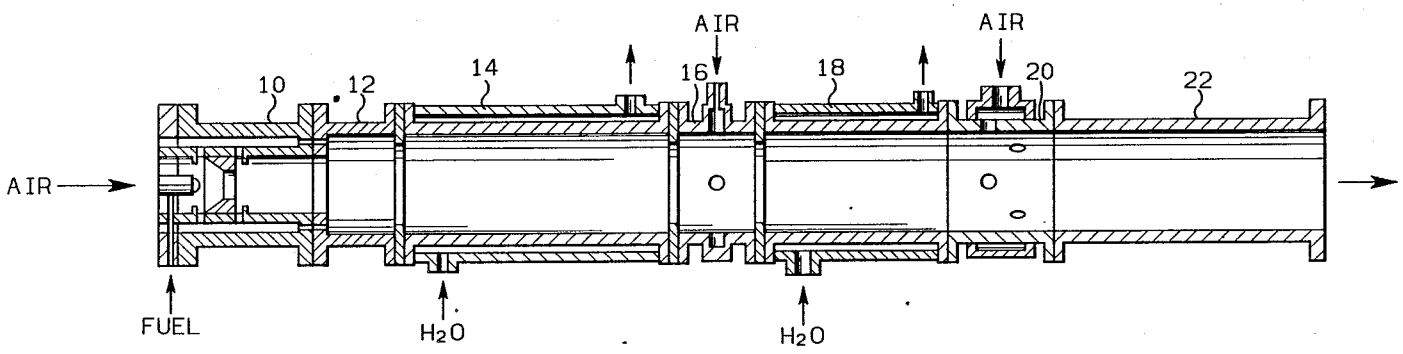
FIG. 9 is a schematic representation of the combustor of FIG. 1 and sets forth certain design characteristics of said combustor.

FIG. 9) was increased from 12 inches to 30 inches to provide a secondary combustion region having a length of 36 inches instead of 18 inches. Said increase in the length of the primary combustion region increased the residence time therein from 60 to 70 milliseconds. Said increase in the length of the secondary combustion section increased the residence time therein from 18 to 36 milliseconds. All other operating conditions were the same as in the runs of Example I. See Table I.

FIGS. 42, 43, 44, 45, 46 and 47 of the drawings set forth the results obtained. FIGS. 14 and 15 are representative of the results obtained when the combustor was operated at a given test condition and the amount of axial air was varied to determine the optimum amount of swirl air to use for obtaining minimum conversion of fuel-nitrogen to $NO_x$ emissions at said test condition (Test Condition No. 5 in Table I). The results set forth in FIG. 44 show that when it is desired to maintain the conversion of fuel-nitrogen to $NO_x$ emissions at 10 percent or less, the equivalence ratio in the primary combustion region should be maintained within the range of from about 1.08 to about 1.65; and within the range of from about 1.18 to about 1.56 when it is desired to maintain said conversion at less than 7.5 percent. It will be noted that the minimum conversion of about 5.7 percent was obtained over the range of 1.34 to 1.42 equivalence ratio, and that above 1.42 the percent conversion increased rapidly. Referring to FIG. 45, the curve for the Group II runs (2.0 weight percent nitrogen in the fuel) shows that over the equivalence ratio range of about 1.28 to about 1.51 the total $NO_x$ produced was less than the California maximum of 225 parts per million by volume. FIG. 47 shows that the increased residence time in the secondary combustion region was very effective in reducing the CO emissions and, together with FIGS. 44 and 45, that this was done without any detrimental effect on the $NO_x$ emissions.

TABLE I

OPERATING CONDITIONS FOR COMBUSTION OF HIGH-NITROGEN FUELS

| | | | | PRIMARY REGION | | | | SECONDARY REGION | | | | DILUTION REGION | | | |
|---|---|---|---|---|---|---|---|---|---|---|---|---|---|---|---|
| Test Condition | Comb. Oper. Pressure in. Hg Abs. | Inlet Air Temp. °F. | Fuel lb/hr | ø | Total Air lb/sec | Temp. °F. | Flow Velocity ft/sec | ø | Total Air lb/sec | Temp. °F. | Flow Velocity ft/sec | ø | Total Air lb/sec | Temp. °F. | Flow Velocity ft/sec |
| 1 | 32 | 650 | 52.4 | 1.80 | 0.120 | 3100 | 50 | 0.87 | 0.126 | 3690 | 120 | 0.30 | 0.472 | 1950 | 203 |
| 2 | 32 | 650 | 47.7 | 1.70 | 0.115 | 3230 | 50 | 0.87 | 0.109 | 3690 | 109 | 0.30 | 0.430 | 1950 | 185 |
| 3 | 32 | 650 | 43.5 | 1.60 | 0.112 | 3350 | 50 | 0.87 | 0.093 | 3690 | 100 | 0.30 | 0.392 | 1950 | 169 |
| 4 | 32 | 650 | 39.3 | 1.50 | 0.108 | 3500 | 50 | 0.87 | 0.077 | 3690 | 90 | 0.30 | 0.354 | 1950 | 152 |
| 5 | 32 | 650 | 36.3 | 1.40 | 0.107 | 3640 | 50 | 0.87 | 0.064 | 3690 | 83 | 0.30 | 0.327 | 1950 | 141 |
| 6 | 32 | 650 | 32.0 | 1.30 | 0.101 | 3750 | 50 | 0.87 | 0.049 | 3690 | 73 | 0.30 | 0.288 | 1950 | 124 |
| 7 | 32 | 650 | 28.9 | 1.20 | 0.099 | 3850 | 50 | 0.87 | 0.037 | 3690 | 66 | 0.30 | 0.260 | 1950 | 112 |
| 8 | 32 | 650 | 26.2 | 1.10 | 0.098 | 3900 | 50 | 0.87 | 0.025 | 3690 | 60 | 0.30 | 0.235 | 1950 | 101 |
| 9 | 32 | 650 | 23.8 | 1.00 | 0.098 | 3900 | 50 | 0.70 | 0.042 | 3300 | 59 | 0.30 | 0.186 | 1950 | 92 |
| 10 | 32 | 650 | 21.9 | 0.87 | 0.103 | 3690 | 50 | 0.70 | 0.026 | 3300 | 54 | 0.30 | 0.171 | 1950 | 85 |

EXAMPLE II

Another test program was carried out to further investigate the effect of the equivalence ratio $\phi$ in the primary combustion region on the conversion of fuel-nitrogen to $NO_x$ emissions. This test program was carried out in essentially the same manner as that described above in Example I except that Combustor B, another combustor in accordance with the invention was employed. Said Combustor B was like Combustor A except that the length of spool 14 (see FIG. 9) was increased from 18 inches to 24 inches to provide a primary combustion region having a length of 42 inches instead of 36 inches; and the length of spool 18 (see

EXAMPLE III

In another series of runs carried out in Combustor A under conditions similar to those used in Example I above (see Table I above), and at an equivalence ratio of 1.4 in the primary combustion region, it was found that the CO emissions could be reduced to about 160 ppmv by using sufficient excess air in the secondary combustion region to achieve an equivalence ratio therein of 0.87. This was at 3 percent excess oxygen, dry basis, in the exhaust gases. Further increases in excess air reduced the CO emissions to about 100 ppmv at an equivalence ratio of about 0.75. Again, this reduction in CO emissions was accomplished without detrimental effect on the $NO_x$ emissions.

EXAMPLE IV

Another test program was carried out to further investigate the effect of the equivalence ratio $\phi$ in the primary combustion region on the conversion of fuel-nitrogen to $NO_x$ emissions, and to evaluate the performance of Combustor X when operated in a rich-lean combustion process in accordance with the invention. Said Combustor X had a configuration essentially like that illustrated in FIGS. 23 and 24. Said test program comprised operating the combustor over a program comprising the 13 different sets of test or operating conditions set forth in Table II below.

Said Combustor X, unlike Combustors A and B, was not provided with a variable dome. In carrying out said test runs a first stream of air was introduced via tangential openings 28' into the mixing region 11' located in the upstream end portion of the combustor. Said first stream of air was introduced in a swirling direction around an admixture of fuel and a second stream of air which was introduced via nozzle 24' into the upstream end of said mixing region in an axial direction with respect thereto. A stream of secondary air was introduced into the flame tube via finger ports 34'. The total amounts of said streams of air and fuel are set forth in said Table II below. Flow velocity in the primary combustion region was held constant at 25 feet per second so as to maintain the residence time therein constant at 47 milliseconds. The equivalent ratio ($\phi$) in the secondary combustion region was held constant at 0.5 so as to achieve three percent excess oxygen (dry basis) in the exhaust gases. In said Combustor X the amount of said first stream of air (swirl air) was fixed at 74 percent, and the amount of said second stream of air (axial air) was fixed at 26 percent.

1.1 percent when it is desired to maintain said conversion at 7.5 percent or less.

Based on the results obtained in the above Examples I, II, III and IV, the data shown in FIGS. 38, 43 and 48, and other results obtained in subsequent examples herein, it is concluded that in the combustion of fuels containing fuel-nitrogen, by two-stage combustion in a combustor having a primary combustion region and a secondary combustion region, the equivalence ratio in the primary combustion region should be maintained within the range of 1.05 to 1.7 when it is desired to maintain the conversion of fuel-nitrogen to $NO_x$ emissions 10 percent or less, and that said equivalence ratio should be maintained within the range of from 1.14 to 1.56 when it is desired to maintain said conversion at 7.5 percent or less.

EXAMPLE V

Another test program was carried out to investigate the effect of residence time in the primary combustion region on the conversion of fuel-nitrogen to $NO_x$ emissions. Said test program was carried out employing additional combustors in accordance with the invention, i.e., Combustors C, D, E, and F.

Said Combustor C was like Combustor A except that the length of spool 14 (see FIG. 9) was decreased from 18 inches to 12 inches to provide a primary combustion region having a length of 30 inches instead of 36 inches the length of spool 18 (see FIG. 9) was increased from 12 inches to 54 inches to provide a secondary combustion region having a length of 60 inches instead of 18 inches.

Said Combustor E was like Combustor A except that the length of spool 18 (see FIG. 9) was increased from 12 inches to 36 inches to provide a secondary combustion region having a length of 42 inches instead of 18 inches.

TABLE II

OPERATING CONDITIONS FOR COMBUSTION OF HIGH-NITROGEN FUELS

| | | | | PRIMARY REGION | | | | SECONDARY REGION | | | |
|---|---|---|---|---|---|---|---|---|---|---|---|
| Test Condition | Comb. Oper. Pressure in. Hg Abs. | Inlet Air Temp. °F. | Fuel lb/hr | ϕ | Total Air lb/sec | Temp. °F. | Flow Velocity ft/sec | ϕ | Total Air lb/sec | Temp. °F. | Flow Velocity ft/sec |
| 11 | 30 | 500 | 3.51 | 2.0 | 25.9 | 2750 | 25 | 0.5 | 77.8 | 2400 | 89 |
| 12 | 30 | 500 | 2.91 | 1.8 | 23.9 | 3020 | 25 | 0.5 | 62.2 | 2400 | 74 |
| 13 | 30 | 500 | 2.42 | 1.6 | 22.4 | 3260 | 25 | 0.5 | 49.3 | 2400 | 61 |
| 14 | 30 | 500 | 1.97 | 1.4 | 20.8 | 3540 | 25 | 0.5 | 37.5 | 2400 | 50 |
| 15 | 30 | 500 | 1.78 | 1.3 | 20.2 | 3660 | 25 | 0.5 | 32.3 | 2400 | 45 |
| 16 | 30 | 500 | 1.60 | 1.2 | 19.7 | 3760 | 25 | 0.5 | 27.6 | 2400 | 41 |
| 17 | 30 | 500 | 1.44 | 1.1 | 19.4 | 3830 | 25 | 0.5 | 23.3 | 2400 | 37 |
| 18 | 30 | 500 | 1.32 | 1.0 | 19.5 | 3810 | 25 | 0.5 | 19.5 | 2400 | 34 |
| 19 | 30 | 500 | 1.23 | 0.9 | 20.3 | 3650 | 25 | 0.5 | 16.2 | 2400 | 31 |
| 20 | 30 | 500 | 1.15 | 0.8 | 21.3 | 3450 | 25 | 0.5 | 12.8 | 2400 | 29 |
| 21 | 30 | 500 | 1.08 | 0.7 | 22.9 | 3180 | 25 | 0.5 | 9.2 | 2400 | 28 |
| 22 | 30 | 500 | 1.01 | 0.6 | 24.8 | 2900 | 25 | 0.5 | 5.0 | 2400 | 26 |
| 23 | 30 | 500 | 0.94 | 0.5 | 27.7 | 2550 | 25 | 0.5 | 0.0 | 2400 | 24 |

The test program included two groups of runs, Group I and Group II, carried out with the base fuel and synthetic fuel respectively, as described above in Example I, for determining the percent conversion of fuel-nitrogen to $NO_x$ emissions.

FIGS. 48, 49, 50 and 51 of the drawings set forth the results of said runs. Said FIG. 48 shows that when it is desired to maintain the conversion of fuel-nitrogen to $NO_x$ emissions at 10 percent or less, the equivalence ratio $\phi$ in the primary combustion region should be maintained in the range of from about 1.04 to about 1.12; and within the range of from about 1.07 to about Said Combustor F was like Combustor A except that the length of spool 14 (see FIG. 9) was increased from 18 inches to 42 inches to provide a primary combustion region having a length of 60 inches instead of 36 inches.

A first portion of said investigation of the effect of residence time comprised changing the length of the primary combustion region as indicated above. A second portion of said investigation comprised decreasing the flow velocity in the primary combustion region from 50 feet per second to 25 feet per second. In both of said portions of said investigation the test runs carried out included two groups of runs (Group I and Group II), carried out with the base fuel and synthetic fuel respectively, as described above in Example I, for determining the percent conversion of fuel-nitrogen to $NO_x$ emissions. The test runs wherein the flow velocity in the primary combustion region was maintained at 25 feet per second were carried out at the test conditions set forth in Table III below. In analyzing and compiling the data obtained, pertinent data from previous test runs carried out in Combustors A, B, and X were included. This compilation of data is set forth in Table IV-Part 1 and Table IV-Part 2, given below, which summarizes the operating conditions and results obtained.

TABLE III

OPERATING CONDITIONS FOR COMBUSTION OF HIGH-NITROGEN FUELS

| | | | | PRIMARY REGION | | | | SECONDARY REGION | | | | DILUTION REGION | | | |
|---|---|---|---|---|---|---|---|---|---|---|---|---|---|---|---|
| Test Condition | Comb. Oper. Pressure in. Hg Abs. | Inlet Air Temp. °F. | Fuel lb/hr | Ø | Total Air lb/sec | Temp. °F. | Flow Velocity ft/sec | Ø | Total Air lb/sec | Temp. °F. | Flow Velocity ft/sec | Ø | Total Air lb/sec | Temp. °F. | Flow Velocity ft/sec |
| 24 | 32 | 650 | 26.2 | 1.80 | 0.060 | 3100 | 25 | 0.87 | 0.063 | 3690 | 60 | 0.30 | 0.236 | 1950 | 102 |
| 25 | 32 | 650 | 23.9 | 1.70 | 0.058 | 3230 | 25 | 0.87 | 0.054 | 3690 | 55 | 0.30 | 0.215 | 1950 | 93 |
| 26 | 32 | 650 | 21.8 | 1.60 | 0.056 | 3350 | 25 | 0.87 | 0.046 | 3690 | 50 | 0.30 | 0.196 | 1950 | 84 |
| 27 | 32 | 650 | 19.6 | 1.50 | 0.054 | 3500 | 25 | 0.87 | 0.039 | 3690 | 45 | 0.30 | 0.177 | 1950 | 76 |
| 28 | 32 | 650 | 18.1 | 1.40 | 0.053 | 3640 | 25 | 0.87 | 0.032 | 3690 | 42 | 0.30 | 0.163 | 1950 | 70 |
| 29 | 32 | 650 | 16.0 | 1.30 | 0.051 | 3750 | 25 | 0.87 | 0.025 | 3690 | 37 | 0.30 | 0.144 | 1950 | 62 |
| 30 | 32 | 650 | 14.4 | 1.20 | 0.049 | 3850 | 25 | 0.87 | 0.018 | 3690 | 33 | 0.30 | 0.130 | 1950 | 56 |
| 31 | 32 | 650 | 13.1 | 1.10 | 0.049 | 3900 | 25 | 0.87 | 0.013 | 3690 | 30 | 0.30 | 0.118 | 1950 | 51 |
| 32 | 32 | 650 | 11.9 | 1.00 | 0.049 | 3900 | 25 | 0.70 | 0.021 | 3300 | 34 | 0.30 | 0.093 | 1950 | 46 |
| 33 | 32 | 650 | 10.9 | 0.87 | 0.051 | 3690 | 25 | 0.70 | 0.013 | 3300 | 31 | 0.30 | 0.086 | 1950 | 42 |

TABLE IV

PART I

OPERATING CONDITIONS FOR MINIMUM $NO_x$ EMISSIONS WITH HIGH-NITROGEN FUELS

| | Primary-Combustion Region | | | | | | Emissions, (3% Excess $O_2$, Dry) | | |
|---|---|---|---|---|---|---|---|---|---|
| Combustor Number | Length in | Flow Velocity, ft/sec | Residence Time, millisec | Fuel-Air Ø at Minimum Conversion of Fuel-N to $NO_x$ | Swirl Air at Minimum Conversion of Fuel-N to $NO_x$, % | Test-Fuel Nitrogen, wt % | $NO_x$ from Base-Fuel,* ppmv | $NO_x$ from Test-Fuel ppmv | Fuel-N Conversion to $NO_x$, % |
| E | 0 | 50 | 0 | 0.87 Set | 100 | 0.100 | 113 | 153 | 30.2 |
| | | | | | | 0.500 | | 292 | 27.0 |
| | | | | | | 1.000 | | 414 | 22.8 |
| | | | | | | 1.500 | | 552 | 22.2 |
| | | | | | | 2.000 | | 644 | 20.2 |
| A | | | | | | | 135 | 674 | 20.5 |
| B | | | | | | | 147 | 697 | 20.9 |
| C | | | | | | | 169 | 736 | 21.5 |
| D | | | | | | | 150 | 674 | 19.9 |
| F | | | | | | | 138 | 659 | 19.8 |
| D | | 25 | | | | | 233 | 766 | 20.3 |
| E | | | | | | | 221 | 736 | 19.6 |
| X | | | | | 74 Set | | 57 | 633 | 21.9 |

*Base-Fuel contained 0.0% nitrogen

TABLE IV

PART II

OPERATING CONDITIONS FOR MINIMUM $NO_x$ EMISSIONS WITH HIGH-NITROGEN FUELS

| | Primary-Combustion Region | | | | | | Emissions, (3% Excess $O_2$, Dry) | | |
|---|---|---|---|---|---|---|---|---|---|
| Combustor Number | Length in | Flow Velocity, ft/sec | Residence Time, millisec | Fuel-Air Ø at Minimum Conversion of Fuel-N to $NO_x$ | Swirl Air at Minimum Conversion of Fuel-N to $NO_x$, % | Test-Fuel Nitrogen, wt % | $NO_x$ from Base-Fuel,* ppmv | $NO_x$ from Test-Fuel ppmv | Fuel-N Conversion to $NO_x$, % |
| E | 36 | 50 | 60 | 1.4 | 37 | 0.100 | 67 | 101 | 25.6 |
| | | | | | | 0.500 | | 172 | 15.8 |
| | | | | | | 1.000 | | 202 | 10.3 |
| | | | | | | 1.500 | | 224 | 7.9 |
| | | | | | | 2.000 | | 224 | 5.9 |
| | 10 Probe | | 17 | | | | 42 | 374 | 12.6 |
| | 16 Probe | | 27 | | | | 44 | 289 | 9.3 |
| | 19 Probe | | 32 | | | | 41 | 254 | 8.1 |
| | 22 Probe | | 37 | | | | 43 | 250 | 7.9 |
| | 28 Probe | | 47 | | | | 40 | 234 | 7.4 |
| | 36 Probe | | 60 | | | | 39 | 194 | 5.9 |
| D | 18 | | 30 | 1.1 | 100 | | 89 | 314 | 8.6 |
| C | 30 | | 50 | 1.2 | 77 | | 55 | 242 | 7.1 |
| A | 36 | | 60 | 1.4 | 37 | | 53 | 205 | 5.8 |
| B | 42 | | 70 | 1.4 | 37 | | 54 | 202 | 5.7 |

TABLE IV-continued

PART II

OPERATING CONDITIONS FOR MINIMUM $NO_x$ EMISSIONS WITH HIGH-NITROGEN FUELS

| Primary-Combustion Region | | | | | | | Emissions, (3% Excess $O_2$, Dry) | | |
|---|---|---|---|---|---|---|---|---|---|
| Combustor Number | Length in | Flow Velocity, ft/sec | Residence Time, millisec | Fuel-Air ∅ at Minimum Conversion of Fuel-N to $NO_x$ | Swirl Air at Minimum Conversion of Fuel-N to $NO_x$, % | Test-Fuel Nitrogen, wt % | $NO_x$ from Base-Fuel,* ppmv | $NO_x$ from Test-Fuel ppmv | Fuel-N Conversion to $NO_x$, % |
| F | 60 | | 100 | 1.4 | 37 | | 46 | 169 | 4.7 |
| D | 18 | 25 | 60 | 1.5 | 100 | | 77 | 215 | 5.2 |
| E | 36 | | 120 | 1.7 | 100 | | 67 | 221 | 5.8 |
| X | 14 | | 47 | 1.1 | 74 Set | | 48 | 228 | 6.8 |

*Base-Fuel contained 0.0% nitrogen

The runs set forth in Part I of Table IV were carried out with an equivalence ratio $\phi$ of 0.87 in the "primary combustion region". With the fuels used, this gives 3 percent excess oxygen (dry basis) in the exhaust gases. Such an operation simulates a one-stage, fuel-lean, combustion process which is common to stationary power plants and thus serves as a base-line performance representative of the prior art. The fact that the conversion of fuel-nitrogen to $NO_x$ emissions was only 20 to 30 percent, depending upon the amount of organic or fuel-nitrogen in the fuel, reflects the superior fuel-air mixing characteristics of the combustors of the invention. Such superior mixing is essential for a "low-$NO_x$ combustor". The residence time in the "primary combustion region" has been designated as zero for data purposes because the combustors were operated as one-stage combustors in these runs and there is thus, in effect, no fuel-rich primary combustion region as such, as there is in a two-stage, rich-lean process.

The runs set forth in Part 2 of Table IV were carried out in accordance with the two-stage, rich-lean combustion method of the invention.

FIGS. 52, 53, 54 and 55 of the drawings set forth the results obtained. FIG. 52 sets forth the relationship between the Total Minimum $NO_x$ Emissions (at the optimum $\phi$ in the primary combustion region) and Primary Region Residence Time, and includes all pertinent such data set forth in Table IV-Parts 1 and 2, including the runs at both 25 and 50 feet per second flow velocities. FIG. 53 sets forth the relationship between Minimum Fuel-Nitrogen Conversion To $NO_x$ Emissions (at the optimum $\phi$ in the primary combustion region) and Primary Region Residence Time, and includes all pertinent such data set forth in Table IV-Parts 1 and 2, including the runs at both 25 and 50 feet per second flow velocities. FIG. 54 sets forth the relationship between the optimum Primary Region Equivalence Ratio For Minimum Fuel-Nitrogen Conversion to $NO_x$ emissions and Primary Region Residence Time, and includes all pertinent such data from Table IV-Parts 1 and 2.

FIG. 55 is a replot of the data in FIG. 53 to which there has been added the results of a careful sampling of $NO_x$ concentration by quartz probes inserted through the wall of Combustor E at the locations indicated in FIG. 56. During the run in which said probe tests were made said Combustor E was operated at test condition No. 5 in Table I above. It is considered noteworthy that the results obtained by probing the combustor are in complete agreement with the results obtained by varying the length of the primary combustion region and the results obtained by changing flow velocity in said primary region. Said probe results clearly illustrate the formation of $NO_x$ from fuel-nitrogen and its subsequent destruction in the fuel-rich primary combustion region.

EXAMPLE VI

This example sets forth a continuation of the test programs outlined above in Examples I, II, IV, and V, and completes and establishes the correlation between: (a) the equivalence ration ($\phi$) in the primary combustion region; (b) the residence time in said primary combustion region; and (c) the percent swirl air (of the total air) introduced into the mixing region and then into said primary combustion region of a combustor, having downstream tangential primary air introduction means, when said combustor is operated in accordance with the two-stage, rich-lean combustion method of this invention.

The results of the test runs of this example are illustrated in FIGS. 57 and 58 of the drawings. Said runs were carried out in the manner described in Example V above, and employing the combustors there described. Said FIGS. 57 and 58 were plotted from data set forth in the above Table IV-Part 2. Said FIG. 57 sets forth the relationship between residence time in the primary combustion region and the percent swirl air (of the total air) introduced into the mixing region and then into said primary combustion region, for minimum conversion of fuel-nitrogen to $NO_x$ emissions. FIG. 58 sets forth the relationship between the equivalence ratio in the primary combustion region and the percent swirl air (of the total air) introduced into the mixing region and then into said primary combustion region, for minimum conversion of fuel-nitrogen to $NO_x$ emissions. Referring to said FIGS. 57 and 58, it will be noted that in all instances the percent swirl air is always at least about 37 percent.

EXAMPLE VII

A test program was carried out to investigate the effect of the concentration of fuel-nitrogen in the previously described base fuel. Said test program was carried out employing the above-described Combustor E. Said test program comprised operating said combustor over a program comprising the 10 different sets of test or operating conditions set forth in Table I above. Two groups of runs, I and II, were carried out using a base fuel and a synthetic test fuel, respectively, as described in Example I above. FIGS. 59, 60 and 61 of the drawings set forth the results obtained. The data are summarized in Table IV-Parts 1 and 2, above.

Referring to FIG. 59, it will be noted that with all concentrations of fuel-nitrogen the minimum total $NO_x$ emissions was obtained at an equivalence ratio of about 1.4 in the primary combustion region.

FIG. 60 shows that, with the exception of the fuel containing only 0.1 percent fuel-nitrogen, the minimum conversion of fuel-nitrogen to $NO_x$ emissions was obtained at an equivalence ratio of about 1.4 in the primary combustion region.

FIG. 61 shows that the advantage of the two-stage, rich-lean, combustion process becomes greater as the concentration of fuel-nitrogen in the fuel increases. This is advantageous in that it is anticipated that many fuels in the future will typically contain in the order of 2.0 weight percent fuel-nitrogen, e.g., fuels from shale oil, liquefaction of coal, etc.

Referring to the above Table IV, Parts 1 and 2, it will be noted that the $NO_x$ emissions concentration in the exhaust gases when using the fuels of varying fuel-nitrogen content levels off at about 224 ppmv when using the two-stage, rich-lean combustion process. It is concluded that this indicates an equilibrium exists between the $NO_x$ formation and the $NO_x$ destruction reactions in the fuel-rich primary combustion region. No such level-off was evident in the one-stage, fuel-lean operation wherein the $NO_x$ emissions reached 644 ppmv when the test fuel contained 2.000 weight percent fuel nitrogen.

EXAMPLE VIII

A series of runs was carried out to investigate the effect of the orifice 46 located downstream from and adjacent the second air inlet means 30 and the effect of the orifice 48 located in the downstream end portion of the primary combustion section and adjacent the downstream end thereof, and also the effect of the orifice 50 located downstream from the secondary air inlet 34 and in the upstream end portion of the secondary combustion section. See FIG. 1.

The runs of this example were carried out in Combustor A (see FIG. 1) and substantially duplicate combustors in which orifices 46 and 48 were removed and in which orifices 46, 48 and 50 were removed. In said runs the combustors were compared at test condition 5 of Table I above, for the purposes of this example.

Based on a comparison at a $\phi$ of 1.4 in the primary combustion region and a $\phi$ of 0.87 in the secondary combustion region, the data indicate that removal of the orifices 46 and 48 from the primary combustion section of Combustor A increased the thermal $NO_x$ from about 50 to about 85 ppmv. It also decreased the fuel-$NO_x$ from about 160 to about 150 ppmv. The net result was that the total $NO_x$ emissions increased from about 210 to about 235 ppmv. Thus, based on said data it is presently preferred that the combustors utilized be provided with orifices such as said orifices 46 and 48. However, in view of the small effects involved, it is within the scope of the invention to omit said orifices.

Said data also indicated that when said orifice 50 in the secondary combustion section was also removed, there was a marked increase in the amount of CO emissions, e.g., from about 220 to about 860 ppmv at said 0.87 $\phi$ in the secondary combustion section. Thus, based on said data it is concluded that the combustors of the invention should be provided with a said orifice 50 when it is desired to abruptly terminate the primary combustion region and achieve adequate mixing in the secondary combustion section for control of CO emissions without resorting to excessive air dilution.

Based on the data given in all the above examples it is concluded that in practicing the method of the invention, using light fuels and the swirl air combustors, there is a definite relationship and/or correlation between: (a) the fuel-air equivalence ratio $\phi$ in the primary combustion region; (b) the residence time in said primary combustion region; and (c) the percent swirl air (of the total air) introduced into the mixing region and then into said primary combustion region of a combustion zone when said combustion zone is operated in a two-stage, rich-lean manner, e.g., with a fuel-rich primary combustion region and a fuel-lean secondary combustion region.

FIGS. 38 and 44 show that there is an optimum fuel-air equivalence ratio ($\phi$) for the primary combustion region which must be maintained in order to obtain minimum conversion of fuel-nitrogen to $NO_x$. FIGS. 38 and 45 show that the same is true with respect to total $NO_x$ emissions. Thus, if it is desired to hold the conversion of fuel-nitrogen below a given level, e.g., 10 percent, one must operate the fuel-rich primary combustion region within a relatively narrow range of $\phi$. One cannot just maintain the primary combustion region fuel-rich, as has been suggested by some of the prior art. Also, one cannot merely maintain the value of $\phi$ above a certain value, e.g., above about 1.43 as has been suggested by some of the prior art. This is true because, as shown in FIGS. 38 and 44, as $\phi$ increases above the optimum minimum value, the conversion of fuel-nitrogen to $NO_x$ emissions also increases. Thus, based on the data set forth in said FIGS. 38 and 44, it is concluded that if the fuel-rich primary combustion region is operated with too high a value for $\phi$, i.e., too rich, the partial combustion in said primary region is too incomplete and too much partially combusted fuel is carried over into the secondary combustion region where thermal $NO_x$ can form. Also, fuel-nitrogen will be carried over into the secondary combustion region where it will be converted to $NO_x$ emissions. Under these circumstances one is losing the advantage of a two-stage, fuel-rich, fuel-lean, process.

However, the data of the above examples show that one cannot merely consider only the value of $\phi$ in the primary combustion region. It was surprising to discover that one must also correlate the residence time in the primary combustion region with the $\phi$ in said primary region. The data herein show that the optimum $\phi$ in the primary combustion region for minimum conversion of fuel-nitrogen to $NO_x$ increases with increasing residence time in said primary combustion region. FIG. 54 herein shows that said optimum $\phi$ is only slightly fuel-rich ($\phi = 1.05$ to 1.1) at a residence time of 30 milliseconds and increases to very fuel-rich ($\phi = 1.7$) at a residence time of 120 milliseconds. Thus, based on the data herein, e.g., said FIGS. 38, 44, and 54, it is concluded that one must consider, and correlate, both the value of $\phi$ and the residence time in the primary combustion region in order to operate a two-stage, rich-lean combustion process so as to obtain reduced conversion of fuel-nitrogen to $NO_x$ emissions.

It is presently believed that said variables of $\phi$ and residence time in the primary combustion region are two of the most important variables in the operation of a two-stage, rich-lean combustion process, because when said variables are properly correlated one will obtain markedly reduced conversion of fuel-nitrogen to $NO_x$ emissions. However, when introducing swirl air at a downstream location, the data in the above examples also show that there is a third important variable which should be considered if one is to obtain the best results, e.g., to insure that one obtains the minimum conversion of fuel-nitrogen to $NO_x$ emissions. Said third variable is the percent swirl air (of the total air) introduced into the mixing region and then into the primary combustion region of the combustion zone.

FIG. 57 shows that the percent swirl air to obtain minimum conversion of fuel-nitrogen to $NO_x$ emissions decreases with increasing residence time in the primary combustion region. FIG. 58 shows that the percent swirl air to obtain minimum conversion of fuel-nitrogen to $NO_x$ emissions decreases with increasing equivalence ratio in the primary combustion region. These were surprising and unexpected results when one also considers: (a) the showing in FIGS. 38 and 44 that there is an optimum fuel-air equivalence ratio in the primary combustion region for minimum conversion of fuel-nitrogen to $NO_x$ emissions; and (b) the showing in FIG. 28 that the optimum fuel-air equivalence ratio in the primary combustion region increases with increasing residence time in said primary region. Thus, it was surprising and unexpected to discover that one should correlate the percent swirl air introduced into the mixing region with both the equivalence ratio and the residence time in the primary combustion region, if one is to obtain the best results, i.e., the minimum conversion of fuel-nitrogen to $NO_x$ emissions.

It is concluded from the results illustrated in the above examples that the percent swirl air should be used in the practice of the invention to complement both of said other operating variables (a) the fuel-air equivalence ratio in the primary combustion region and (b) the residence time in said primary combustion region, so as to obtain the minimum conversion of fuel-nitrogen to $NO_x$ emissions.

In this manner all three of said interacting operating variables can be correlated to provide a flexible, efficient method which can be used with a wide variety of high nitrogen content fuels over a wide range of operating conditions to obtain the minimum conversion of fuel-nitrogen to $NO_x$ emissions.

EXAMPLE IX

In an additional series of tests a crude shale oil, designated herein as shale oil A, was used as a fuel. The characteristics of this particular oil are set forth in Table V below:

TABLE V

| | Shale Oil A |
|---|---|
| Flash Point, °F. | 215 |
| Pour Point, °F. | 85 |
| Water and Sediment, vol % | 1.60 |
| Carbon Residue on 10% Bottoms, % | 2.40 |
| Ash, wt % | 0.09 |
| Kinematic Viscosity, cSt | |
| @ 100 F. | 40.0 |
| @ 122 F. | 21.6 |
| Specific Gravity, 60/60 °F. | 0.9279 |
| Sulfur, wt % | 0.69 |
| Nitrogen, wt % | 1.93 |
| Carbon, wt % | 84.47 |
| Hydrogen, wt % | 11.66 |
| Oxygen, wt % | 1.18 |
| Heat of Combustion, Btu/lb | 18,427 |
| Metal Content, ppm | |
| Fe | 75 |
| V | 0.38 |
| As | 29.5 |
| Ni | 2.17 |
| Pb | 5.0 |
| Hg | 0.13 |

TABLE V-continued

| | Shale Oil A |
|---|---|
| Na | 18.0 |

In this series of tests, in addition to testing an actual crude shale oil, as opposed to a light fuel oil doped with pyridine to provide a high nitrogen content, three different burner configurations were also tested and compared. The combustor referred to herein as Combustor G is similar to that illustrated in FIGS. 1 and 2 of the drawings but was modified in order to adapt the same to the heavy shale oil. The specific structure of the fuel-air mixing means is shown at FIG. 10 of the drawings. The fuel oil nozzle 24 was that shown in FIGS. 20 through 22. This type nozzle was selected in order to attain as great an atomization of the heavy oil as possible prior to the introduction of the fuel into the flame tube. Combustor G also included a variable dome primary air inlet 164 which is illustrated in greater detail in FIGS. 11, 12, 13 and 14 of the drawings. The means for introducing the air in a swirling direction through air inlets 28 and 30 was the same as that previously illustrated and described in connection with FIGS. 3, 4 and 5. The combustor also included the nozzle-type means for introducing secondary air and terminating the primary combustion region shown in FIG. 17 of the drawings.

The combustor referred to herein as combustor H is shown in FIG. 15 of the drawings. In this case, the same fuel nozzle and variable primary air inlet of Combustor G were utilized as well as the nozzle-type means for terminating the primary zone.

The combustor referred to herein as Combustor I (FIG. 16) included the same fuel nozzle of Combustor G and the same general configuration of variable primary air inlet except that the variable air inlet was the sole primary air inlet (in addition to the fuel nozzle) and included angular fins 190 designed to introduce the air in a tangential or swirling manner.

In all instances, the nominal length of the portion of primary combustion region measured from the midpoint of the primary air conduit 162 to the midpoint of the secondary air orifices was 58 inches and the nominal length of the secondary combustion region measured from the midpoint of the secondary air inlet ports to the midpoint of the dilution air inlet ports as shown in FIG. 1 of the drawings was 33 inches. The maximum internal diameter of the flame tube including the major portion of the primary combustion region and the major portion of the secondary combustion region was 6 inches. Obviously, in an actual commercial burner the flame tube would be larger but it would be scaled up in accordance with essentially the same ratio of internal diameter to length in order to attain the desired configuration necessary for attaining proper residence times, proper mixing and optimum reduction of $NO_x$. In this series of tests, the fuel-air equivalence ratio in the primary combustion zone was varied from 0.87 to 1.7. Air pressure to the fuel atomizer was 100 psig, the air temperature to the fuel atomizer was 650° F. and the fuel temperature to the fuel atomizer was 250°F. The average heat input rate for the single stage combustion (fuel-air equivalence ratio of 0.87 throughout) was 757,000 BTU per hour while that for the two-stage combustion was 744,000 BTU per hour. The average heat release rate was 498,000 BTU per hour per cubic foot for the single stage combustion and 489,000 BUT per hour per cubic foot for the two-stage combustion. The primary zone residence time was estimated to be 110 milliseconds. The remaining test conditions are set forth in the following Table VI, in which the primary zone temperature, the primary zone flow velocity and the secondary zone temperature are estimated values. The base data for thermal $NO_x$ was obtained on #1 fuel oil with 0% nitrogen.

Figure 62:
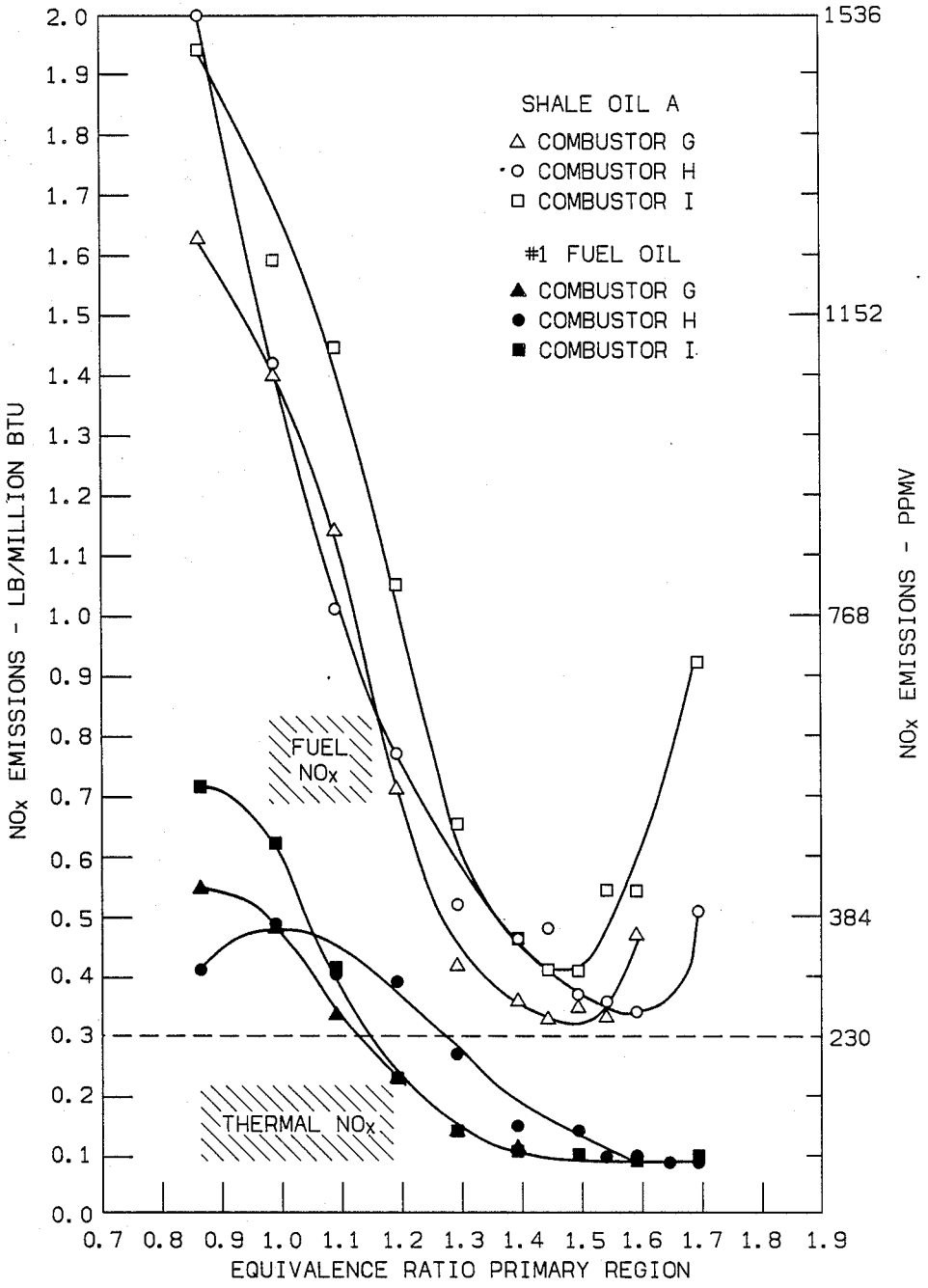
FIGS. 62–69, inclusive, are data curves setting forth the results obtained in additional working examples of the invention.

The results of this series of tests are set forth in FIG. 62 of the drawings in which the curve for Combustor G represents an average of eight runs, the curve for Combustor E represents an average of ten runs and that for Combustor I is an average of two runs. Obviously, runs made at a fuel-air equivalence ratio of 0.87 were single stage runs, since the entire burner was operated in a conventional fuel-lean manner.

Figure 63:
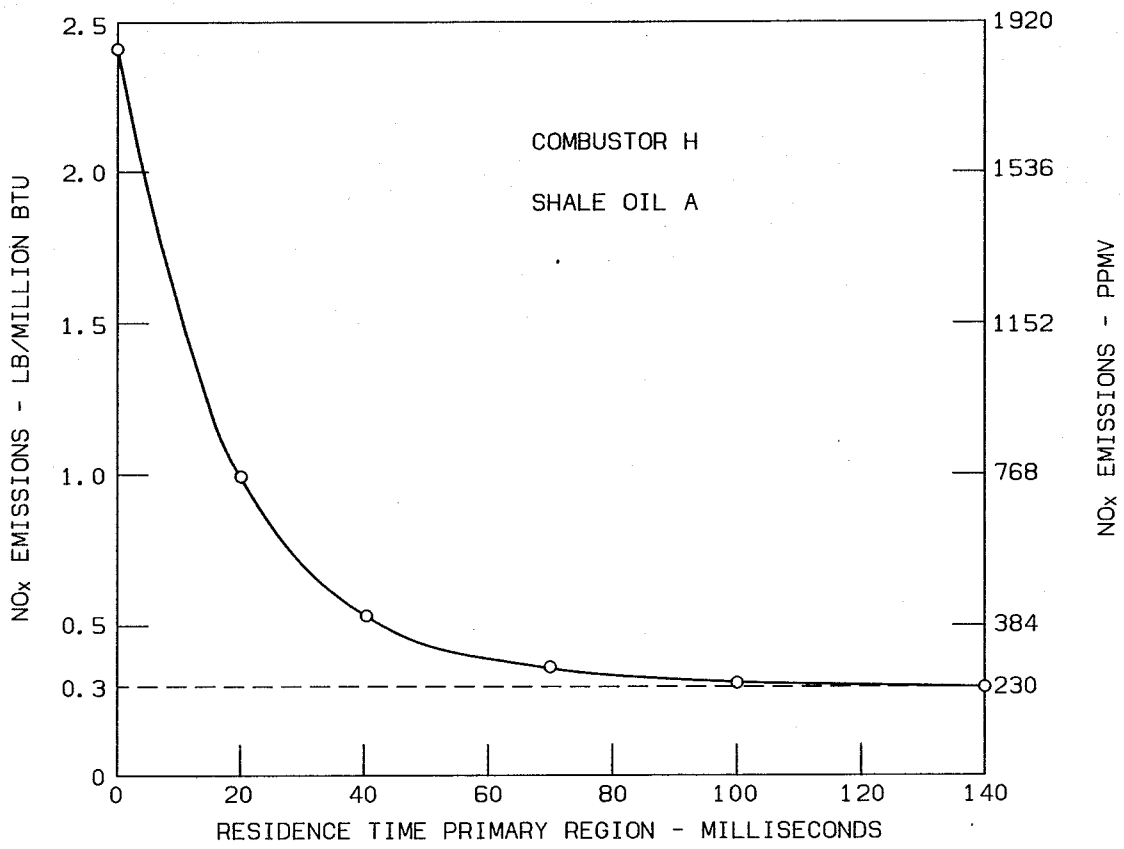

FIG. 63 of the drawings is a plot of residence time in the primary combustion region versus minimum $NO_x$ emissions from the data obtained at a primary combustion region equivalence ratio of 1.6 (test condition 36). This was considered to be the optimum equivalence ratio for Combustor H in the presently discussed series of runs. It is interesting to note from FIG. 63 that minimum $NO_x$ emissions are obtained when utilizing a primary combustion region residence time above about 35 milliseconds. However, still better results are obtained at a residence time above about 100 milliseconds. From 100 milliseconds to 140 milliseconds residence time no noticeable reduction in $NO_x$ emissions occurs. Accordingly, for optimum results, in this particular combustor operating on this particular shale oil, a preferred residence time is at least about 100 milliseconds and there is no reason to extend the residence time beyond about 140 milliseconds. Thus, in a commercial burner, there is no advantage in extending the length of the primary combustion region beyond that necessary to attain residence times between 140 and 100 milliseconds at acceptable primary combustion region flow velocities.

TABLE VI

| | | OPERATING CONDITIONS FOR COMBUSTION OF HIGH-NITROGEN FUELS | | | | | | | | | | | | | |
|---|---|---|---|---|---|---|---|---|---|---|---|---|---|---|---|
| | | | | PRIMARY REGION | | | | SECONDARY REGION | | | | DILUTION REGION | | | |
| Test Condition | Comb. Oper. Pressure in. Hg Abs. | Inlet Air Temp. °F. | Fuel lb/hr | Ø | Total Air lb/sec | Temp. °F. | Flow Velocity ft/sec | Ø | Total Air lb/sec | Temp. °F. | Flow Velocity ft/sec | Ø | Total Air lb/sec | Temp. °F. | Flow Velocity ft/sec |
| 34 | 32 | 800 | 49.9 | 1.70 | 0.112 | 3360 | 50 | 0.87 | 0.106 | 3750 | 108 | 0.30 | 0.414 | 2150 | 194 |
| 35 | 32 | 800 | 47.7 | 1.65 | 0.110 | 3420 | 50 | 0.87 | 0.098 | 3750 | 103 | 0.30 | 0.396 | 2150 | 185 |
| 36 | 32 | 800 | 45.5 | 1.60 | 0.108 | 3480 | 50 | 0.87 | 0.091 | 3750 | 98 | 0.30 | 0.378 | 2150 | 177 |
| 37 | 32 | 800 | 43.4 | 1.55 | 0.107 | 3540 | 50 | 0.87 | 0.083 | 3750 | 94 | 0.30 | 0.361 | 2150 | 169 |
| 38 | 32 | 800 | 41.4 | 1.50 | 0.105 | 3600 | 50 | 0.87 | 0.076 | 3750 | 89 | 0.30 | 0.344 | 2150 | 161 |
| 39 | 32 | 800 | 39.5 | 1.45 | 0.104 | 3650 | 50 | 0.87 | 0.069 | 3750 | 85 | 0.30 | 0.328 | 2150 | 153 |
| 40 | 32 | 800 | 37.7 | 1.40 | 0.102 | 3700 | 50 | 0.87 | 0.062 | 3750 | 81 | 0.30 | 0.313 | 2150 | 146 |
| 41 | 32 | 800 | 36.1 | 1.35 | 0.102 | 3750 | 50 | 0.87 | 0.056 | 3750 | 78 | 0.30 | 0.300 | 2150 | 140 |
| 42 | 32 | 800 | 34.2 | 1.30 | 0.100 | 3800 | 50 | 0.87 | 0.049 | 3750 | 74 | 0.30 | 0.284 | 2150 | 133 |
| 43 | 32 | 800 | 32.5 | 1.25 | 0.099 | 3850 | 50 | 0.87 | 0.043 | 3750 | 70 | 0.30 | 0.270 | 2150 | 126 |
| 44 | 32 | 800 | 30.9 | 1.20 | 0.098 | 3900 | 50 | 0.87 | 0.037 | 3750 | 67 | 0.30 | 0.256 | 2150 | 120 |
| 45 | 32 | 800 | 27.8 | 1.10 | 0.096 | 3980 | 50 | 0.87 | 0.025 | 3750 | 60 | 0.30 | 0.230 | 2150 | 108 |
| 46 | 32 | 800 | 25.6 | 1.00 | 0.097 | 3920 | 50 | 0.70 | 0.042 | 3400 | 63 | 0.30 | 0.185 | 2150 | 99 |
| 47 | 32 | 800 | 23.2 | 0.87 | 0.101 | 3750 | 50 | 0.70 | 0.025 | 3400 | 57 | 0.30 | 0.168 | 2150 | 90 |

Several significant observations can be made by reference to FIG. 62 of the drawings. First, it can be seen that, for the particular high nitrogen, heavy shale oil tested, thermal $NO_x$ alone is substantially higher than the Federal limits when a combustor is operated as a single stage combustor. Even when operating the combustors in a two-stage, rich-lean manner, and under indicated operating conditions, the thermal $NO_x$ represented nearly one-third of the total $NO_x$ level permitted by Federal regulations. However, with each of the three burners it was possible to reduce the total $NO_x$ content of the flue gases to values which essentially meet the Federal limitations.

By comparing FIG. 62 with FIGS. 39, 45, 49 and 59 of the drawings, it is obvious that the minimum $NO_x$ emissions were obtained at higher fuel-air equivalence ratios in the primary combustion region while operating with the heavy shale oil, as opposed to the previously tested light oil containing essentially the same amount of nitrogen. Thus, this shift in the fuel-air equivalence ratio for the primary combustion region can be attributed to the heavier character of the shale oil.

It is also interesting to note that minimum $NO_x$ emissions were obtained at slightly different equivalence ratios for the three different combustors. Thus, since the three combustors differed primarily in the means for introducing primary combustion air and mixing the same with the fuel, the necessary equivalence ratio for minimum $NO_x$ emissions is obviously dependent upon the nature of the fuel-air mixing and the intimacy of contact attained.

Comparing FIG. 63 with FIGS. 52 and 53 of the drawings, it is to be seen that the minimum primary region residence times are somewhat higher for the heavy shale oil, as compared with the lighter oil doped with pyridine.

EXAMPLE X

Figure 64:
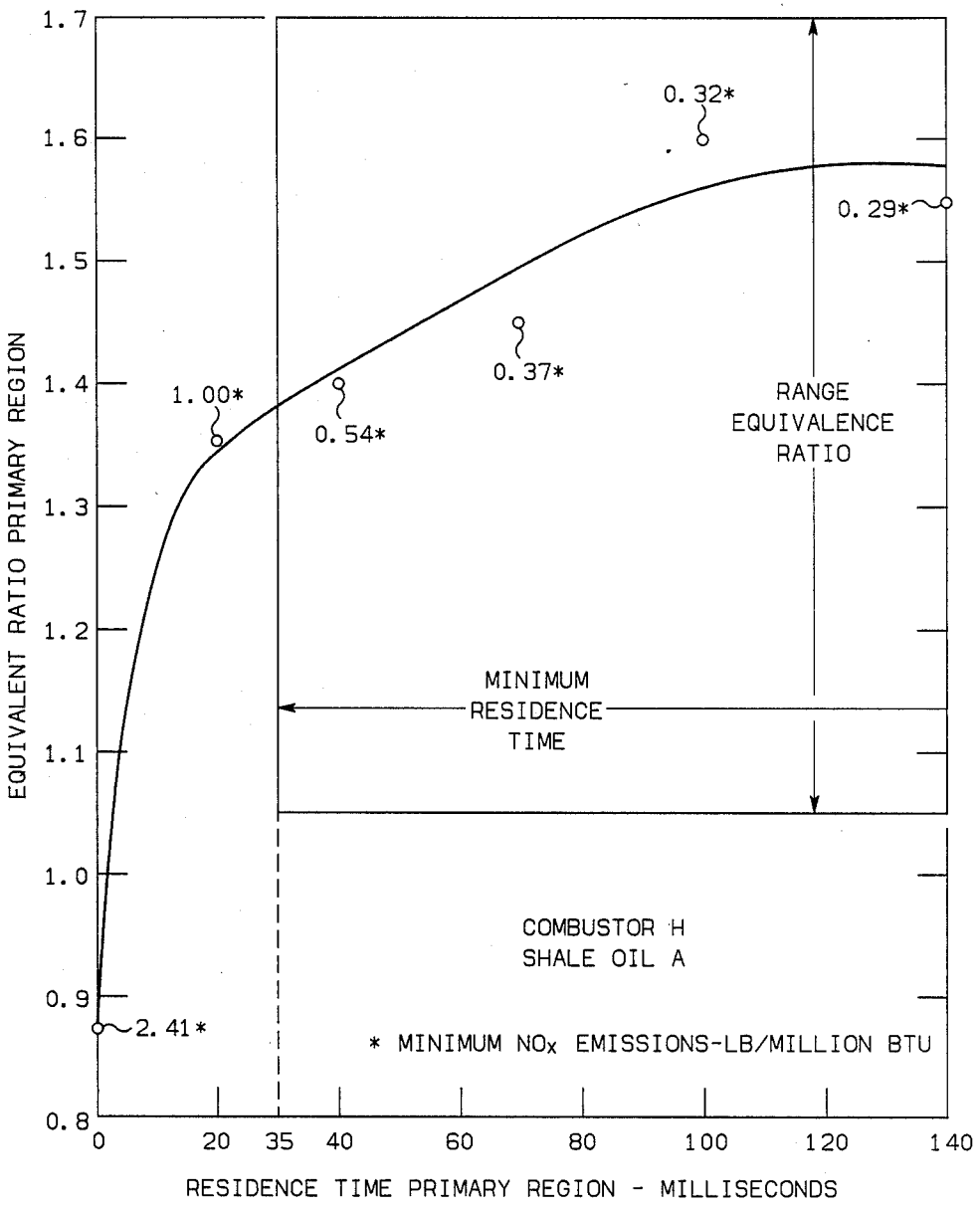

The relationship of the primary zone equivalence ratio and the primary zone residence time is illustrated by FIG. 64 of the drawings. The data plotted in FIG. 64 are for shale oil A and combustor H. Table VII below sets forth the conditions employed in conducting the series of tests summarized in FIG. 64. The tests were run by selecting different lengths for the primary combustion region from zero through seven feet (fuel-air equivalence ratios from 0 to 140 milliseconds), maintaining a constant primary region flow velocity of 50 feet per second and varying the primary zone equivalence ratio to obtain minimum $NO_x$ emissions at the particular primary zone residence time.

TABLE VII

| Primary Combustion Region | |
|---|---|
| Length - Feet | Residence Time - Milliseconds |
| 0 | 0 |

TABLE VII-continued

| Primary Combustion Region | |
|---|---|
| Length - Feet | Residence Time - Milliseconds |
| 1.0 | 20 |
| 2.0 | 40 |
| 3.5 | 70 |
| 5.0 | 100 |
| 7.0 | 140 |
| Inlet Air Pressure | 32 in Hg abs |
| Inlet Air Temperature | 800° F. |
| Air Pressure to Fuel Nozzle | 100 psig |
| Air Temperature to Fuel Nozzle | 650° F. |
| Fuel Temperature to Fuel Nozzle | 250° F. |
| Heat Input Rate | 838,000 Btu/hr |
| Primary Region Flow Velocity (Estimated) | 50 ft/sec |
| Secondary Region Equivalence Ratio | 0.87 |
| Secondary Region Temperature (Estimated) | 3750° F. |

It is to be observed that the curve of FIG. 64 is quite comparable in character to that of FIG. 54. At a residence time of about 35 milliseconds, there is a break in the curve which clearly indicates that the minimum residence time set forth herein of 35 milliseconds represents a change in character. From 35 milliseconds to about 100 milliseconds, the curve follows a gradually increasing path and above 100 milliseconds the curve tends to flatten out. Thus, the heavier shale oil tends to shift the curve toward higher residence times when both the equivalence ratio and residence time are considered. By the same token, FIG. 64 shows that, for the heavier shale oil, there is also a shift in the equivalence ratio to higher equivalence ratios.

EXAMPLE XI

Figure 65:
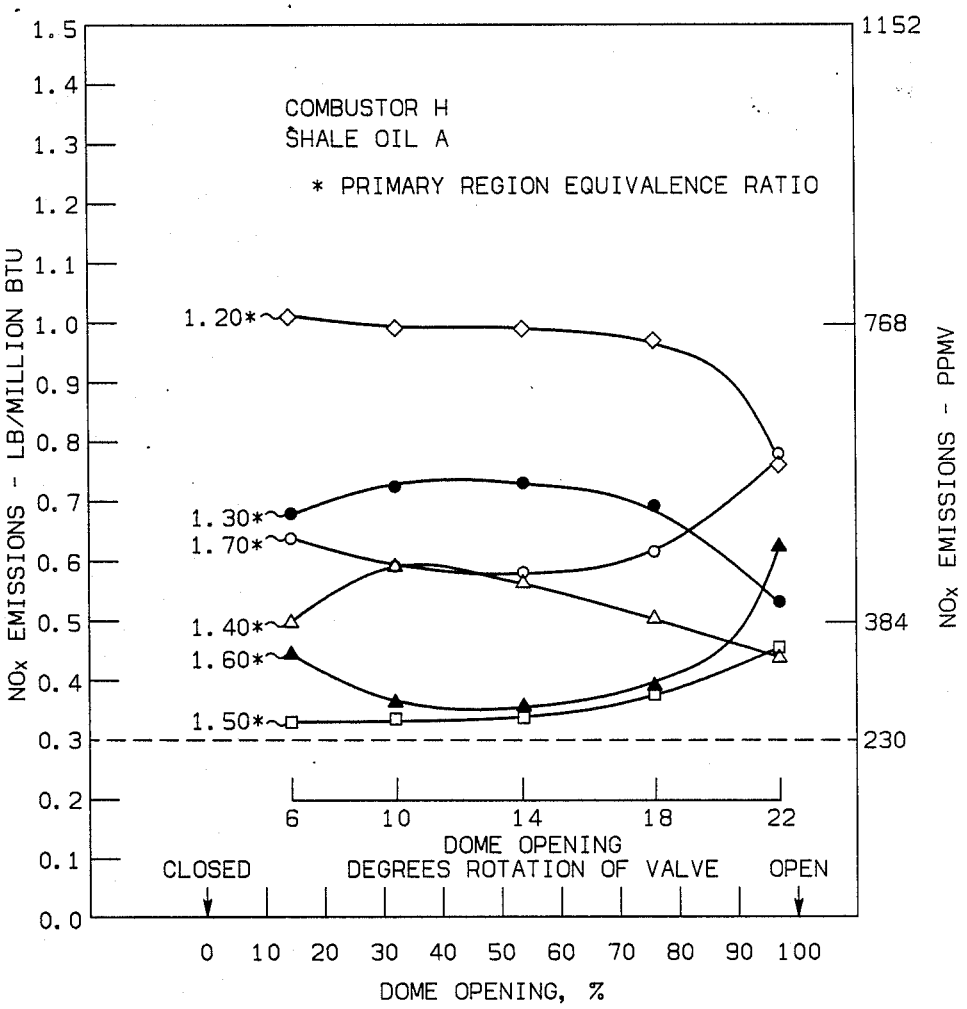

FIG. 65 of the drawings shows the importance of adjusting the ratio of the axial flow component and the radial flow component by utilizing a variable dome air inlet when operating with heavy oils. The data plotted in FIG. 65 was obtained utilizing combustor H and shale oil A. In this particular instance, the dome opening was varied from 15 percent open to 97 percent open at each of the designated primary combustion region equivalence ratios. The data plotted are averages of minimum $NO_x$ emission obtained in a plurality of tests under test conditions 34, 36, 38, 40, 42 and 44, as previously set forth in Table VI.

It is to be observed by a study of FIG. 65 that at low equivalence ratios, which are too low to obtain optimum $NO_x$ emissions, the minimum $NO_x$ emission is obtained with the dome essentially 100 percent open. However, as the optimum equivalence ratio is approached in this particular case, the curve begins to flatten out and reverse as shown at an equivalence ratio of 1.5. At an equivalence ratio of 1.5, minimum $NO_x$ emissions are obtained at a dome opening of about 15 percent open. However, the dome opening becomes quite significant at the optimum equivalence ratio of 1.6 (lowest $NO_x$ emissions). This obviously illustrates the necessity of not only correlating the operating variables of primary zone residence, equivalence ratio and dome opening, but of ajusting these variables for each particular fuel oil. Thus, at the optimum equivalence ratio, there is also a dome opening which attains minimum $NO_x$ emissions. In this particular instance, this opening occurs at about 47 percent open. Therefore, it is quite obvious that when operating on this particular heavy shale oil, the adjustment of the variable primary air inlet is most significant and, in fact, is necessary to the proper operation of the combustor. Obviously, when a fuel which has not been previously burned in a given two-stage combustor is to be utilized, in addition to determining the optimum residence time and the optimum fuel air equivalence ratio, it is necessary to determine the optimum dome opening for the variable air inlet in order to attain optimum mixing of the fuel and air in the primary combustion region and stabilize the flame adjacent the upstream end of the primary combustion region. It is also important that the variable opening dome be employed in commercial operations so that adjustments can be made for changes in the character of fuel to be burned as well as changes in the properties of a particular fuel. Obviously, any given fuel supplied over a long period of time will vary to some extent, particularly with respect to volatility. Accordingly, should the $NO_x$ emission level increase at any time, it can normally be brought back to the desired minimum level by simply adjusting the adjustable dome.

While, as previously indicated, the combustors of the present invention will operate to produce minimum $NO_x$ emissions without a variable dome, it is necessary in such cases to design a burner for a particular fuel and no adjustments can be made should the fuel be changed or should the properties of a particular fuel vary during use of the combustor. While adjustments can be made in the primary region flow velocity and equivalence ratio, it is much simpler to be able to adjust the variable air introduction means to attain the desired degree of mixing when only the volatility of the fuel differs.

Figure 66:
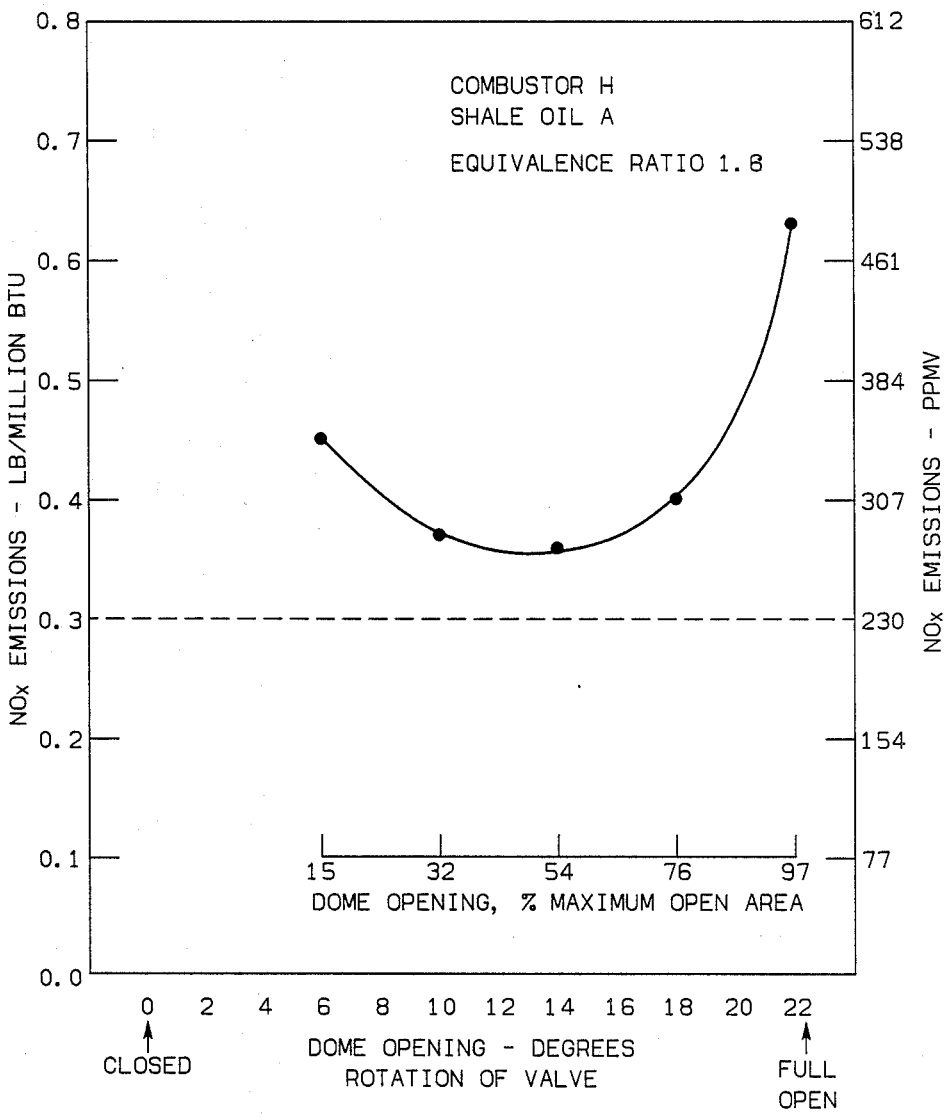

FIG. 66 of the drawings is a replot of the data of FIG. 65 on an expanded scale at the optimum equivalence ratio of 1.6, so as to emphasize the importance of adjusting the dome opening, once the optimum residence time and optimum equivalence ratio have been set.

The adjustment of the variable air can be carried out manually or automatically. In the latter instance an appropriate controller unit, such as controller unit 109 of FIG. 6, would be actuated by a signal from an appropriate means for measuring the $NO_x$ content of the flue gas.

EXAMPLE XII

Figure 67:
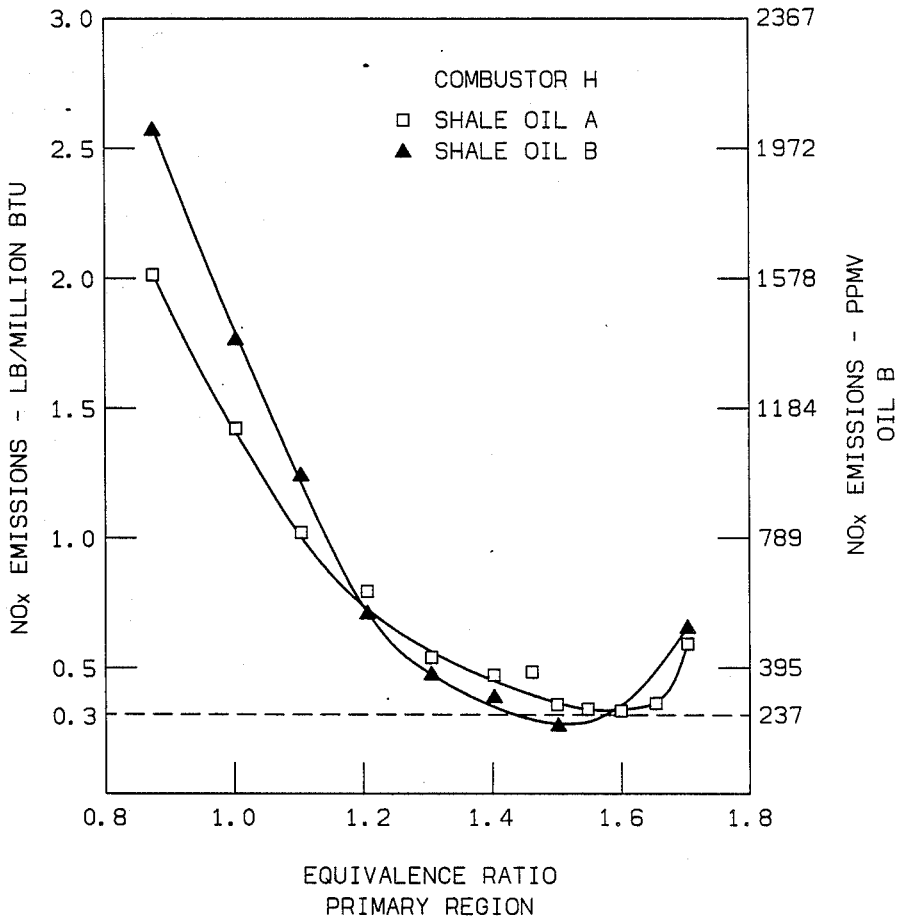

Another series of tests was conducted in which a different shale oil, having a lower concentration of bound nitrogen, was burned in Combustor H. The conditions of this series of tests are set forth in the Table VIII below and the characteristics of this shale oil, referred to herein as shale oil B, are set forth in Table IX. In order to compare the results obtained with those obtained in the same combustor (H) and utilizing shale oil A, the plot of equivalence ratio versus $NO_x$ emissions for combustor H shale oil A of FIG. 62 was replotted in FIG. 67 along with the data obtained when operating on shale oil B.

It is to be observed that while the two shale oils have essentially the same characteristics, including volatilities, the difference in the level of bound nitrogen has a tendency to shift the optimum equivalence ratio. For the shale oil containing the lesser amount of bound nitrogen, the optimum equivalence ratio occurs at about 1.5, while, as previously indicated, the higher nitrogen fuel exhibits optimum results at an equivalence ratio of about 1.6.

Figure 68:
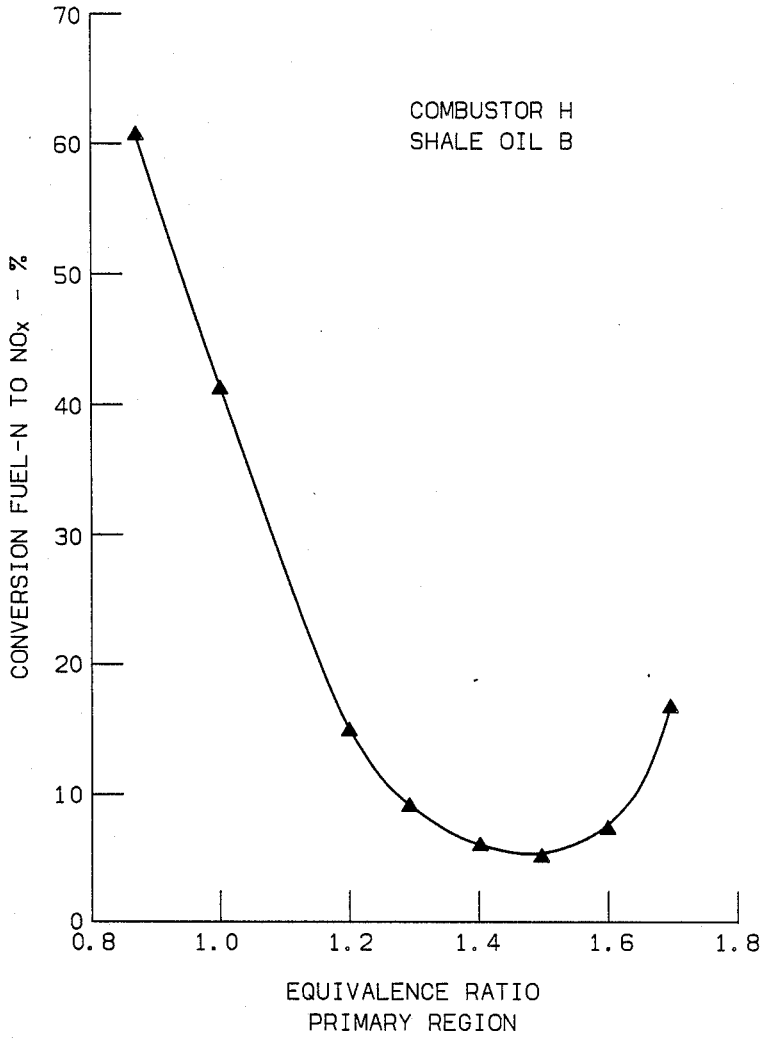

FIG. 68 of the drawings illustrates the conversion of fuel-nitrogen to $NO_x$ emissions at various equivalence ratios from the data obtained on shale oil B. It can be seen that the conversion of fuel-nitrogen to $NO_x$ can be reduced to the desired 5 percent when operating in accordance with the present invention.

As previously indicated, by maintaining carbon monoxide emissions below about 300 parts per million, efficient utilization of the fuel can be

TABLE VIII

OPERATING CONDITIONS FOR COMBUSTION OF SHALE OIL B

| Burner Pressure in Hg abs | Air Inlet Temperature, F. | Primary Air Flow, lb/hr | Fuel Flow, lb/hr | Equivalence Ratio | Estimated Primary Zone Temperature, F. | Estimated Primary Zone Flow Velocity, ft/sec |
|---|---|---|---|---|---|---|
| 32 | 650 | 432 | 58 | 1.8 | 3100 | 50 |
| 32 | 650 | 414 | 53 | 1.7 | 3230 | 50 |
| 32 | 650 | 403 | 48 | 1.6 | 3350 | 50 |
| 32 | 650 | 389 | 43 | 1.5 | 3500 | 50 |
| 32 | 650 | 385 | 40 | 1.4 | 3640 | 50 |
| 32 | 650 | 364 | 35 | 1.3 | 3750 | 50 |
| 32 | 650 | 356 | 32 | 1.2 | 3850 | 50 |
| 32 | 650 | 353 | 29 | 1.1 | 3900 | 50 |
| 32 | 650 | 353 | 26 | 1.0 | 3900 | 50 |
| 32 | 650 | 371 | 24 | 0.87 | 3690 | 50 |

Equivalence Ratio in Secondary Zone = 0.87 (3% Excess Oxygen, Dry)
Equivalence Ratio in Dilution Zone = 0.30 (Estimated 1950° F.)

TABLE X

OPERATING CONDITIONS FOR COMBUSTION OF HIGH-NITROGEN FUELS

| | | PRIMARY REGION | | | | | | SECONDARY REGION | | | | | DILUTION REGION | | | |
|---|---|---|---|---|---|---|---|---|---|---|---|---|---|---|---|---|
| Fuel Oil | Combo Oper. Pressure in. Hg Abs. | Inlet Air Temp. °F. | Fuel lb/hr | Ø | Total Air lb/sec | Temp. °F. | Flow Velocity ft/sec | Residence Time Ms | Ø | Total Air lb/sec | Temp. °F. | Flow Velocity ft/sec | Ø | Total Air lb/sec | Temp. °F. | Flow Velocity ft/sec |
| #4* | 32 | 650 | 39.3 | 1.50 | 0.108 | 3500 | 50 | 31 | 0.87 | 0.077 | 3900 | 90 | 0.30 | 0.354 | 1950 | 152 |
| #4* | 32 | 1000 | 76.1 | 1.50 | 0.208 | 3620 | 100 | 15 | 0.87 | 0.151 | 3970 | 187 | 0.30 | 0.682 | 2330 | 341 |
| #4* | 32 | 650 | 39.3 | 1.50 | 0.108 | 3500 | 50 | 8 | 0.87 | 0.077 | 3900 | 90 | 0.30 | 0.354 | 1950 | 152 |
| #4* | 32 | 650 | 39.3 | 1.50 | 0.108 | 3500 | 50 | 8 | 0.87 | 0.077 | 3900 | 90 | 0.30 | 0.354 | 1950 | 152 |
| Shale | 32 | 650 | 39.3 | 1.50 | 0.108 | 3500 | 50 | 31 | 0.87 | 0.077 | 3900 | 90 | 0.30 | 0.354 | 1950 | 152 |

*Doped with pyridine to obtain 20% fuel nitrogen.

TABLE IX

PHYSICAL AND CHEMICAL PROPERTIES OF SHALE OIL B

| | |
|---|---|
| Flash Point, °F. | 160 |
| Pour Point, °F. | 65 |
| Water and Sediment, vol % | 0.3 |
| Carbon Residue on 10% Bottoms, % | 2.11 |
| Ash, wt % | 0.01 |
| Kinematic Viscosity, cSt | |
| @ 100 F. | 30.9 |
| @ 122 F. | 17.14 |
| Specific Gravity, 60/60 °F. | 0.9254 |
| Sulfur, wt % | 0.48 |
| Nitrogen, wt % | 1.85 |
| Carbon, wt % | 82.80 |
| Hydrogen, wt % | 11.09 |
| Oxygen, wt % | 1.39 |
| Heat of Combustion, Btu/lb | 18,481 |
| Metal Content, ppm | |
| Fe | 37 |
| V | 0.79 |
| As | 27.1 |
| Ni | 1.85 |
| Pb | <10 |
| Hg | 0.22 |
| Na | 0.16 |

EXAMPLE XIII

Figure 69:
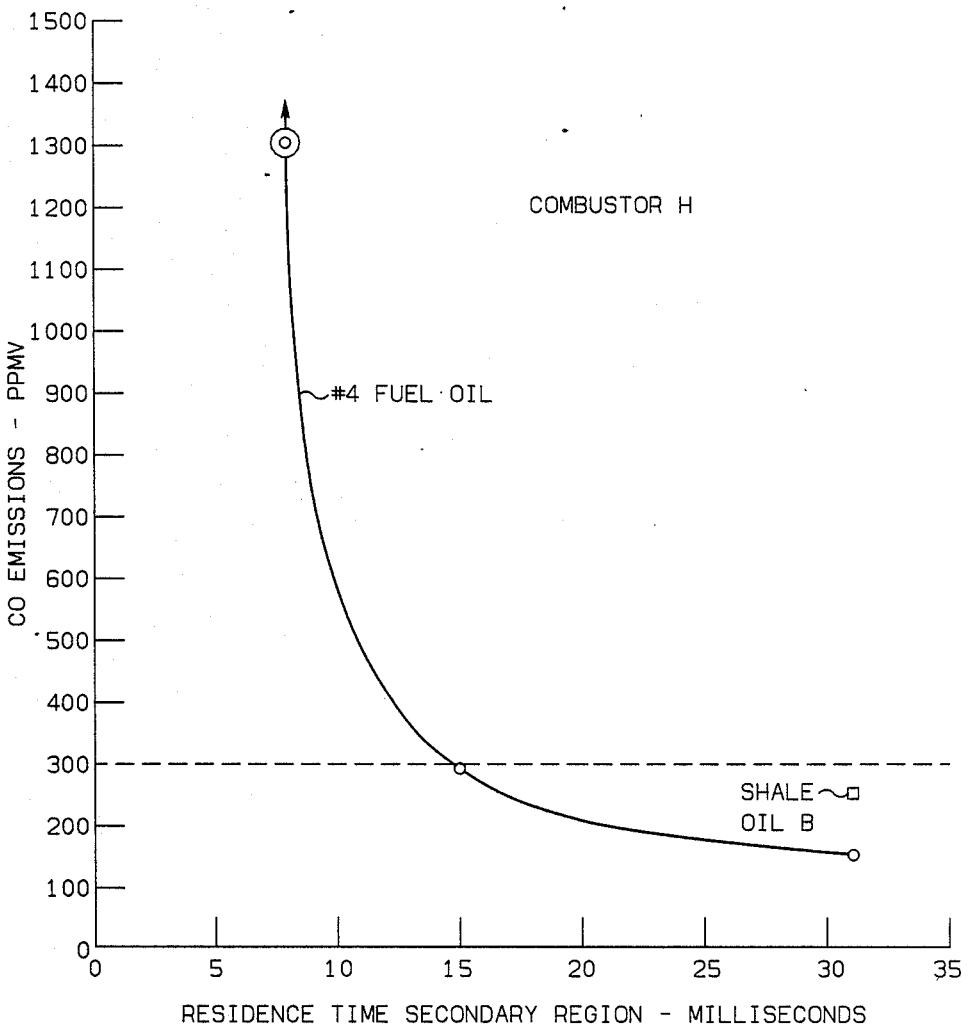

In order to illustrate the necessity of also maintaining a minimum residence time in the secondary combustion region to attain substantially complete and efficient combustion of the fuel, data has been plotted as FIG. 69 for a #4 fuel oil, doped with pyridine to obtain a 2.0% nitrogen content. The test conditions are set forth in Table X.

EXAMPLE XIV

A series of tests was conducted utilizing prototype burner L of FIG. 28. This burner had 4-inch thick ceramic walls and was designed to have a maximum pressure drop of 6 inches of water at its rated heat release of 10 MM BTU/Hr when operated with an air inlet temperature of 800°F. This burner was installed in the furnace shown IN FIG. 33, utilizing the air supply shown in FIGS. 34 and 35. This air supply allowed preheating of the air, without vitiation, to 600° F. Be metering the total air flow to the burner and the air flow to the primary combustion zone it was possible to establish the desired stoichiometry in both the primary and secondary combustion zones.

The performance of this prototype burner during the initial testing period was found to be acceptable. The burner lit easily and the air-jet mixing configuration displayed a stable flame without audible resonance. The pressure drop across the burner was less than the target of 6 inches of water, maximum, at the rated heat release (10 MM BTU/Hr). Combustion efficiency was 100 percent with excess oxygen levels in the exhaust gas down to 1 percent and with no visible exhaust smoke. The fuel-rich primary zone was free of deposits after extended operation on No. 6 fuel oil. The burner response to changing primary-zone stoichiometry is shown in FIG. 70, i.e., $NO_x$ emissions were high when operated as a one-stage burner ($\phi=0.87$) and decreased markedly with two-stage operation, reaching a minimum with a primary zone equivalence ratio of about 1.5.

Figure 70:
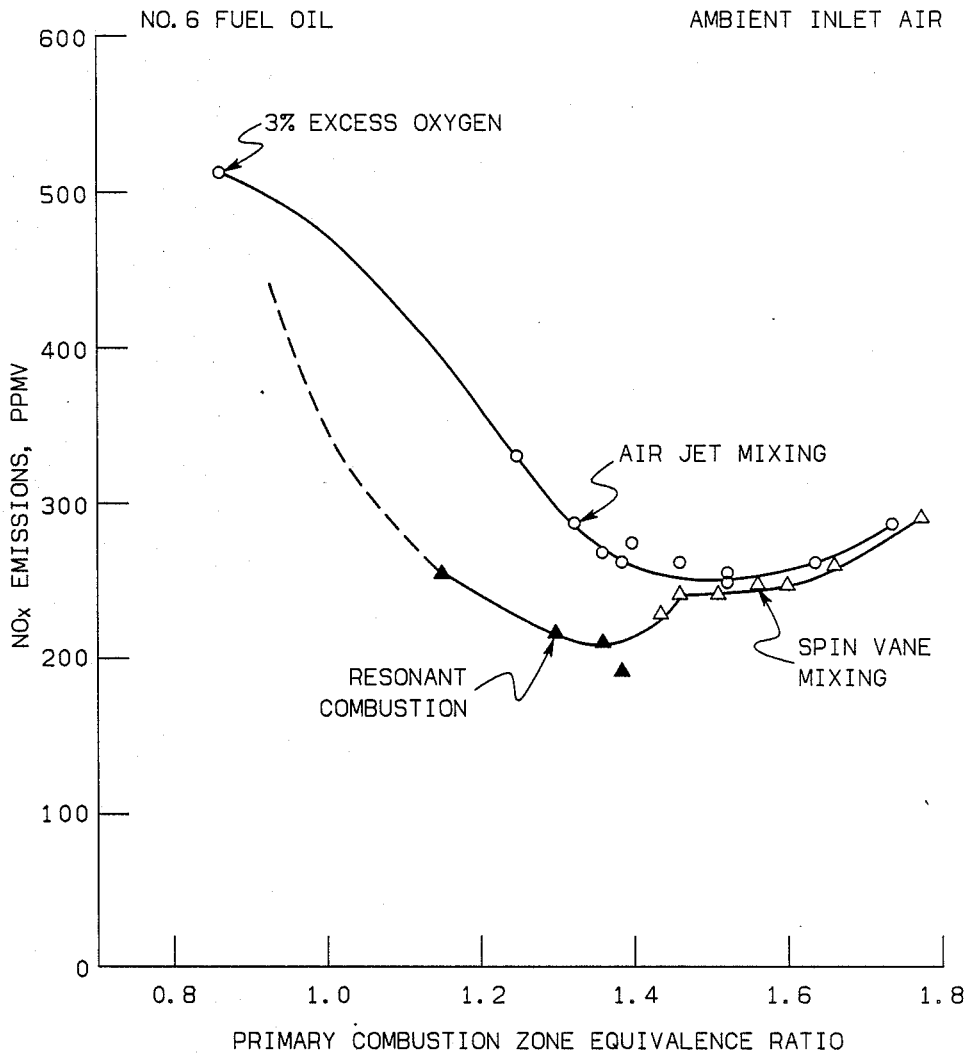
FIGS. 70–77 are data curves setting forth the results of prototype tests conducted in the test furnaces of FIGS. 33 and 36.

The performance of prototype burner L of FIG. 27, in the same furnace and utilizing the same air system, is also shown in FIG. 70. This approximates a high intensity vortex mixing system. While the level of $NO_x$ emissions dropped below that achieved with the burner of FIG. 28, a high level of combustion instability was encountered which was evidenced by intolerable resonance. It is well known that resonance, or screeching combustion, can accelerate heat and mass transfer to improve fuel-air mixing.

The utilization of the test furnace of FIG. 33 proves to be an unfortunate choice because of the relatively high temperatures achieved in the furnace which, in turn, resulted in relatively high levels of "thermal $NO_x$". As a result, testing of the prototype burners in this furnace was terminated at this point.

EXAMPLE XV

Figure 71:
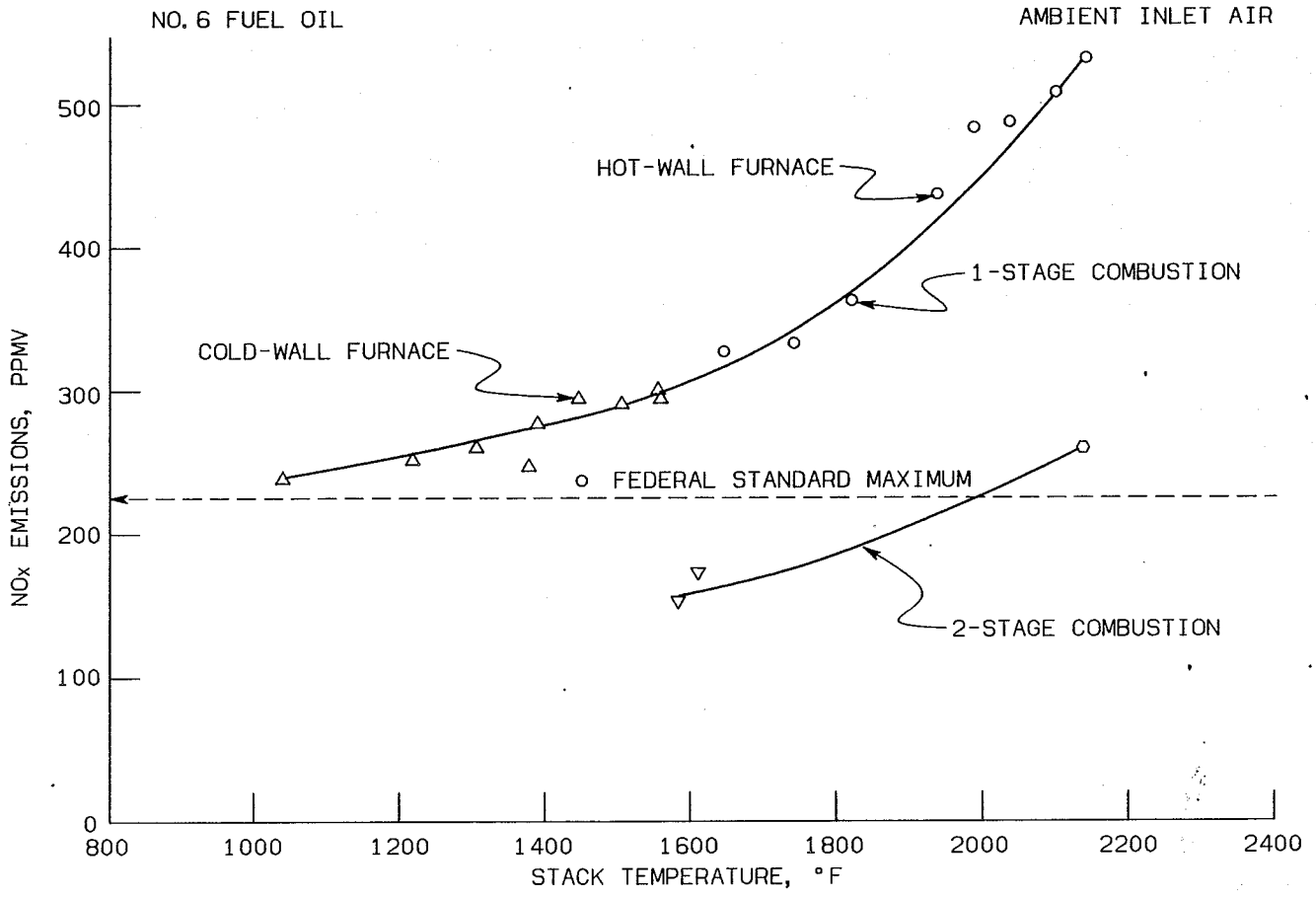

Prototype burners L and M of FIGS. 27 and 28, respectively, were also installed in a furnace configuration shown in FIG. 36, utilizing the air supply system of FIG. 37. As indicated, the test furnace of FIG. 36 had a steel wall that was water cooled. As a result, the stack gas temperatures were reduced significantly, and this decreased the level of thermal $NO_x$ to a tolerable level, as illustrated by the data presented in FIG. 71. The lower furnace temperature achieved in this environment is characteristic of that existing in process heaters which is the duty which was sought to be simulated in the test program. The performance of the prototype burners during this final period of testing continued to be acceptable, i.e., the burners were easy to light, the flame was compact, the exhaust gas was clean, there were no problems with distortion of the air registers or other hardware, and the burners proved to be durable.

Figure 72:
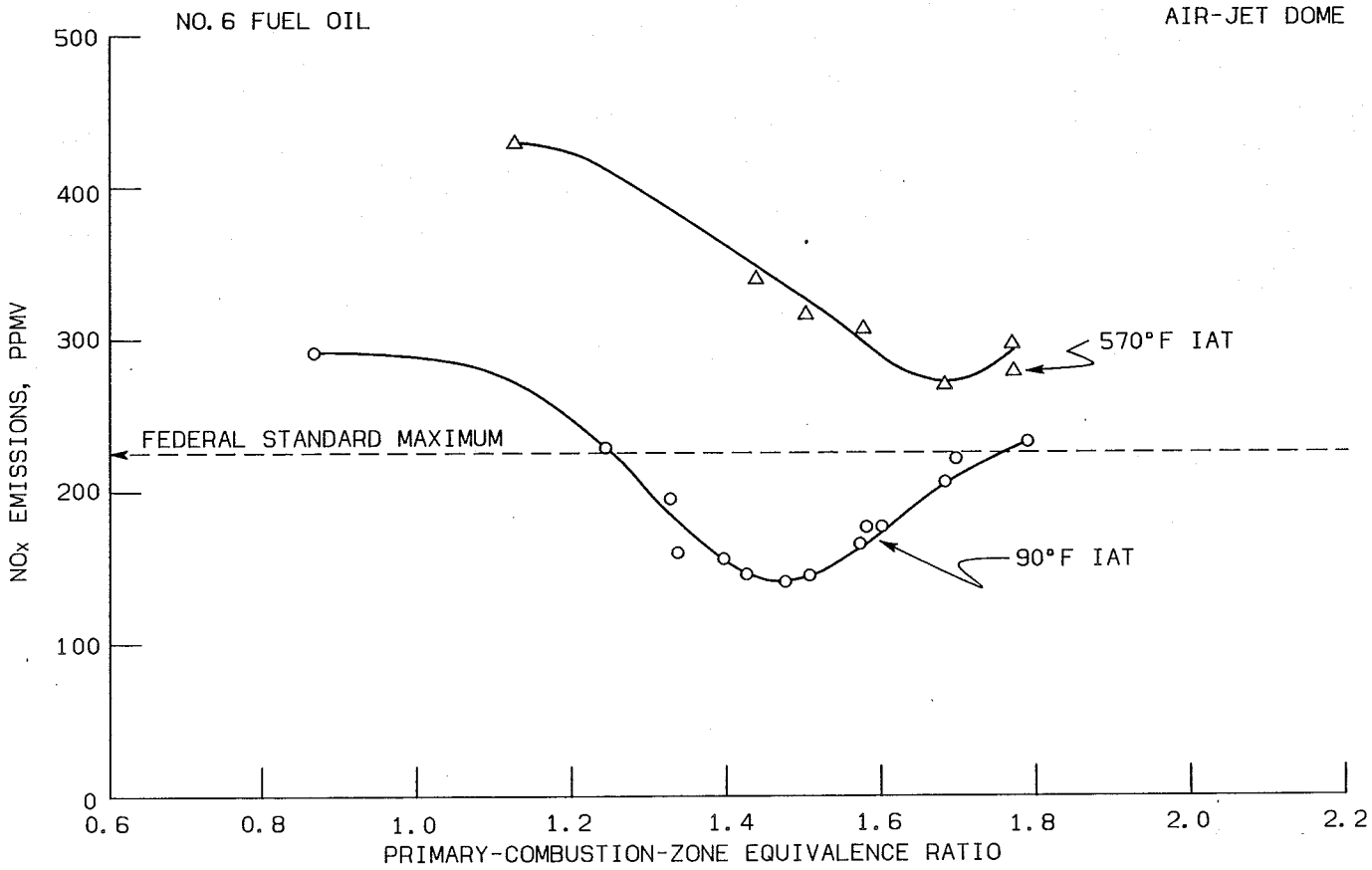
Figure 73:
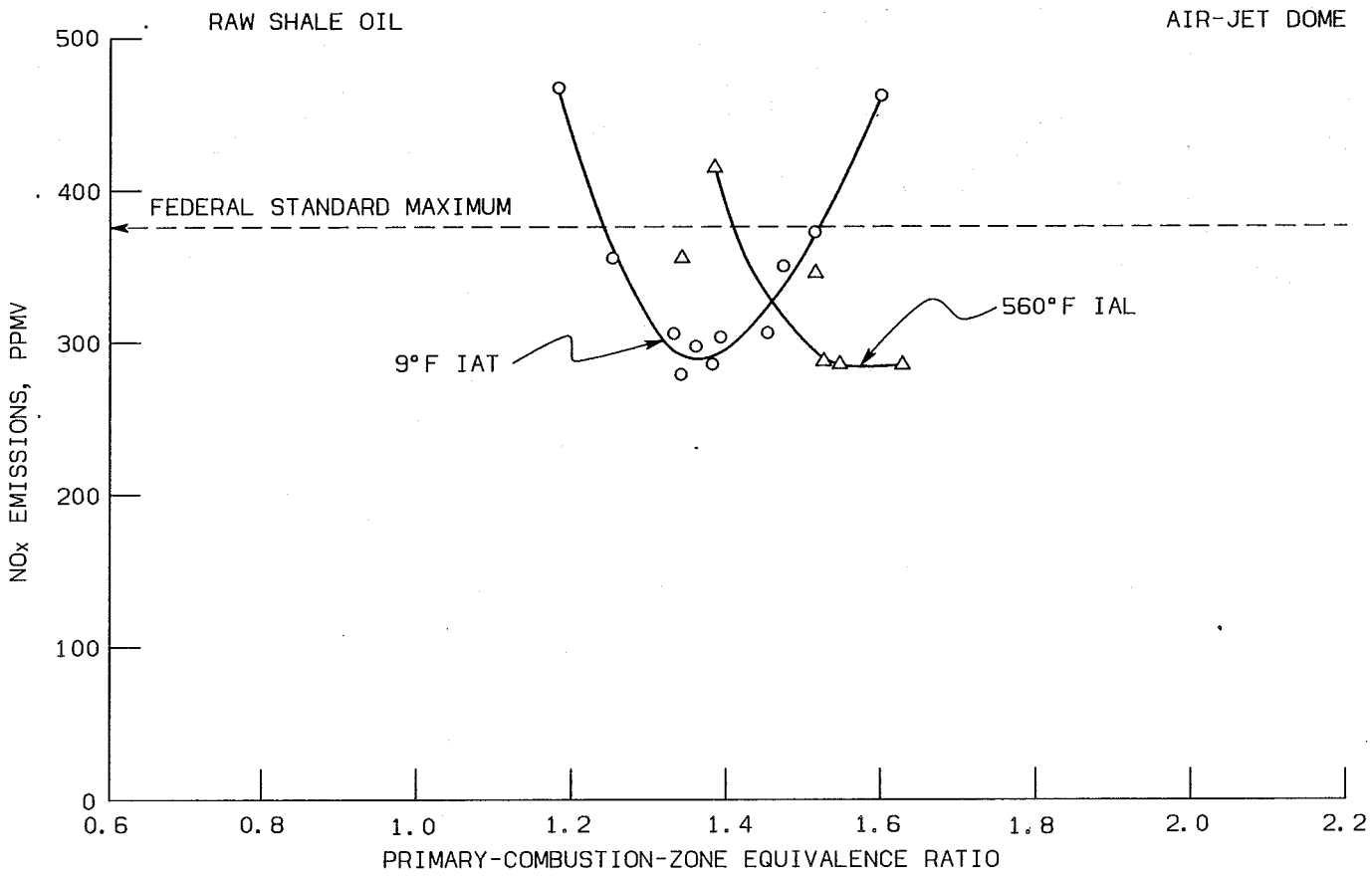

With the burner of FIG. 28 (burner M) the data obtained burning No. 6 fuel oil are presented in FIG. 72. Similarly, the data obtained burning raw shale oil are presented in FIG. 73. A statistical analysis of these data was made to determine the 95 percent confidence interval on the true mean value of $NO_x$ emissions at the minimum levels for each mixture-response curve, and the results were very acceptable. As an example, for No. 6 fuel oil at an inlet air temperature of 90° F., the minimum level of $NO_x$ emissions was observed to be 145 ppmv at an equivalence ratio of 1.47, and the 95 percent confidence interval on the true mean value is $149 \pm 8$ ppmv $NO_x$. Similar levels of the experimental air were found in other test conditions and with other fuels. It should be noted that no attempt was made during this investigation to optimize fuel-air mixing by varying the axial and radial components of the primary air flow, nor was any attempt made to optimize burner length (residence time) for minimum $NO_x$ emissions. Based upon previous operating experience with smaller burners, it is anticipated that further reductions in $NO_x$ emissions could be made if the fuel-air mixing and the residence time were optimized in the prototype burner.

Figure 74:
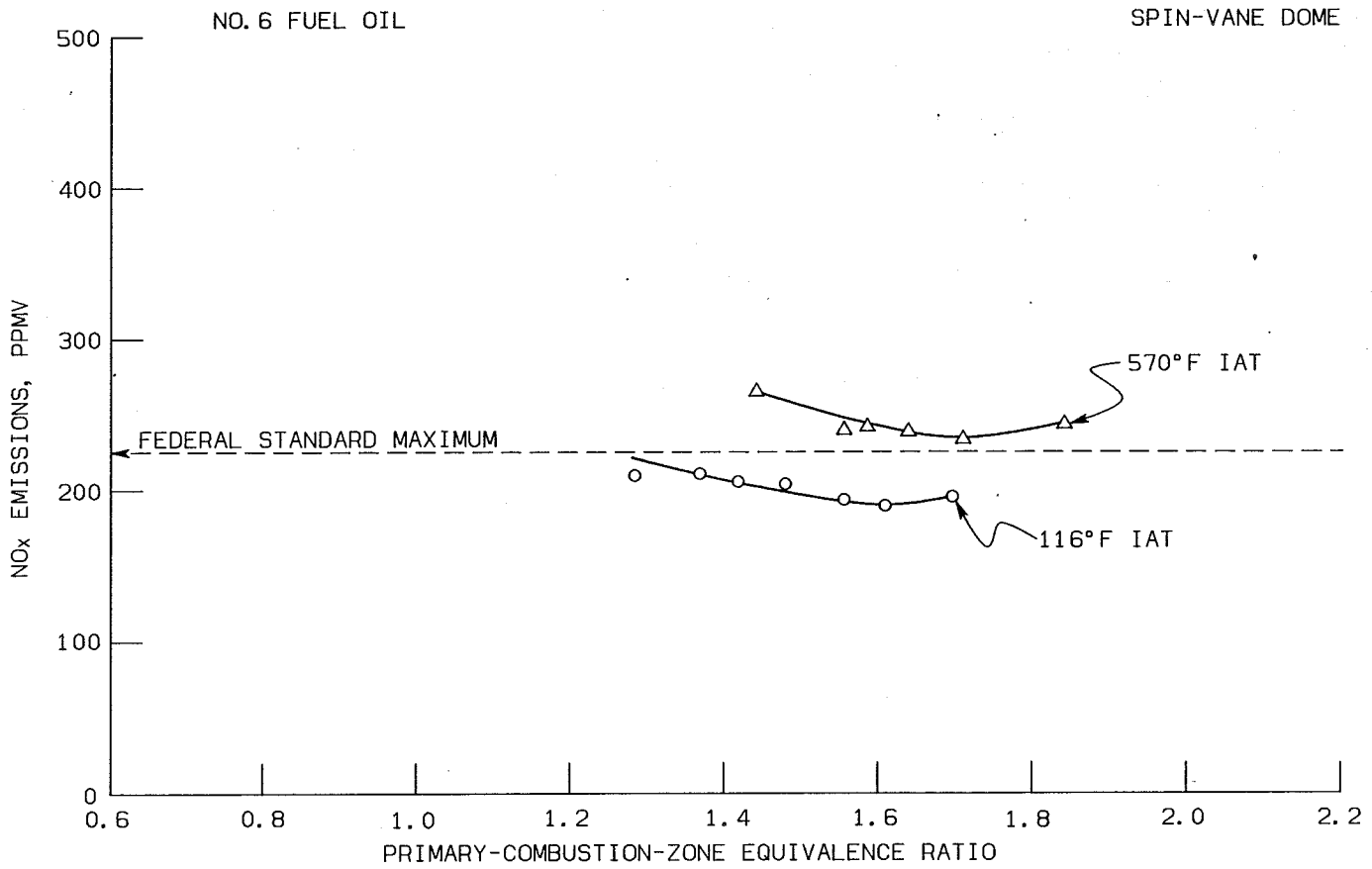
Figure 75:
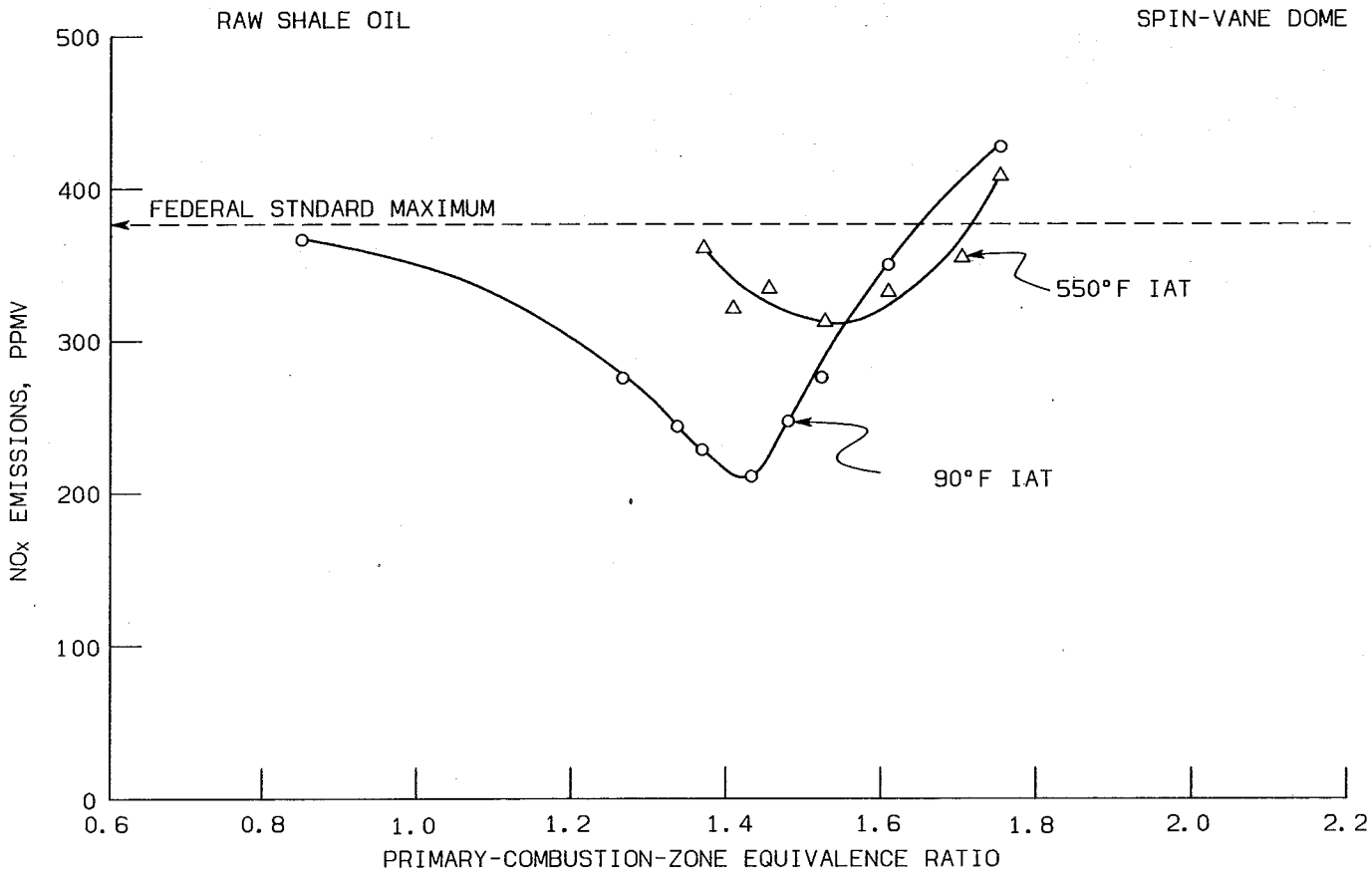

Burner L of FIG. 27 was also tested and comparable levels of $NO_x$ emissions were obtained, as shown in FIG. 74 for No. 6 fuel oil and FIG. 75 for raw shale oil. Unfortunately, the operation of this burner was accompanied by resonant combustion, which varied in intensity from a moderate buzz to an intense screech. Therefore this burner would be considered unacceptable for commercial operation. However, modification to eliminate the problem of resonance is within the skill of one skilled in the art.

Figure 76:
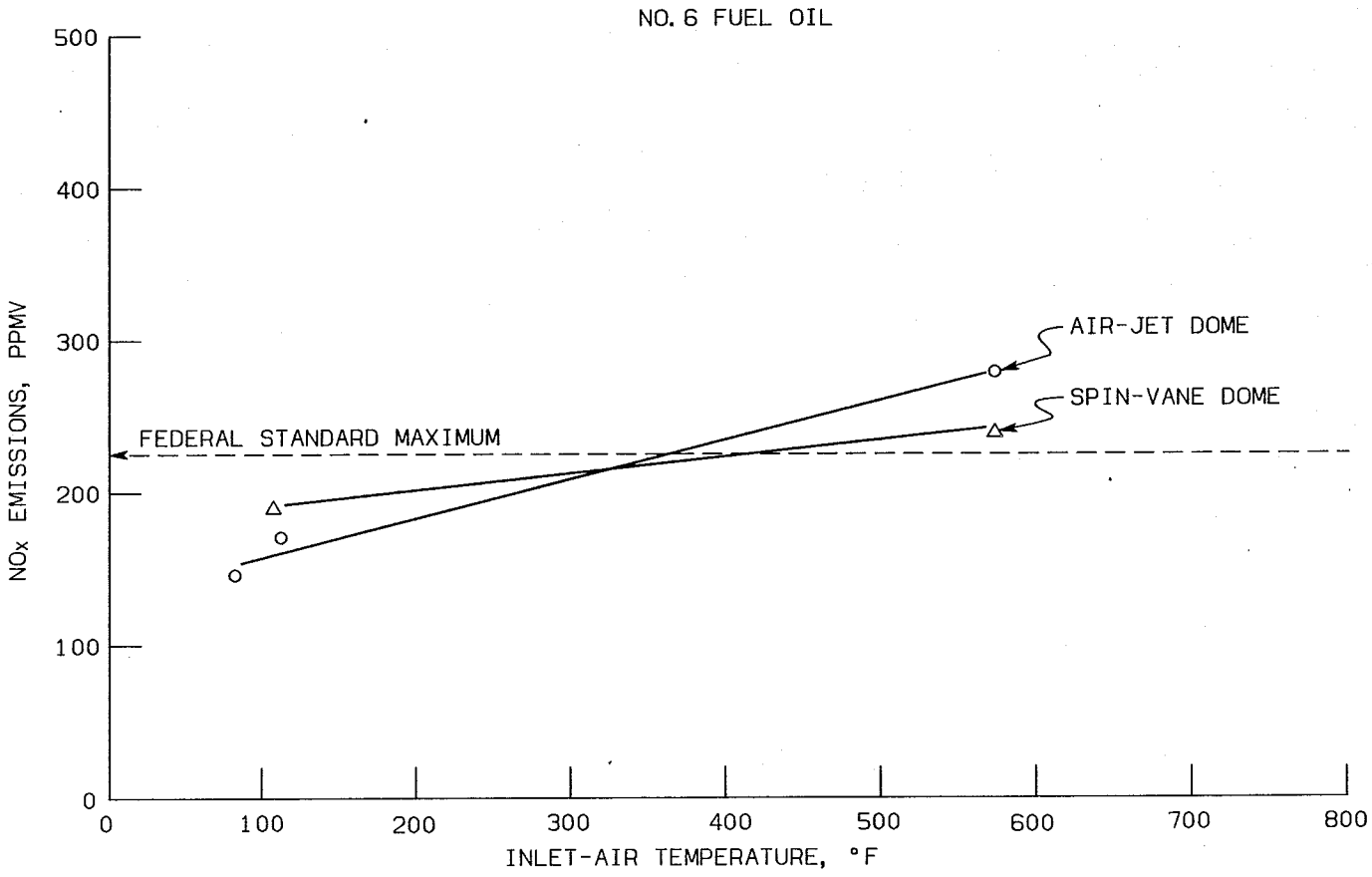
Figure 77:
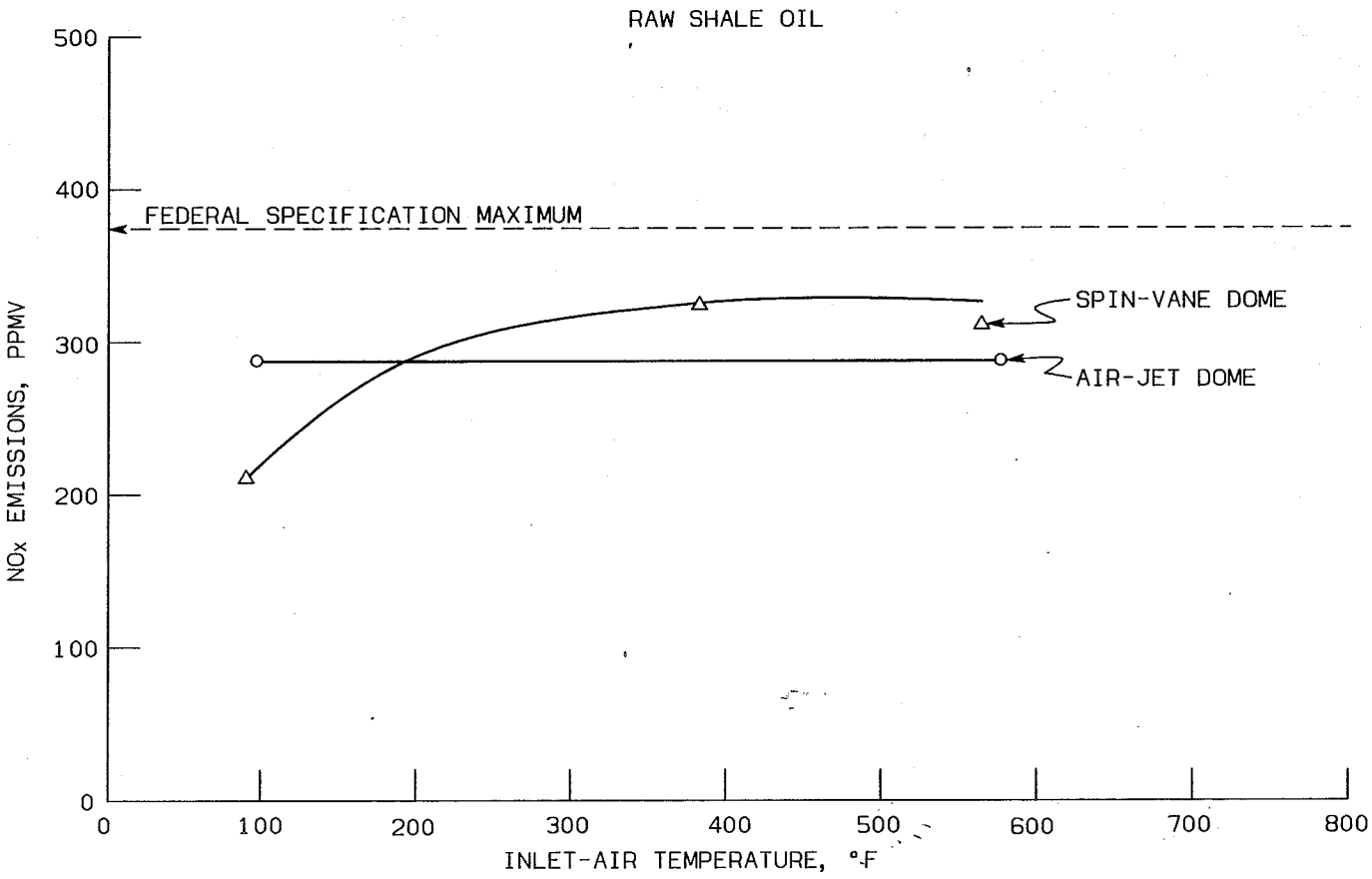

Finally, the performance of the prototype burners is summarized in FIG. 76 for operation on No. 6 fuel oil and FIG. 77 for operation on raw shale oil.

By way of summary, in accordance with the present invention, for most fuels and the various combustors hereof, the operating variables are within the limits set forth below.

The primary region fuel-air equivalence ratio should be between 1.0 and 1.8. Preferably, for a light fuel with high concentrations of nitrogen the equivalence ratio is between about 1.05 and about 1.7 and ideally about 1.14 to about 1.56. For a heavier oil, such as shale oil, the preferred range is about 1.3 to about 1.7 and ideally about 1.4 to about 1.65.

The residence time within the primary combustion region should be between about 30 milliseconds and about 140 milliseconds. For a light fuel the preferred range is about 30 to about 120 milliseconds and ideally between about 45 and about 75 milliseconds. For heavy fuels the preferred range is about 35 to about 140 milliseconds and ideally about 100 to 140 milliseconds.

When primary air is also introduced in a swirling fashion at a point, downstream from the point of introduction of primary air immediately adjacent the fuel inlet, the volume of swirl air should be about 35 to about 100% of the total primary air utilized.

The fuel-air equivalence ratio in the secondary combustion region should be such as to produce an overall fuel-air equivalence ratio between about 0.50 and 1.0, preferably between 0.75 and 0.87 and most preferably 0.87.

The residence time in the secondary combustion region should be at least about 15 milliseconds and preferably at least about 30 milliseconds.

Stated in terms of the results to be obtained, the fuel nitrogen of the fuel should be converted to not more than 10% $NO_x$, preferably not more than 7.5% and ideally not more than 5.0% and the CO content of the flue gas should be less than about 300 ppmv. For a powdered fuel, such as a typical Western Kentucky coal, these fuel $NO_x$ limits of 10%, 7.5% and 5.0% represent about 0.350, 0.262 and 0.175 lb. fuel $NO_x$/Million Btu, respectively. Corresponding values for a typical crude solvent refined coal oil are 0.216, 0.162 and 0.108, respectively; for shale oil A, exemplified herein, 0.344, 0.258 and 0.172, respectively; for shale oil B, exemplified herein, 0.329, 0.247, and 0.164, respectively; and for the light fuel with 2.0% bound nitrogen, exemplified herein, 0.322, 0.242 and 0.161, respectively. Accordingly, the operating variables should be selected and correlated to reduce the fuel $NO_x$ emissions to less than about 0.350 lb./Million Btu, preferably to less than about 0.290 and ideally to less than 0.180 and the total $NO_x$ in the flue gas to less than 0.450, 0.365 and 0.275 lb. total $NO_x$/MM Btu, respectively.

The term "air" is employed generically herein and in the claims to include air and other combustion-supporting gases.

While the invention has been described above in terms of using a liquid fuel, the invention is not limited to the use of liquid fuels. It is within the scope of the invention to use vaporous or gaseous fuels, including prevaporized liquid fuels. It is also within the scope of the invention to use finely divided solid fuels, e.g., powdered coal.

While certain embodiments of the invention have been described for illustrative purposes, the invention is not limited thereto. Various other modifications or embodiments of the invention will be apparent to those skilled in the art in view of this disclosure. Such modifications or embodiments are within the spirit and scope of the disclosure.

I claim:

1. A plurality of combustion processes, each in an individual combustion zone having a primary combustion region and a secondary combustion region, comprising:

initiating a fuel-rich combustion stage, in said primary combustion region of each of said plurality of combustion zones, by burning a fuel-rich combustion mixture, comprising a fuel and a first volume of a preimary air source and having a fuel-air ratio greater than the stochiometric ratio, for a period of time sufficient to produce a moving primary combustion stage effluent comprising a flame front, unburned fuel and partially burned fuel;

abruptly terminating said fuel-rich combustion stage and initiating a fuel-lean combustion stage, in said secondary combustion region of each of said plurality of combustion zones, by reducing the peripheral dimension of said moving primary combustion region effluent and introducing into said moving primary combustion region effluent a second volume of a secondary air source to produce a fuel-lean combustion mixture having a fuel-air ratio less than the stochiometric ratio, said second volume of said secondary air being introduced at a longitudinally narrow zone immediately before said reduction of the peripheral dimension of said primary combustion region effluent; and burning said fuel-lean combustion mixture, in said secondary combustion region of each of said plurality of combustion zones, to produce a moving secondary combustion stage effluent.

2. A process in accordance with claim 1 wherein the peripheral dimension of said moving primary combustion stage effluent, in each of said plurality of combustion zones, is expanded after said reduction of the peripheral dimension of said primary combustion region effluent.

3. A plurality of combustion processes, each in an individual combustion zone having a primary combustion region and a secondary combustion region, comprising:

introducing a fuel into said primary combustion region, of each of said plurality of combustion zones, from a generally central location of said primary combustion regions and in a generally axial direction to form at least a part of a generally axial flow component;

introducing a first volume of a primary air source, comprising a first stream of primary air and a second stream of primary air, into said primary combustion region of each of said plurality of combustion zones, in proportions sufficient to produce a fuel-rich combustion mixture having a fuel-air ratio above 1, wherein said first stream of primary air forms a first portion of a generally radial flow component which contacts and mixes with said axial flow component by being introduced from a peripheral location about said axial flow component and in a direction generally inwardly toward the axis of said axial flow component, and wherein said second stream of primary air forms a second portion of a generally radial flow component which contacts and mixes with said axial flow component by being introduced at a location upstream from the introduction of said first stream of said primary air, said second stream of said primary air being introduced from a peripheral location about said axial flow component, and in a direction generally inwardly toward the axis of said axial flow component, the ratio of said axial flow component to said radial flow component being such that intimate mixing of said fuel and said first volume of said primary air source is attained;

initiating a fuel-rich combustion stage, in said primary combustion region of each of said plurality of combustion zones, by introducing said fuel-rich combustion mixture into said primary combustion region and partially burning said fuel-rich combustion mixture to produce a moving primary combustion region effluent comprising a flame front, unburned fuel and partially burned fuel, said moving primary combustion region effluent being maintained in said fuel-rich combustion stage for at least 35 milliseconds;

abruptly terminating said fuel-rich combustion stage and initiating a fuel-lean combustion stage, in said secondary combustion region of each of said plurality of combustion zones, by introducing into said moving primary combustion region effluent a second volume of a secondary air source air to produce a fuel-lean combustion mixture having a fuel-air ratio less than 1, said moving primary combustion region effluent and said second volume of secondary air being simultaneously introduced into said secondary combustion region in a manner which prevents backflow of said second volume of secondary air into said primary combustion region; and burning said fuel-lean combustion mixture, in said secondary combustion region of each of said plurality of combustion zones, to produce a moving secondary combustion region effluent.

4. A method in accordace with claim 3 wherein the introduction of said second stream of said first volume of primary air is variable with relation to introduction of said first stream of said first volume of primary air, wherein the introduction of said second stream of said first volume of primary air is varied to adjust the ratio of said axial flow component and said radial flow component.

5. A method in accordance with claim 3 wherein said radial flow component further includes a third stream of said first of primary air being introduced in a generally swirling manner about said axial flow component.

6. A method in accordance with claim 5 wherein said first stream of said first volume of primary air is introduced in a generally swirling manner about said axial flow component, and wherein said third stream of said first volume of primary air is introduced downstream from the introduction of said first stream of said first volume of primary air.

7. A method in accordance with claim 6 wherein said swirling first stream of said first volume of primary air and said swirling third stream of said first volume of primary air swirl in opposite directions.

8. A method in accordance with claim 3, wherein said fuel-rich combustion mixture, in each of said plurality of combustion zones, is reduced in its peripheral dimension at a point immediately after said axial flow component is contacted by said first stream of said first volume of primary air and is then expanded to the full diameter of said primary combustion region.

9. A method in accordance with claim 3 wherein said moving primary combustion region effluent is reduced in its peripheral dimension from the full diameter of said primary combustion region and is thereafter expanded to the full diameter of said secondary combustion region.

10. A method for the combustion of a fuel containing chemically bound nitrogen in a combustion zone to produce combustion gases having low emissions of $NO_x$ pollutants contained therein, and reducing the conversion of said nitrogen-containing fuel to $NO_x$, said combustion zone having an upstream fuel-air mixing region, a primary combustion region downstream from and in communication with said upstream fuel-air mixing region, and a secondary combustion region downstream from and in communication with said primary combustion region, said method comprising:

introducing a stream of fuel into said upstream fuel-air mixing region;

introducing at least one stream of a primary air source into said fuel-air mixing region in a swirling direction around said fuel and in an amount sufficient to produce a fuel-rich combustible mixture of fuel and air having a fuel-air ratio within the range from about 1.05 to about 1.7;

passing said fuel-rich combustible mixture into said primary combustion region and therein causing only partial combustion of said fuel-rich combustible mixture, producing a moving primary combustion region effluent comprising a flame front, unburned fuel and partially burned fuel, wherein said fuel-rich combustion mixture is maintained in said primary combustion region for a period of time sufficient to provide a total residence time in said fuel-air mixing region and said primary combustion region within the range from about 35 to about 120 milliseconds;

passing said moving primary combustion region effluent into said secondary combustion region;

introducing into said secondary combustion region, a second stream of secondary air in an amount sufficient to produce a fuel-lean combustion mixture having a fuel-air ratio of less than 1; and burning said fuel-lean combustion mixture in said secondary combustion region of each of said plurality of combustion zones to produce a secondary combustion region effluent, comprising a moving fuel-lean flame front and combustion gases having low emissions of $NO_x$ pollutants contained therein.

11. A method for the combustion of a fuel containing chemically bound nitrogen in a combustion zone to produce combustion gases having low emissions of $NO_x$ pollutants contained therein, including reduced conversion of said nitrogen-containing fuel to $NO_x$, said combustion zone having an upstream fuel-air mixing region, a primary combustion region downstream from and in communication with said upstream fuel-air mixing region, and a secondary combustion region downstream from and in communication with said primary combustion region, said method comprising:

introducing a stream of fuel into the upstream end portion of said fuel-air mixing region;

introducing a first stream of a primary air into said upstream end portion of said fuel-air mixing region in a swirling direction around said stream of fuel, tangential to the wall of said fuel-air mixing region and in one of (a) a clockwise direction or (b) a counter-clockwise direction, looking downstream in said fuel-air mixing region;

introducing a second stream of primary air into the downstream end portion of said fuel-air mixing region in a swirling direction around said stream of fuel, tangential to said wall of said fuel-air mixing region and in the other of said clockwise direction or said counter-clockwise direction, wherein the total amount of primary air introduced into said fuel-air mixing region through said first stream of primary air and said second stream of primary air is sufficient to form a fuel-rich combustible mixture of fuel and air having a fuel-air equivalence ratio within the range from 1.05 to about 1.7;

passing said fuel-rich combustible mixture into said primary combustion region and therein causing only partial combustion of said fuel-rich combustible mixture and forming a moving primary combustion region effluent comprising a flame front, unburned fuel and partially burned fuel, wherein said fuel-rich combustible mixture is maintained in said primary combustion region for a period of time sufficient to provide a total residence time in said fuel-air mixing region and said primary combustion region within the range from about 35 to about 120 milliseconds, the total amount of said first stream of primary air and said second stream of primary air being within the range from about 35 to about 100 volume percent of a total amount of air introduced into said fuel-air mixing region;

passing said moving primary combustion region effluent into said secondary combustion region; and introducing a stream of secondary air into said secondary combustion region in an amount sufficient to provide a fuel-lean combustion mixture having a fuel-air equivalence ratio of less than 1; and burning said fuel-lean combustion mixture in said secondary combustion region to produce a secondary combustion region effluent, comprising a moving fuel-lean flame front and combustion gases having low emissions of $NO_x$ pollutants contained therein.

12. A method in accordance with claim 11 wherein a third stream of primary air is introduced into said fuel-air mixing region at a location upstream from the location of the introduction of said first stream of primary air, wherein said third stream of primary air being up to about 65 volume percent of said total amount of primary air streams introduced into said fuel-air mixing region.

13. A method in accordance with claim 11 wherein said first volume of primary air and said second volume of secondary air are supplied from a single air plenum surrounding the said combustion zones.

* * * * *